US009851670B2

(12) United States Patent
Takeuchi et al.

(10) Patent No.: US 9,851,670 B2
(45) Date of Patent: Dec. 26, 2017

(54) IMAGE FORMING APPARATUS TO SUPPRESS EXCESSIVE INTERPOSING TONER

(71) Applicant: CANON KABUSHIKI KAISHA, Tokyo (JP)

(72) Inventors: Yasushi Takeuchi, Moriya (JP); Takayuki Ganko, Tokyo (JP); Koji Arimura, Toride (JP); Yusuke Ishida, Toride (JP); Takanori Iida, Noda (JP); Toshiyuki Yamada, Kashiwa (JP); Daisuke Makino, Toride (JP); Taisuke Matsuura, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/244,928

(22) Filed: Aug. 23, 2016

(65) Prior Publication Data

US 2017/0060061 A1 Mar. 2, 2017

(30) Foreign Application Priority Data

Aug. 28, 2015 (JP) ..... 2015-168420

(51) Int. Cl.

| | |
|---|---|
| ***G03G 15/08*** | (2006.01) |
| ***G03G 15/16*** | (2006.01) |
| ***G03G 21/14*** | (2006.01) |
| ***G03G 15/00*** | (2006.01) |
| ***G03G 15/02*** | (2006.01) |
| ***G03G 15/06*** | (2006.01) |

(52) U.S. Cl.
CPC ..... *G03G 15/50* (2013.01); *G03G 15/0266* (2013.01); *G03G 15/065* (2013.01)

(58) Field of Classification Search
CPC ..... G03G 15/50
USPC ..... 399/38, 66
See application file for complete search history.

(56) References Cited

U.S. PATENT DOCUMENTS 8,995,862 B2 * 3/2015 Mizukoshi ..... G03G 15/50 399/71

FOREIGN PATENT DOCUMENTS

| | | | |
|---|---|---|---|
| JP | 2004-286985 | A | 10/2004 |
| JP | 2006-072007 | A | 3/2006 |
| JP | 2009-145534 | A | 7/2009 |

OTHER PUBLICATIONS

Computer translation of JP2004-286985A, Oct. 2004, Junichi et al.*
Computer translation of JP2009-145534A, Jul. 2009, Hironao et al.*

* cited by examiner

*Primary Examiner* — Quana M Grainger
(74) *Attorney, Agent, or Firm* — Canon U.S.A., Inc. IP Division

(57) ABSTRACT

When ending image forming, a state is realized where charging by a charging roller is stopped (charging bias off) and also applying DC voltage at a developing device is stopped (developing bias DC off). In this state, AC voltage is applied to the developing device (developing bias AC on), thereby adhering toner to the surface of a photosensitive drum and forming interposing toner. Driving of the photosensitive drum and an intermediate transfer belt is then stopped in the state with the interposing toner interposed between the photosensitive drum and intermediate transfer belt.

17 Claims, 50 Drawing Sheets

| | DUTY RATIO |
|---|---|
| ΔVpatch < −75 | 56 |
| −75 ≤ ΔVpatch < −50 | 54 |
| −50 ≤ ΔVpatch < −25 | 52 |
| −25 ≤ ΔVpatch < 25 | 50 |
| 25 ≤ ΔVpatch < 50 | 48 |
| 50 ≤ ΔVpatch < 75 | 46 |
| 75 ≤ ΔVpatch | 44 |

| | DUTY RATIO OFFSET AMOUNT |
|---|---|
| $\Delta I < -0.45$ V | +3% |
| $-0.45$ V $\leq \Delta I < -0.3$ V | +2% |
| $-0.3$ V $\leq \Delta I < -0.15$ V | +1% |
| $-0.15$ V $\leq \Delta I < 0.15$ V | 0 |
| $0.15$ V $\leq \Delta I < 0.3$ V | −1% |
| $0.3$ V $\leq \Delta I < 0.45$ V | −2% |
| $0.45 \leq \Delta I$ | −3% |

| RELATIVE HUMIDITY (%) | DUTY RATIO |
|---|---|
| RH ≤ 15 | 56% |
| 15 < RH ≤ 25 | 53% |
| 25 < RH ≤ 45 | 50% |
| 45 < RH ≤ 60 | 47% |
| 60 < RH | 44% |

FIG. 33

| PROCESS SPEED | DUTY RATIO |
|---|---|
| 250 mm/sec | 50% |
| 125 mm/sec | 46% |

FIG. 34

| DETERMINATION OF STREAK LEVEL | | TEMPERATURE T (°C) | | | | |
|---|---|---|---|---|---|---|
| | | 15 | 20 | 25 | 30 | 35 |
| DENSITY OF INTERPOSING TONER (X-RITE) | 0.08 | GOOD | GOOD | GOOD | GOOD | GOOD |
| | 0.04 | GOOD | GOOD | GOOD | FAIR | POOR |
| | 0.01 | GOOD | GOOD | FAIR | POOR | POOR |

FIG. 36
| TEMPERATURE (°C) | DUTY RATIO |
|---|---|
| T ≤ 15 | 44% |
| 15 < T ≤ 20 | 47% |
| 20 < T ≤ 25 | 50% |
| 25 < T ≤ 30 | 53% |
| 30 < T | 56% |
FIG. 37
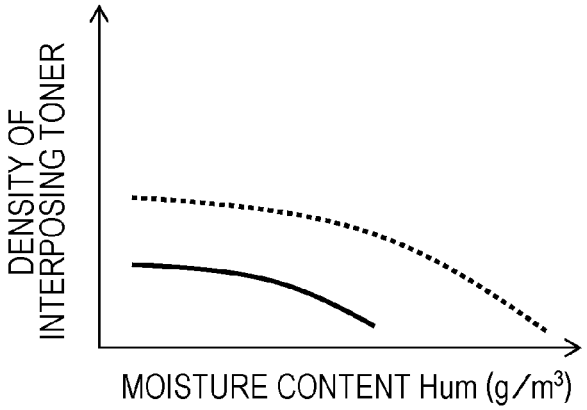
FIG. 38
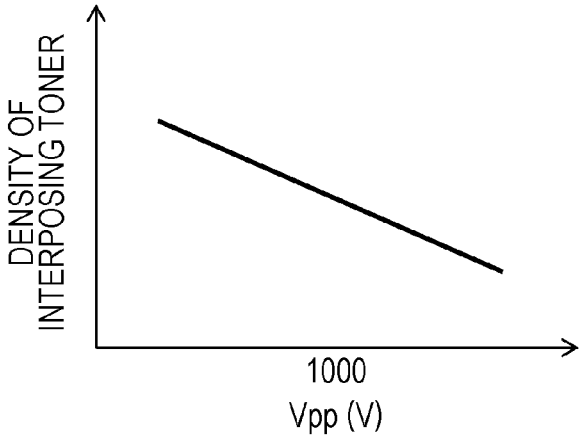

| MOISTURE CONTENT (g/m$^3$) | Vpp |
|---|---|
| Hum ≤ 2 | 1100 V |
| 2 < Hum ≤ 5 | 1050 V |
| 5 < Hum ≤ 15 | 1000 V |
| 15 < Hum ≤ 20 | 880 V |
| 20 < Hum | 800 V |

FIG. 42A

| DETERMINATION OF STREAK LEVEL | | INTERMEDIATE TRANSFER BELT USAGE HISTORY COUNT n | | | | |
|---|---|---|---|---|---|---|
| | | 0 | 100 k | 200 k | 300 k | 500 k |
| DENSITY OF INTERPOSING TONER | c | GOOD | GOOD | GOOD | GOOD | GOOD |
| | b | GOOD | GOOD | GOOD | GOOD | GOOD |
| | a | POOR | POOR | FAIR | GOOD | GOOD |

FIG. 42B

| | INTERMEDIATE TRANSFER BELT USAGE HISTORY COUNT n | | | |
|---|---|---|---|---|
| | 0 | 100 k | 200 k | 300 k |
| DENSITY OF INTERPOSING TONER | c | c | c | a |

FIG. 44

| DETERMINATION OF STREAK LEVEL | | INTERMEDIATE TRANSFER BELT USAGE HISTORY COUNT n | | | | |
|---|---|---|---|---|---|---|
| | | 0 | 100 k | 200 k | 300 k | 500 k |
| DENSITY OF INTERPOSING TONER | c | GOOD | GOOD | GOOD | GOOD | GOOD |
| | b | GOOD | GOOD | GOOD | GOOD | GOOD |
| | a | POOR | POOR | FAIR | GOOD | GOOD |
| | NONE | POOR | POOR | POOR | FAIR | GOOD |

FIG. 45

| | INTERMEDIATE TRANSFER BELT USAGE HISTORY COUNT n | | | | |
|---|---|---|---|---|---|
| | 0 | 100 k | 200 k | 300 k | 500 k |
| DENSITY OF INTERPOSING TONER | c | c | c | a | NONE |

| | NUMBER OF TIMES OF SECONDARY TRANSFER CLEANING |
|---|---|
| $\Delta Vpatch < -25$ | 1 set |
| $-25 \leq \Delta Vpatch < 25$ | 2 set |
| $25 \leq \Delta Vpatch < 75$ | 3 set |
| $75 \leq \Delta Vpatch$ | 4 set |

| | OFFSET AMOUNT OF NUMBER OF TIMES OF SECONDARY TRANSFER CLEANING |
|---|---|
| $\Delta I < -0.3$ V | +1 set |
| $-0.3$ V $\leq \Delta I < 0.3$ V | 0 |
| 0.3 V $\leq \Delta I < 0.45$ V | +3 sets |
| 0.45 V $\leq \Delta I$ | +4 sets |

| RELATIVE HUMIDITY (%) | NUMBER OF TIMES OF SECONDARY TRANSFER CLEANING |
|---|---|
| RH ≤ 25 | 1 set |
| 25 < RH ≤ 45 | 2 sets |
| 45 < RH ≤ 60 | 3 sets |
| 60 < RH | 4 sets |

| | NUMBER OF TIMES OF SECONDARY TRANSFER CLEANING | |
|---|---|---|
| RELATIVE HUMIDITY (%) | PS250 mm/sec | PS125 mm/sec |
| RH ≤ 25 | 1 set | 1 set |
| 25 < RH ≤ 45 | 2 sets | 3 sets |
| 45 < RH ≤ 60 | 3 sets | 5 sets |
| 60 < RH | 4 sets | 8 sets |

| | NUMBER OF TIMES OF SECONDARY TRANSFER CLEANING |
|---|---|
| HIGH-QUALITY PAPER | 2 sets |
| RECYCLED PAPER | 1 set |
| COATED ONE SIDE | 3 sets |
| COATED BOTH SIDES | 3 sets |
| EMBOSSED | 1 set |
| VELLUM | 2 sets |

FIG. 62

| SIGNAL VALUE | NUMBER OF TIMES OF SECONDARY TRANSFER CLEANING |
|---|---|
| LESS THAN 80 | 1 set |
| 80 THROUGH 160 | 2 sets |
| 160 THROUGH 255 | 3 sets |

FIG. 63

| | | | | | | |
|---|---|---|---|---|---|---|
| | | 15 min | 30 min | 60 min | 120 min | 180 min |
| MOISTURE CONTENT ($g/m^3$) | 0.86 | NONE | NONE | NONE | NONE | STREAKS |
| | 2 | NONE | NONE | NONE | STREAKS | STREAKS |
| | 8.9 | NONE | NONE | STREAKS | STREAKS | STREAKS |
| | 18 | NONE | STREAKS | STREAKS | STREAKS | STREAKS |
| | 21.6 | STREAKS | STREAKS | STREAKS | STREAKS | STREAKS |

| | INTERPOSING TONER USED |
|---|---|
| UP TO 10,000 SHEETS | YES |
| 10,001 SHEETS OR MORE | NO |

| | |
|---|---|
| 2TrI(1) | 50 μA |
| 2TrI(2) | 40 μA |

FIG. 74

| CURRENT VALUE AT FIRST STAGE OF SECONDARY TRANSFER ATVC ($\mu$A) | 30 | 40 | 50 | 60 | 70 | 80 | 90 |
|---|---|---|---|---|---|---|---|
| LEVEL OF OCCURRENCE OF BACKSIDE CONTAMINATION OF RECORDING MEDIUM | POOR | POOR | POOR | FAIR | GOOD | GOOD | GOOD |

IMAGE FORMING APPARATUS TO SUPPRESS EXCESSIVE INTERPOSING TONER

BACKGROUND OF THE INVENTION

Field of the Invention

The present disclosure generally relates to an electrophotographic or electrostatic image forming apparatus, such as a multifunction apparatus having multiple functions of a copier, printer, and facsimile.

Description of the Related Art

There conventionally has been known a configuration of an image forming apparatus where a toner image is transferred from a photosensitive drum (image bearing member) to an intermediate transfer belt (rotating member), and the toner image transferred into the intermediate transfer belt is transferred onto a recording medium. In such a configuration, if the photosensitive drum and intermediate transfer belt stop in a state in contact with each other, and this state continues for a prolonged period, constituents such as, for example, rubber material, fluorine compounds, and so forth of the intermediate transfer belt may migrate onto the photosensitive drum. When such constituents migrate onto the photosensitive drum, this can change charging properties of the photosensitive drum when forming the next image, and can lead to image defects such as streaks being manifested in halftone images. There has been proposed a configuration where toner is interposed between a photosensitive belt (image bearing member) and the intermediate transfer belt when image formation ends (e.g., Japanese Patent Laid-Open No. 2006-72007). However, if too much toner is interposed between the photosensitive drum and intermediate transfer belt in this configuration, cleaning this toner off before forming the next image will take time. It has been found desirable to provide a configuration where the amount of toner interposed between the image bearing member and the rotating member can be prevented from being excessive.

SUMMARY OF THE INVENTION

According to an aspect of the present disclosure, an image forming apparatus includes: an image bearing member configured to bear an image thereon; a charging device configured to charge a surface of the image bearing member; an exposing device configured to expose the charged surface of the image bearing member and form an electrostatic latent image; a developing device configured to develop the electrostatic latent image formed on the surface of the image bearing member by voltage being applied where AC voltage has been superimposed on DC voltage; a rotating member, provided rotatably, and disposed in contact with the image bearing member; and a control unit. The control unit is configured to effect control to, corresponding to an end of an image forming job, stop application of the DC voltage by the charging device in a state where the image bearing member is driven, stop application of the DC voltage of the developing device after the surface of the image bearing member facing the charging device when the application of DC voltage by the charging device stops has passed the developing device, and stop driving of the image bearing member after application of DC voltage by the developing device has stopped. The control unit is configured to execute a mode of controlling driving of the image bearing member, corresponding to an end of the image forming job, after stopping application of the DC voltage at the charging device and the developing device, the control unit drives the image bearing member in a state with AC voltage applied to the developing device so as to adhere toner to the image bearing member, and controls driving of the image bearing member so that the surface of the image bearing member, that has passed a position facing the developing device at a time of AC voltage being applied to the developing device, stops at a position in contact with the rotating member.

Further features of the present disclosure will become apparent from the following description of exemplary embodiments with reference to the attached drawings.

BRIEF DESCRIPTION OF THE DRAWINGS

FIG. 33 is a diagram of a table showing duty ratio of the square bias waveform as to process speed according to the ninth embodiment.

FIG. 34 is a diagram illustrating the level of streaks as to temperature, at each density of interposing toner, according to a tenth embodiment.

FIG. 36 is a diagram of a table showing duty ratio of the square bias waveform as to temperature, according to the tenth embodiment.

FIG. 37 is a diagram illustrating the relationship between moisture content and interposing toner amount according to an eleventh embodiment.

FIG. 38 is a diagram illustrating the relationship between Vpp of the square bias waveform and interposing toner density according to the eleventh embodiment.

FIGS. 42A and 42B are tables relating to the twelfth embodiment, FIG. 42A illustrating the level of streaks as to temperature, at each density of interposing toner, and FIG. 42B a table of interposing toner density as to usage history.

FIG. 44 is a diagram illustrating the level of streaks as to usage history for each interposing toner density according to a thirteenth embodiment.

FIG. 45 is a table showing interposing toner density as to usage history according to a thirteenth embodiment.

FIG. 62 is a diagram of a table showing the number of times of cleaning as to signal values of a surface detection sensor according to the nineteenth embodiment.

FIG. 63 is a diagram illustrating whether or not streaks occur, with regard to the moisture content and standby time during which the photosensitive drum and intermediate transfer belt have not been driven, according to a twentieth embodiment.

FIG. 74 is a diagram illustrating occurrence of backside contamination of the recording medium, as to the current value of secondary transfer Active Transfer Voltage Control (ATVC) according to the twenty-second embodiment.

DESCRIPTION OF THE EMBODIMENTS

Hereinafter, image forming according to embodiments of the present disclosure will be described in detail with reference to the accompanying drawings. Note that configurations described in the embodiments are merely examples, and the scope of the present disclosure is not limited to the configurations.

First Embodiment

A first embodiment will be described with reference to FIGS. 1 through 7. First, a schematic configuration of the image forming apparatus according to the present embodiment will be described with reference to FIG. 1.

Image Forming Apparatus

An image forming apparatus 100 is a full-color electrophotography image forming apparatus using a tandem intermediate transfer system, where multiple image forming stations Sa, Sb, Sc, and Sd, that each have different toner colors, are arrayed in the rotation direction of an intermediate transfer belt 51. The image forming stations (process units) Sa, Sb, Sc, and Sd form toner images of the colors yellow, magenta, cyan, and black, respectively. The configurations of the image forming stations Sa through Sd are essentially the same, except that the color of the toner used is different. Accordingly, common configurations will be described using the image forming station Sa representatively. Configurations of the other image forming stations will be appended by the suffixes b, c, and d, to indicate that they are configurations of the respective stations, and description thereof will be omitted.

The image forming station Sa includes a photosensitive drum (photosensitive member) 1*a* serving as an image bearing member. Disposed around the photosensitive drum 1*a* are a charging roller 2*a*, a laser scanner 3*a*, a developing device 4*a*, a drum cleaner 6*a*, and so forth, in that order along the rotational direction of the photosensitive drum 1*a*. The intermediate transfer belt 51 is disposed adjacent to the photosensitive drums 1*a* through 1*d* of the image forming stations Sa through Sd, and circles around so as to serve as an intermediate transfer member (rotating member).

The photosensitive drum 1*a* is rotatably supported by a frame of the image forming apparatus main body. The photosensitive drum 1*a* is a cylindrical electrophotography photosensitive member of which the primary configuration is an electroconductive base member of aluminum or the like, and a photoconductive layer formed on the outer periphery thereof. The photosensitive drum 1*a* has a supporting axis at the center thereof, and is rotationally driven by a motor (driving source) at a speed (process speed) of 250 mm/sec for example, on the supporting axis in the direction indicated by the arrow. The charging polarity of the photosensitive drum 1*a* is negative in the present embodiment. The outer diameter thereof is 30 mm.

Figure 1:
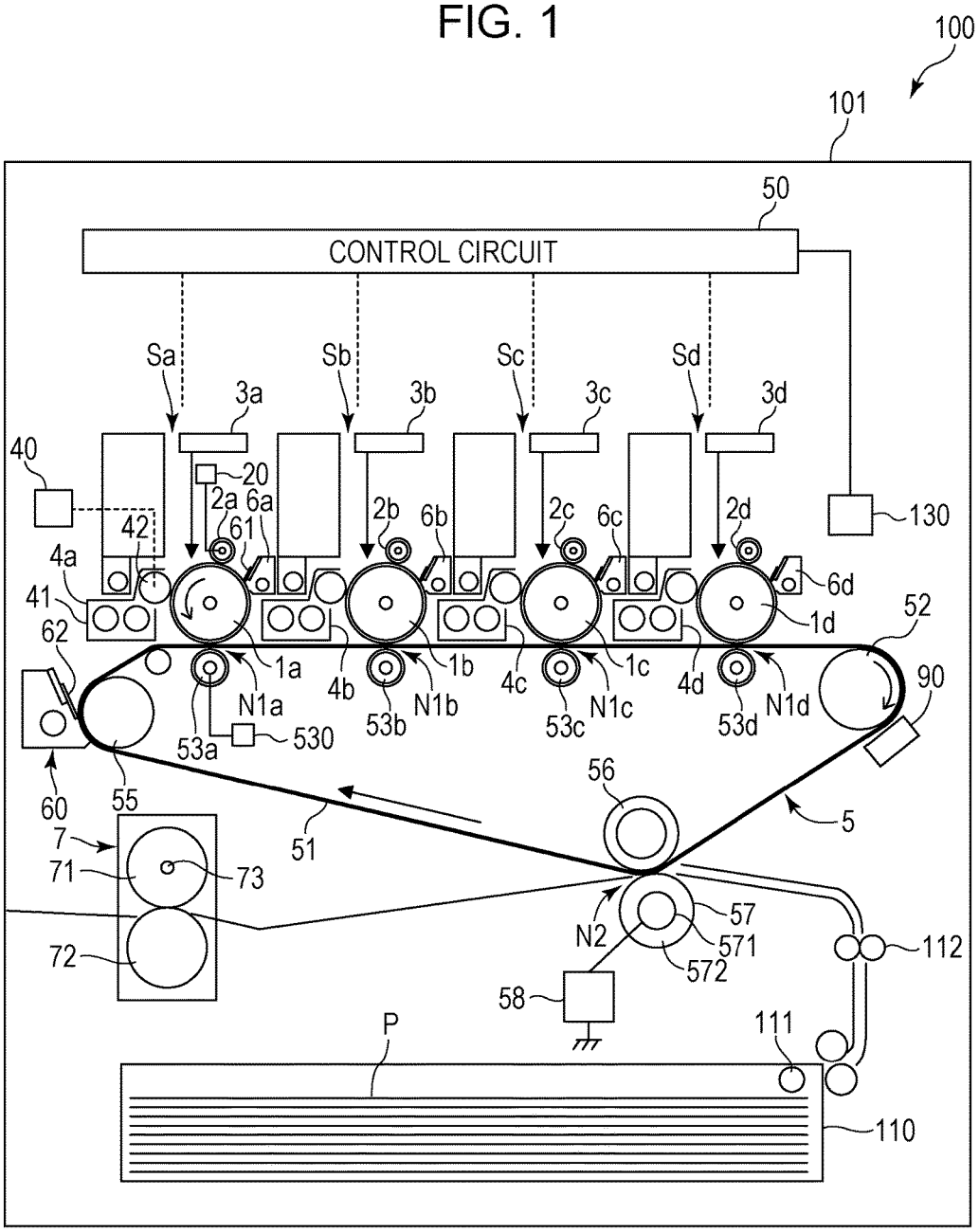
FIG. 1 is a schematic configuration diagram according to an image forming apparatus according to a first embodiment.

The charging roller 2*a* (charging device) serving as a charging unit is disposed above the photosensitive drum 1*a* in FIG. 1, comes into contact with the surface of the photosensitive drum 1*a*, and uniformly charges the surface of the photosensitive drum 1*a* to a predetermined polarity and potential. The charging roller 2*a* has an electroconductive core metal at the middle thereof, and a low-resistance electroconductive layer and medium resistance electroconductive layer formed on the outer perimeter periphery thereof, so as to be overall configured as a roller. The charging roller 2*a* has both end portions of the core metal rotate supported by bearing members (omitted from illustration), and is disposed in parallel to the photosensitive drum 1*a*. The bearing members at the end portions are urged toward the photosensitive drum 1*a* by bias units (not illustrated) such as springs or the like. Accordingly, the charging roller 2*a* is pressed against the surface of the photosensitive drum 1*a* at a certain pressing force, and rotates being driven by the rotation of the photosensitive drum 1*a*. A charging bias voltage is applied to the charging roller 2*a* by a charging bias power source 20 serving as a charging bias applying unit. The surface of the photosensitive drum 1*a* is thus uniformly charged by contact charging.

The laser scanner 3*a* serving as an exposing unit irradiates the photosensitive drum 1*a*, on the downstream side of the charging roller 2*a* in the rotation direction of the photosensitive drum 1*a*, by laser light. The laser scanner 3*a* exposes the surface of the photosensitive drum 1*a* by scanning while turning a laser beam off and one based on image information. This forms an electrostatic latent image on the photosensitive drum 1*a* in accordance with the image information.

The developing device 4*a* serving as a developing unit is disposed downstream from the exposure position of the laser scanner 3*a* in the rotational direction of the photosensitive drum 1*a*. The developing device 4*a* has a developer container 41 that accommodates a 2-component developer of non-magnetic toner particles (toner) and magnetic carrier particles (carrier), and a developing sleeve 42 serving as a developer carrying member that is rotationally supported by the developer container 41. The toner and carrier are stirred while being conveyed within the developer container 41, whereby the toner is negatively charged and the carrier is positively charged.

The developing sleeve 42 rotates while carrying the developer within the developer container 41. A voltage (developing bias) obtained by superimposing an alternating current (AC) voltage on a direct current (DC) voltage from a developing bias power source 40 serving as a developing bias applying unit is applied to the developing sleeve 42. For example, a square-wave AC bias having a frequency of 10 KHz and amplitude of 1000 volts (V) is used in the present embodiment as AC voltage (alternating current voltage). The developing bias applied to the developing sleeve 42 causes the toner carried by the developing sleeve 42 to fly toward the photosensitive drum 1*a*, so the electrostatic latent image on the photosensitive drum 1*a* is visualized (developed) and becomes a visible image (toner image).

Figure 2:
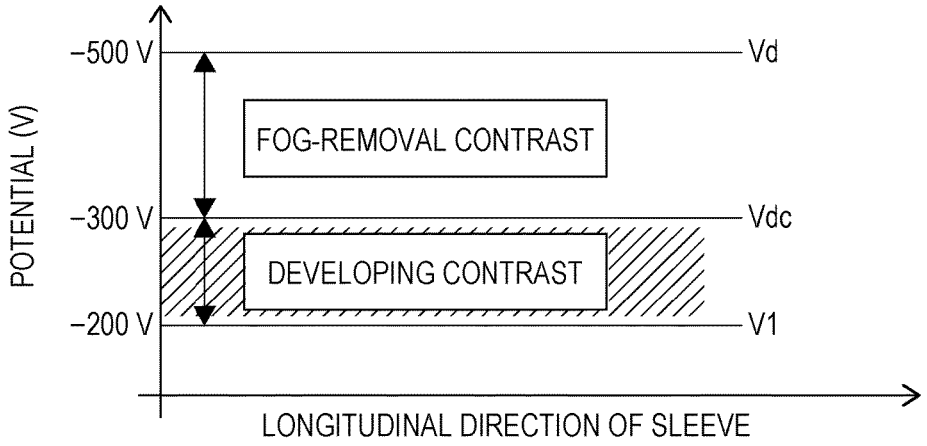
FIG. 2 is a diagram regarding surface potential of the photosensitive drum when forming images in the first embodiment.
Figure 3:
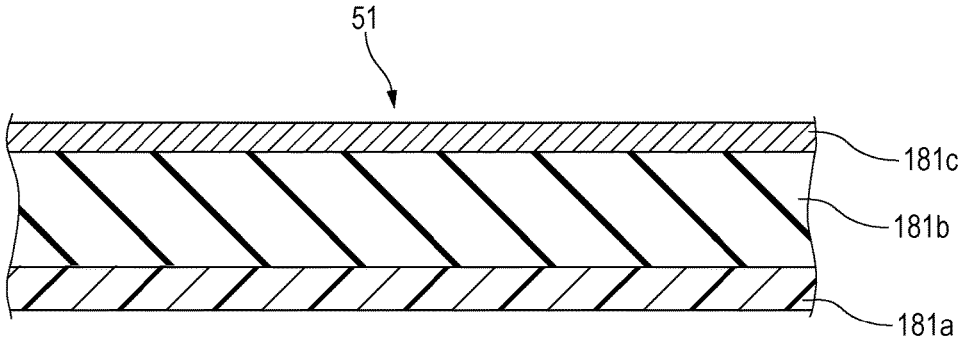
FIG. 3 is a schematic diagram illustrating a cross-section of the intermediate transfer belt according to the first embodiment.

FIG. 2 illustrates a surface potential relationship, relating to the rotation axis direction (longitudinal direction of sleeve) of the developing sleeve 42 of the photosensitive drum 1*a* when forming an image. In FIG. 2, Vd represents the charging potential of the photosensitive drum 1*a*, Vdc represents the DC component of the developing bias, and V1 represents the potential of the exposure portion exposed by the laser scanner 3*a*. Exposing the surface of the photosensitive drum 1*a* charged to −500 V forms a −200 V electrostatic latent image. Applying developing bias having a −300 V DC component causes negatively-charged toner to adhere to the exposed portion, thereby developing the electrostatic latent image. Note that the difference between Vdc and V1 is called developing contrast. The difference between Vd and Vdc is called fog-removing contrast, as it makes it more difficult for negatively-charged toner to adhere to portions other than the exposed portion, thus making fogging harder to occur. Thus, in the present embodiment, toner charged to the same polarity as the charging polarity of the photosensitive drum 1*a* adheres to the exposed portion, thereby forming a toner image on the photosensitive drum 1*a*.

An intermediate transfer unit 5 is disposed beneath the photosensitive drums 1*a* through 1*d* in FIG. 1. The intermediate transfer unit 5 includes the intermediate transfer belt 51, primary transfer rollers 53*a* through 53*d*, a secondary inner transfer roller 56, a secondary outer transfer roller 57, a belt cleaner 60, and so forth. The intermediate transfer belt 51 runs over a drive roller 52, a follower roller 55, and a secondary inner transfer roller 56, that serve as multiple supporting members of the intermediate transfer belt 51. Driving force is transmitted to the intermediate transfer belt 51 by the drive roller 52 serving as a belt driving unit, and rotates (circles) in the direction indicated by the arrow in FIG. 2 at a speed of 250 mm/sec, for example.

On the inner circumference surface side of the intermediate transfer belt 51, at positions facing the photosensitive drums 1*a* through 1*d*, are disposed primary transfer rollers 53*a* through 53*d* serving as primary transfer members. The primary transfer rollers 53*a* through 53*d* have the same configuration, and accordingly the primary transfer roller 53*a* will be described representatively. The primary transfer roller 53*a* is configured of a core metal and an electroconductive layer cylinder formed on the outer circumferential surface thereof.

The primary transfer roller 53*a* is urged toward the photosensitive drum 1*a* by pressing members (omitted from illustration) such as springs or the like at both ends. Accordingly, the electroconductive layer of the primary transfer roller 53*a* is pressed against the surface of the photosensitive drum 1*a* at a predetermined pressure with the intermediate transfer belt 51 interposed therebetween. The photosensitive drums 1*a* through 1*d* and the intermediate transfer belt 51 form primary transfer portions (primary transfer nips) N1*a* through N1*d*. The primary transfer rollers 53*a* through 53*d* are in contact with the inner circumference surface of the intermediate transfer belt 51 and rotate being driven by movement of the intermediate transfer belt 51.

A primary transfer bias power source 530 is connected to the core metal of the primary transfer roller 53*a* to serve as a primary transfer bias applying unit. When forming an image, primary transfer bias having opposite polarity (positive polarity in the present embodiment) from the regular charging polarity (negative polarity in the present embodiment) is applied to the primary transfer roller 53*a* from the primary transfer bias power source 530. Accordingly, an electric field is formed between the primary transfer roller 53*a* and the photosensitive drum 1*a*, in a direction of moving the toner having a negative polarity from upon the photosensitive drum 1*a* toward the intermediate transfer belt 51. Thus, the toner image on the photosensitive drum 1*a* is subjected to primary transfer into the intermediate transfer belt 51.

Adhering substances such as toner remaining on the surface of the photosensitive drum 1*a* after the primary transfer process (primary transfer residual toner) is cleaned by the drum cleaner 6*a*. The drum cleaner 6*a* has a cleaning blade 61 that comes into contact with the surface of the photosensitive drum 1*a*, and adhering substances on the photosensitive drum 1*a* are scraped off by the cleaning blade 61. Urethane materials are widely used as a material for the cleaning blade 61. The present embodiment uses a cleaning blade of urethane rubber that has a hardness of 75 degrees, and dimensions of approximately 2.0 mm thick, approximately 8.0 mm in free length, and approximately 320 mm in width in the main scanning direction (rotational axis direction of the photosensitive drum 1*a*). The cleaning blade 61 is pressed against the photosensitive drum 1*a* at a contact angle θ of 25° and pressure of approximately 1300 gf.

The secondary outer transfer roller 57 serving as a secondary transfer member (transfer member) is disposed on the outer circumferential surface side of the intermediate transfer belt 51 at a position facing the secondary inner transfer roller 56. The secondary outer transfer roller 57 comes into contact with the outer circumferential face of the intermediate transfer belt 51 forming a secondary transfer portion (secondary transfer nip) N2. The secondary inner transfer roller 56 is electrically grounded, with a secondary transfer bias power source 58 serving as a secondary transfer bias applying unit connected to the secondary outer transfer roller 57. The secondary inner transfer roller 56 comes into contact with the inner circumferential surface of the intermediate transfer belt 51, and is rotated by the movement of the intermediate transfer belt 51. Applying secondary transfer bias from the secondary transfer bias power source 58 to the secondary outer transfer roller 57 transfers the toner image that has been transferred onto the intermediate transfer belt 51, onto a recording medium P.

When forming images, secondary transfer bias voltage having opposite polarity (positive polarity) from the regular charging polarity (negative polarity) of the toner is applied to the secondary outer transfer roller 57 by the secondary transfer bias power source 58 the present embodiment. An electric field is the formed between the secondary inner transfer roller 56 and the secondary outer transfer roller 57, in the direction of moving the toner with negative polarity from upon the intermediate transfer belt 51 (upon the rotating member, i.e., upon the intermediate transfer member) toward the recording medium P.

For example, when forming a full-color image, toner images of the respective colors are formed on the photosensitive drums 1*a* through 1*d* of the image forming stations Sa through Sd. These toner images are sequentially transferred (primary transfer) onto the intermediate transfer belt 51 to form a full-color toner image. The full-color toner image is conveyed to the secondary transfer portion N2 in accordance with the rotation of the intermediate transfer belt 51.

On the other hand, the recording medium P has been conveyed from a cassette 110 recording medium storage portion to the secondary transfer portion N2 by this time. That is to say, the recording medium P fed out from the cassette 110 one sheet at a time by a pickup roller 111 is conveyed to the secondary transfer portion N2 by a conveyance roller 112 and other members. An example of the recording medium is a sheet medium such as paper or an overhead projector (OHP) sheet or the like.

The full-color toner image on the intermediate transfer belt 51 is transferred onto the recording medium P (secondary transfer). The recording medium P onto which the full-color toner image has been transferred at the secondary transfer portion N2 is conveyed to a fixing device 7 serving as a fixing unit.

Toner (secondary transfer toner) remaining on the outer circumferential surface of the intermediate transfer belt 51, and paper dust and so forth adhering to the intermediate transfer belt 51, are cleaned by a belt cleaner 60. The belt cleaner 60 has a cleaning blade 62, and the adhering substances on the intermediate transfer belt 51 are scraped off by the cleaning blade 62. Urethane materials are widely used as a material for the cleaning blade 62. The present embodiment uses a cleaning blade of urethane rubber that has a hardness of 75 degrees, and dimensions of approximately 2.0 mm thick, approximately 8.0 mm in free length, and approximately 320 mm in width in the main scanning direction (width direction orthogonal to the rotation direction of the intermediate transfer belt 51). The cleaning blade 62 is pressed against the intermediate transfer belt 51 at a contact angle θ of 25° and pressure of approximately 1300 gf.

The fixing device 7 has a fixing roller 71 that is rotatably disposed, and a pressing roller 72 that rotates while pressing the fixing roller 71. A heater 73 such as a halogen lamp or the like is disposed within the fixing roller 71. The surface temperature of the fixing roller 71 is adjusted by controlling the voltage and so forth supplied to the heater 73. When the recording medium P is transported to the fixing device 7, the recording medium P is pressed and heated by a generally constant pressure and heat from both the front and back sides at the time of passing between the fixing roller 71 and the pressing roller 72. This melts the undeveloped toner image on the surface of the recording medium P so as to be fixed onto the recording medium P. Thus, a full-color image is formed on the recording medium P.

Intermediate Transfer Belt

The intermediate transfer belt 51 will be described in detail. The intermediate transfer belt 51 is an endless elastic belt where a coat layer is formed in the surface of an elastic layer, so that the coat layer is the outermost layer (the layer at the side where the toner image is borne). More particularly, the intermediate transfer belt 51 is an elastic belt having a three-layered structure of a resin layer 181*a*, an elastic layer 181*b*, and a surface layer (coat layer or separation layer 181*c*).

Examples of resin material making up the resin layer 181*a* include, but are not restricted to, one type or two or more types selected from a group including polycarbonates; fluorine-based resins (ethylene tetrafluoroethylene (ETFE); polyvinylidene fluoride (PVDF)); styrene resins including polystyrene, chloropolystyrene, poly-α-methylstyrene, styrene-butadiene copolymers, styrene-vinyl chloride copolymers, styrene-vinyl acetate copolymers, styrene-maleic acid copolymers, styrene-acrylic ester copolymers (styrene-acrylic methyl copolymers, styrene-acrylic ethyl copolymers, styrene-acrylic butyl copolymers, styrene-acrylic octyl copolymers, styrene-acrylic phenyl copolymers, etc.) styrene-methacrylic ester copolymers (styrene-methacrylic methyl copolymers, styrene-methacrylic ethyl copolymers, styrene-methacrylic phenyl copolymers, etc.), styrene-α-methyl chloroacrylate copolymers, styrene-acrylonitrile-acrylic ester copolymers (homopolymers and copolymers including styrene or styrene substitutions); methyl methacrylate resins; butyl methacrylate resins; ethyl acrylate resins; butyl acrylate resins; modified acrylic resins (silicone-modified acrylic resins, vinyl chloride-modified acrylic resins, acrylic urethane resins, etc.); vinyl chloride resins; styrene-vinyl acetate copolymers; vinyl chloride-vinyl acetate copolymers; rosin-modified maleic acid resins; phenol resins; epoxy resins; polyester resins; polyester polyurethane resins; polyethylene; polypropylene; polybutadiene; polyvinylidene chloride; ionomer resins; polyurethane resins; silicone resins; ketone resins; ethylene-ethyl acrylate copolymers; xylene resins and polyvinyl butyral resins; polyamide resins; polyimide resins; modified-polyphenyleneoxide resins; modified polycarbonates; and so forth.

Examples of elastic material (elastic rubber or elastomer) making up the elastic layer 181*b* include, but are not restricted to, one type or two or more types selected from a group including butyl rubber; fluorine-based rubber; acrylic rubber; ethylene propylene diene monomer (EPDM) rubber; nitrile butadiene rubber (NBR); acrylonitrile-butadiene-styrene rubber; natural rubber; isoprene rubber; styrene-butadiene rubber; butadiene rubber; ethylene-propylene rubber; ethylene-propylene terpolymer; chloroplene rubber; chlorosulfonated polyethylene; chlorinated polyethylene; urethane rubber; syndiotactic 1,2-polybutadiene; epichlorohydrin rubber; silicone rubber; fluoro rubber; polysulfide rubber; polynorbornene rubber; hydrogenated nitrile rubber; thermoplastic elastomers (e.g., polystyrenes, polyolefins, polyvinylchlorides; polyurethanes; polyamides, polyureas, polyesters, fluoro plastics), and so forth.

Although the material for the surface layer (coat layer) 181*c* is not restricted in particular, the attractive force of toner to the surface of the intermediate transfer belt 51 is preferably small, so that the secondary transfer property is improved. Examples include one type of resin material such as polyurethane, polyester, epoxy resin, or the like; or two or more types of elastic material (elastic rubber or elastomer), butyl rubber, fluorine-based rubber, acrylic rubber, EPDM rubber, NBR, acrylonitrile-butadiene-styrene rubber, natural rubber, isoprene rubber, styrene-butadiene rubber, butadiene rubber, ethylene-propylene rubber, ethylene-propylene terpolymer, chloroplene rubber, chlorosulfonated polyethylene, chlorinated polyethylene, and urethane rubber, be used, and have there dispersed therein a material that reduces surface energy and improves lubricity. Examples of such a material include fluororesins, fluorine compounds, fluorocarbons, titanium dioxide, silicone carbide, and so forth. Powder or particles of one type or two or more types, with differing particle diameters, is/are dispersed in the above resin/elastic material(s). This surface layer 181*c* preferably is configured using a material including a fluororesin.

An electroconductive agent for adjusting the resistance value is added to the resin layer 181*a* and the elastic layer 181*b*. This electroconductive agent for adjusting resistance value is not restricted in particular, and examples thereof include, but are not restricted to, as carbon black; graphite; metal powder of aluminum, nickel, or the like; and electroconductive metal oxides such as tin oxide, titanium oxide, antimony oxide, indium oxide, potassium titanate, antimony oxide-tin oxide complex oxide (ATO), and indium tin oxide complex oxide (ITO). Electroconductive metal oxides coated on fine insulating particles such as barium sulfate, magnesium silicate, calcium carbonate, or the like, may be used. The electroconductive agent is not restricted to the above. A 100-μm thick PI (polyimide) article formed having surface resistivity of $10^{12}$ Ω/sq (measured using a probe conforming to JIS-K6911, applying voltage of 100 V for 60 seconds under an environment of 23° C. and 50% relative humidity (RH)) was used in the present embodiment, but this is not restrictive. Other materials, volume resistivity, and thicknesses, may be used.

The intermediate transfer belt may be of a configuration other than that described above made up of three layers of resin layer, elastic layer, and coat layer, with the coat layer being the outermost layer. That is to say, the coat layer may be formed on the resin layer, with the coat layer being the outermost layer. For example, the intermediate transfer belt may be made up of the two layers of the resin layer and coat layer, with the coat layer being the outermost layer. Also, the elastic layer may be formed on the resin layer, with the elastic layer being the outermost layer. For example, the intermediate transfer belt may be made up of the two layers of the resin layer and elastic layer, with the elastic layer being the outermost layer. Even if the outermost layer is an elastic layer, there is a possibility that constituents of rubber material and the like will migrate into the photosensitive drum. Accordingly, the configuration of the layers inward from the outermost layer is irrelevant, as long as the outermost layer of the intermediate transfer belt is a coat layer or elastic layer.

Primary Transfer Roller

Next, the primary transfer roller 53*a* (as well as 53*b* through 53*d*) will be described in detail. The primary transfer roller 53*a* is configured including a core metal with an outer diameter of 8 mm, and an electroconductive urethane sponge layer 4 mm thick. The electric resistance value of the primary transfer roller 53*a* is approximately $10^7$Ω (23° C., 50% RH). The electric resistance value of the primary transfer roller 53*a* was measured by rotating a primary transfer roller 53, brought into contact with a grounded metal roller under a load of 500 g, at a circumferential speed of 50 mm/sec, and applying voltage of 500 V to the core metal.

Secondary Outer Transfer Roller

Next, the secondary outer transfer roller 57 will be described in detail. The secondary outer transfer roller 57 is made up of a core metal 571 with an outer diameter of 10 mm, and an electroconductive EPDM rubber sponge layer 572 that is 4 mm thick. The electric resistance value of the secondary outer transfer roller 57 was approximately $10^8$Ω when measured according to the same method as the primary transfer roller 53*a* and applying voltage of 2000 V.

Interposing Toner

Now, the intermediate transfer belt 51 and the photosensitive drums 1*a* through 1*d* are in contact at the positions of the primary transfer rollers 53*a* through 53*d* (primary transfer portions N1*a* through N1*d*). If let to stand in this state for a long period, around one week or so for example, there are cases where part of the constituents of the rubber material used for the surface material of the intermediate transfer belt 51 and the fluorine compound dispersed to improve separability of the surface layer (separation layer) will migrate to the surface of the photosensitive drums 1*a* through 1*d*. When the constituents of the intermediate transfer belt 51 migrate to the photosensitive drums 1*a* through 1*d*, this changes the charging properties of the photosensitive drums 1*a* through 1*d*, and forming images after letting stand for a long period of time may result in a problem of horizontal streaks being visible in halftone images. Note that the constituents that have adhered to the photosensitive drums 1*a* through 1*d* are removed by the drum cleaners 6*a* through 6*d* while forming a certain number of images, and the image quality returns to normal.

The present embodiment interposes toner between the photosensitive drum 1*a* (the same for 1*b* through 1*d* hereinafter) and the intermediate transfer belt 51 at the time of ending image forming, in order to suppress occurrence of such streaks. A photosensitive drum 1*a* having a small outside diameter, such as 30 mm, is used in the present embodiment to reduce the size of the image forming apparatus. The developing sleeve 42 and the primary transfer portion N1*a* (N1*b* through N1*d*) are in a positional relationship approximately 90° from each other along the circumferential direction of the photosensitive drum 1*a* (1*b* through 1*d*), with the distance following the rotational direction from the developing sleeve 42 to the primary transfer portion N1*a* being 23 mm. The process speed is 250 mm/sec, as described above.

On the other hand, it is known that at the time of a stop operation after forming of images ends, when turning the DC high-voltage power source applied to the charging roller 2*a* (2*b* through 2*d*) and the developing device 4*a* (4*b* through 4*d*) off, the potential of the photosensitive drum does not completely drop until discharge from capacitors in the high-voltage circuit is complete. For example, the impedance of a capacitor used in the high-voltage circuit of the charging roller 2*a* and developing device 4*a* is several megaohms. In this case, it will take around 100 to 200 msec from the time of turning off the DC high-voltage power source applied to the charging roller 2*a* and developing device 4*a* till the photosensitive drum completely drops off.

In a case where the driving of the photosensitive drum 1*a* is stopped before the high-voltage power source (developing bias) of the developing device 4*a* completely drops off at the time of ending image forming, the developing bias drops off completely while the surface potential of the photosensitive drum 1*a* remains at Vd at the position facing the developing sleeve 42. In this case, the fog-removing contrast illustrated in FIG. 2 is high. When the fog-removing contrast is high, this results in occurrence of "carrier adhesion" where the carrier charged to the opposite polarity as the toner flies into the photosensitive drum 1*a*, and adheres to the surface of the photosensitive drum 1*a*. Occurrence of carrier adhesion results in the carrier adhered to the photosensitive drum 1*a* damaging the intermediate transfer belt 51 and drum cleaner 6*a* downstream in the rotational direction.

Figure 4:
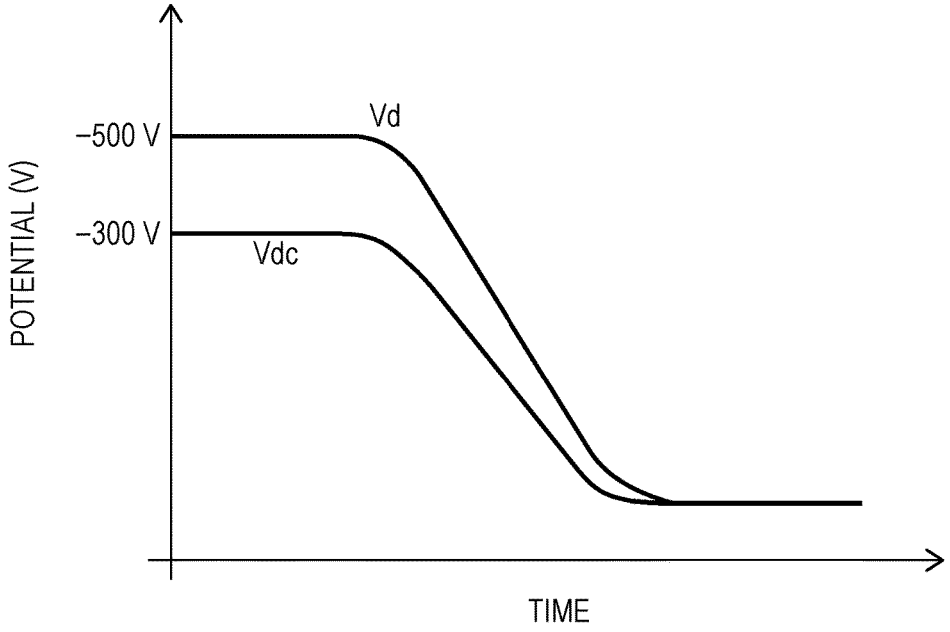
FIG. 4 is a diagram illustrating the relationship in magnitude between surface potential on the photosensitive drum when ending image formation, and a developing bias DC value, according to the first embodiment.

Accordingly, when ending image forming, the relationship in magnitude between the surface potential (Vd) of the photosensitive drum 1*a* and the DC value of the developing bias (DC component, Vdc) is maintained in a state where the photosensitive drum 1*a* is being driven, as illustrated in FIG. 4. That is to say, Vd is maintained to have a larger absolute value than Vdc. The DC value of the charging bias (Vd) and the DC value of the developing bias (Vdc) are lowered with this state maintained, and the driving of the photosensitive drum 1*a* is stopped at a point where the surface potential of the photosensitive drum 1*a* and the DC value of the developing bias are approximately zero.

Accordingly, when ending image forming, the rotation of the photosensitive drum 1*a* is stopped 200 msec after having turned the DC component of the charging bias power source 20 and developing bias power source 40 off in the present embodiment. Now, the outside diameter of the photosensitive drum 1*a* is 30 mm and the distance from the developing sleeve 42 to the primary transfer portion N1*a* is 23 mm. In this case, the interposing toner formed at the time of ending image forming can be made to stop at the primary transfer portion N1*a* if the process speed is 115 mm/sec or slower. However, if the process speed is faster than 115 mm/sec, there will be cases where the interposing toner formed at the time of ending image forming cannot be made to stop at the primary transfer portion N1*a*, and the interposing toner overruns the primary transfer portion N1*a*.

Control when Ending Image Forming

Accordingly, each part is controlled as described below in the present embodiment, at the time of ending image forming, as a predetermined timing. Specifically, a time of post rotation the photosensitive drums 1*a* through 1*d* and the intermediate transfer belt 51 are rotated a predetermined amount of time when ending an image forming job is the predetermined timing. An image forming job is a period from having started image forming based on print signals to form an image on a recording medium up to completing the image forming operation. Specifically, this indicates a period from when performing pre-rotation (preparatory operation before forming image) after having received a print signal (input of image forming job), up to post rotation (operation after image forming), and includes sheet-to-sheet interval (when not forming image).

Figure 5:
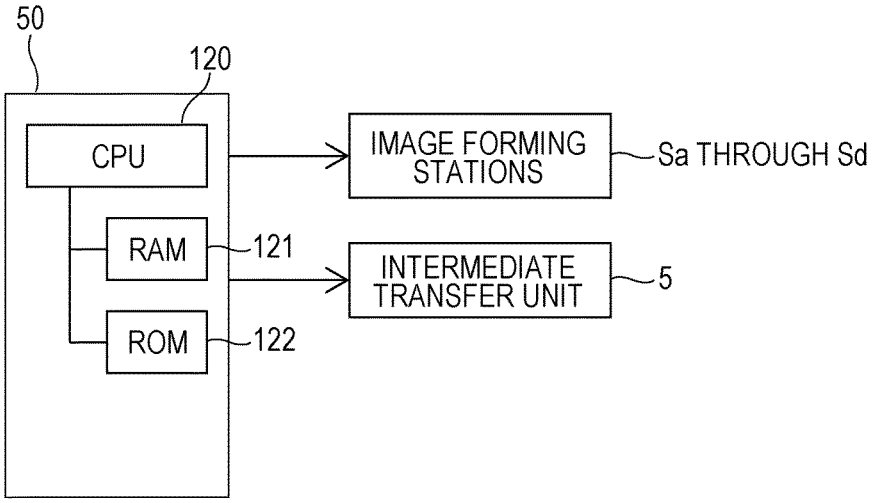
FIG. 5 is a control block diagram of the image forming apparatus according to the first embodiment.

The image forming apparatus 100 according to the present embodiment has a control circuit 50 serving as a control unit, as illustrated in FIG. 5. This enables various types of control to be performed for each of the parts, such as the image forming stations Sa through Sd, the intermediate transfer unit 5, and so forth. The control circuit 50 is configured including a central processing unit (CPU) 120, which may include one or more processors and one or more memories, random access memory (RAM) 121, and read-only memory (ROM) 122 (a storage device). The CPU 120 controls the devices based on setting values stored in the ROM 121 and RAM 122. As used herein, the term "unit" generally refers to any combination of hardware, firmware, software or other component, such as circuitry, that is used to effectuate a purpose.

Figure 6:
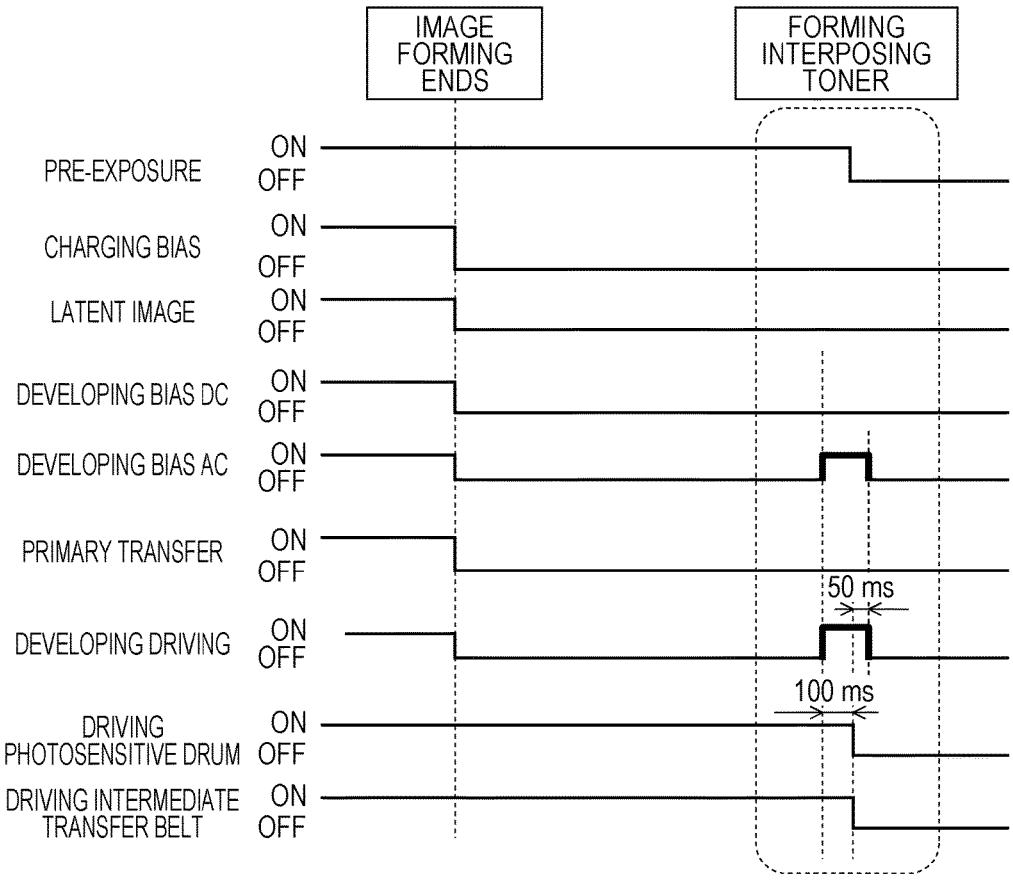
FIG. 6 is a timing chart indicating the control timing of the devices according to the first embodiment.

FIG. 6 illustrates control timing when ending image forming. The toner image formed at the image forming stations is subjected to primary transfer onto the intermediate transfer belt 51, then subjected to secondary transfer onto the recording medium, and conveyed to the fixing device 7. During this time, the photosensitive drums 1*a* through 1*d* and the intermediate transfer belt 51 maintain the driving state. If the developing driving operations continue at this time as well, "fog toner" where toner within the developer container adheres to the photosensitive drum is discharged, which is undesirable from a perspective of toner consumption.

Accordingly, in the present embodiment, at the time of ending image forming the CPU 120 outputs off signals for each of the charging bias, DC component of developing bias (developing bias DC) and AC component of developing bias (developing bias AC), and driving of the developing sleeve 42 (developing driving), as illustrated in FIG. 6. The CPU 120 gradually lowers the charging bias and developing bias DC from the state of −500 V for the surface potential of the photosensitive drum 1*a* and −300 V for the developing bias DC, while maintaining the relationship in magnitude thereof, as illustrated in FIG. 4. Driving of the photosensitive drum 1*a* and intermediate transfer belt 51 continues.

200 msec after the off signals for the charging bias and developing bias, the surface potential of the photosensitive drum 1*a* is approximately 0 V. Thereafter, the developing bias AC and developing driving operation signals are turned on 100 msec before stopping driving of the photosensitive drums 1*a* and stopping driving of the intermediate transfer belt 51, in order to form the interposing toner. Further, 50 msec after off signals for driving the photosensitive drum 1*a* and driving the intermediate transfer belt 51, off signals for the developing bias AC and developing driving are output. That is to say, AC voltage is applied to the developing device 4*a* in a state where the photosensitive drum 1*a* and intermediate transfer belt 51 are driving, and thereafter driving of the photosensitive drum 1*a* and intermediate transfer belt 51 is stopped. Further, after stopping driving of the photosensitive drum 1*a* and intermediate transfer belt 51, applying AC voltage to the developing device 4*a* is stopped.

Figure 7:
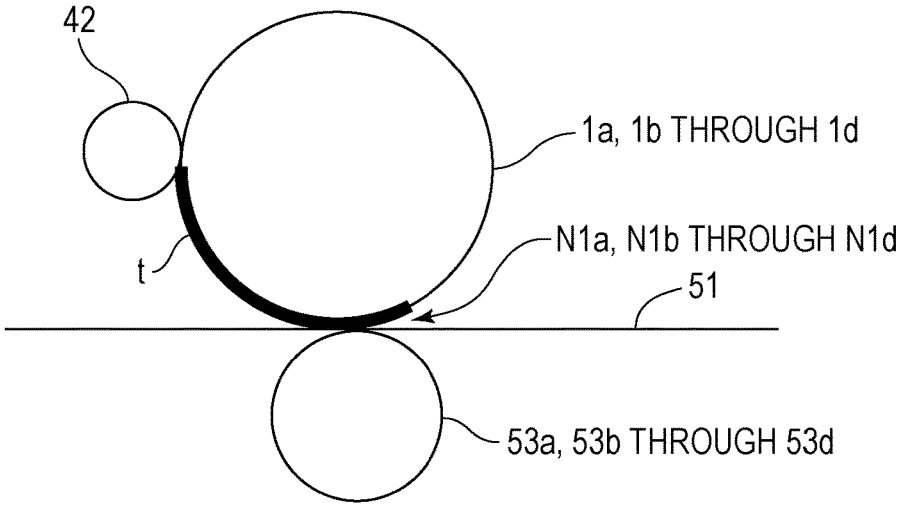
FIG. 7 is a schematic diagram illustrating a state where interposing toner is interposed at a primary transfer portion in the first embodiment.

Accordingly, the image forming apparatus can be stopped in a state where an interposing toner t is formed on the photosensitive drum 1*a* from the position of the developing sleeve 42 to the primary transfer portion N1*a*, as illustrated in FIG. 7. That is to say, in the present embodiment, when ending image forming, which is the predetermined timing, a state is realized where charging by the charging roller 2*a* is stopped (charging bias off) and also applying DC voltage (direct current voltage) at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

Thus, the interposing toner is formed in the present embodiment by only turning the developing bias AC on in a state where the charging bias and developing bias DC are off (a state where the surface potential of the photosensitive drum is almost 0 V). If the interposing toner is formed in a state where potential is left on the photosensitive drum, there may be cases where the potential when forming the interposing toner will remain when forming the next image. This may in some cases result in uneven image density due to uneven potential. This is why the interposing toner is formed with the surface potential of the photosensitive drum at approximately 0 V.

The charging bias and developing bias DC may involve several tens to hundreds of msec to rise. Accordingly, in a case of changing over or turning back on the charging bias or developing bias DC when forming the interposing toner, it may take time to form interposing toner with a stable density. This may result in taking extra time to form the interposing toner, or rotating the developing sleeve and photosensitive drum extra amounts, reducing the life thereof. On the other hand, the rising time for developing bias AC is around several msec to 20 msec or so. Accordingly, the present embodiment forms the interposing toner using only an electric field formed by the developing bias AC, in a state where the charging bias and developing bias DC are off.

Also, the stopping timing of driving the developing sleeve 42 is delayed to after the stopping timing of driving the photosensitive drum 1*a* in the present embodiment, thereby preventing the interposing toner from overrunning the primary transfer portion. That is to say, the interposing toner is made to interpose at the primary transfer portion N1*a* in a more accurate manner, by outputting off signals for the developing bias AC and developing driving 50 msec after the off signal for driving the photosensitive drum 1*a* and driving the intermediate transfer belt 51.

By applying only the developing bias AC when forming the interposing toner, in a state where the surface potential of the photosensitive drum 1*a* is approximately 0 V, the force of the electric field between the developing sleeve 42 and the photosensitive drum 1*a* can be infinitesimally minimalized. Thus, just the toner can be made to fly onto the photosensitive drum 1*a* by magnetic force of a magnet (omitted from illustration) within the developing sleeve 42, without the magnetic carrier flying. Also, the interposing toner is formed by toner adhering to the photosensitive drum 1*a* by applying the developing bias AC, so excessive amount of interposing toner can be suppressed.

That is to say, if the amount of the interposing toner supplied after image forming is small, the desired effects at the intermediate transfer belt 51 may be insufficient. If the amount is too great, the interposing toner will be transferred from the photosensitive drum 1*a* to the intermediate transfer belt 51 when first driving in the next image forming, thereby contaminating the surface of the secondary outer transfer roller 57 on the downstream side in the direction of rotation of the intermediate transfer belt 51. This in turn may involve extra time to clean the toner adhered to the secondary outer transfer roller 57 before image forming. Accordingly, the interposing toner is formed by adhering the toner to the photosensitive drum 1*a* by applying the developing bias AC. The amount of toner borne here for the interposing toner preferably is 0.001 to 0.03 mg/cm$^2$. Alternatively, the density of the interposing toner preferably is around 0.02 to 0.08 when measured by a densitometer manufactured by X-Rite, Inc.

Thus, the present embodiment is capable of ending image forming in a state where a suitable amount of interposing toner is interposed at the primary transfer portion N1*a*, while preventing adhesion of carrier. Accordingly, even if the photosensitive drum 1*a* and intermediate transfer belt 51 are left in this state thereafter for a long period of time in contact with each other, part of the constituents of the intermediate transfer belt 51 such as rubber material, fluorine compounds, and so forth, can be prevented from migrating onto the surface of the photosensitive drum 1*a*, and thus occurrence of streaks can be suppressed.

Also, the developing bias DC and developing bias AC, and the driving operations of the developing sleeve 42 are each stopped when ending image forming, and thereafter driving of the developing bias AC and developing sleeve 42 is started when forming the interposing toner. Accordingly, fog toner can be suppressed, and unintended consumption of toner after the image forming has ended until the photosensitive drum 1*a* and intermediate transfer belt 51 stop can be reduced. Alternatively, the driving of the developing bias AC and developing sleeve 42 may be continued when ending image forming, to form the interposing toner, although the amount of toner consumed will be greater. In this case as well, off signals for the driving of the developing bias AC and developing sleeve 42 are output 50 msec after the driving off signals for the photosensitive drum 1*a* and intermediate transfer belt 51.

Although description primarily has been made regarding control regarding the image forming station Sa and intermediate transfer belt 51, control regarding the other image forming stations and the intermediate transfer belt 51 is the same as well.

Although the configuration has been made such that the charging bias DC and developing bias DC are turned off when the image forming job ends, DC bias may be applied within a range where carrier adhesion does not occur. That is to say, instead of turning the charging bias off when ending image forming in FIG. 6, DC bias below the fog-removing contrast such as illustrated in FIG. 2 may be applied. That is to say, the fog-removing potential contrast during image forming is a first contrast, and the fog-removing potential contrast during forming the interposing toner is a second contrast that is equal to or smaller than the first contrast.

Second Embodiment

A second embodiment will be described with reference to FIGS. 8 and 9. Although an arrangement has been described in the first embodiment where only developing bias AC is applied at the time of forming the interposing toner when ending image forming, only developing bias DC is applied to from the interposing toner in the present embodiment. The idea regarding the control timings of each device when ending image forming and other configurations and operations are the same as in the first embodiment, so the same configurations will be denoted by the same reference numerals, and description thereof will be omitted or simplified. Description will be made primarily regarding feature portions of the second embodiment.

Figure 8:
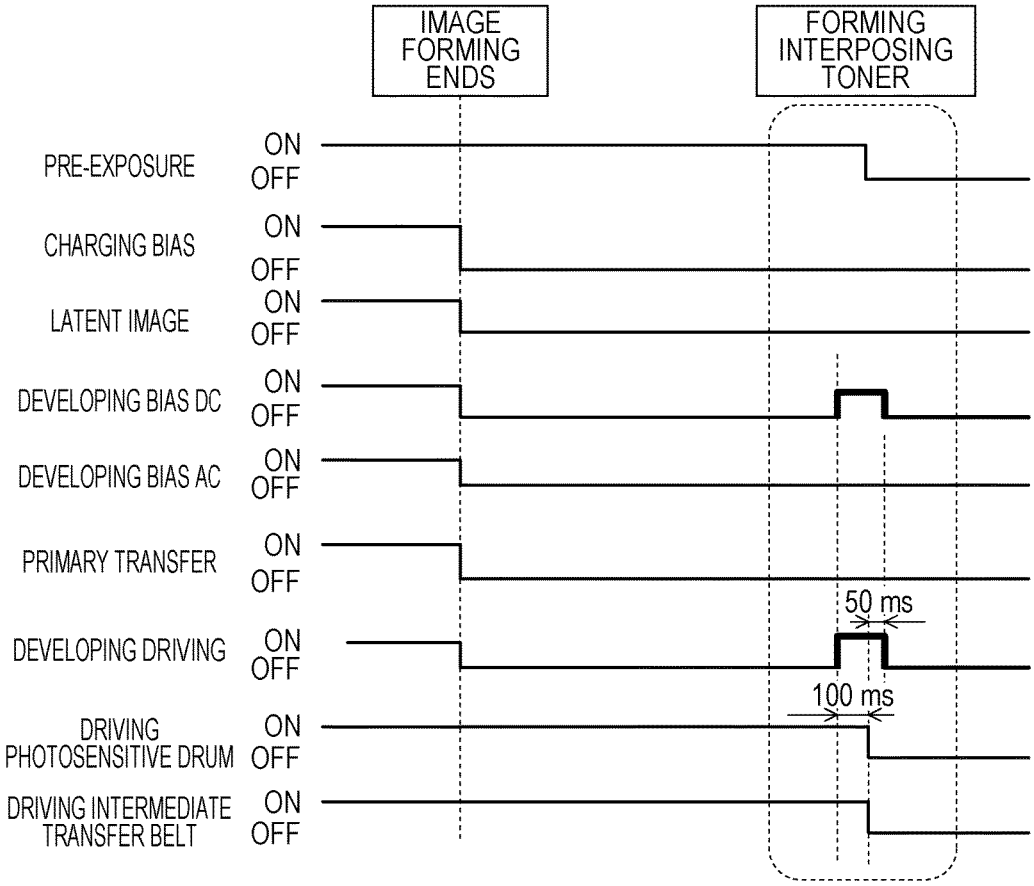
FIG. 8 is a timing chart illustrating the control timing of devices according to a second embodiment.
Figure 9:
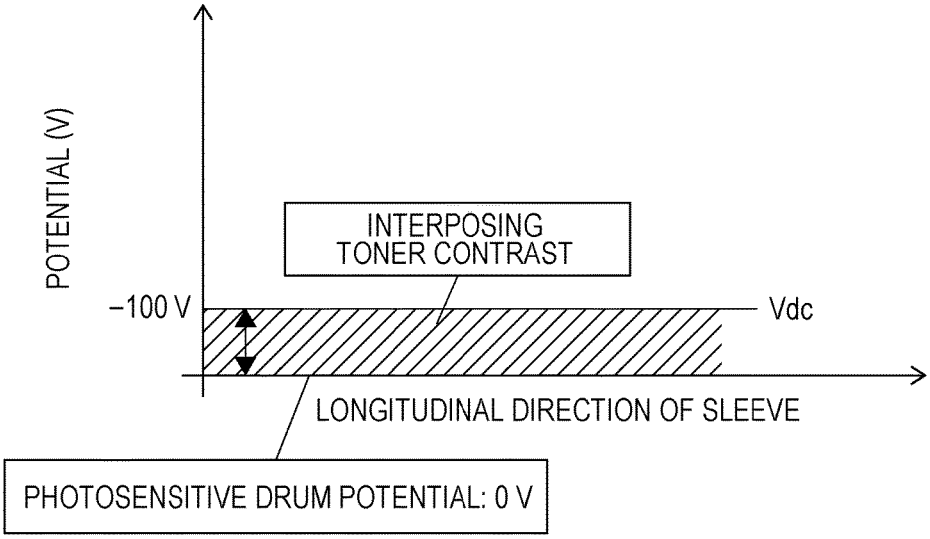
FIG. 9 is a diagram illustrating the relationship in magnitude between surface potential on the photosensitive drum when ending image formation, and a developing bias DC value, according to the second embodiment.

FIG. 8 is a timing chart illustrating control timing of each of the devices. In the present embodiment as well, the developing bias DC and developing driving operations are stopped at the same time as the sequence timing that the charging bias and developing bias AC are turned off when ending image forming. Thereafter, the developing bias DC and developing driving are turned on again 100 msec before stopping driving of the photosensitive drum 1*a* (1*b* through 1*d*) and stopping driving of the intermediate transfer belt 51.

In the present embodiment, the developing bias DC (DC voltage) applied at this time is set so that the absolute value thereof is lower than the developing bias DC when performing normal image forming. That is to say, while the developing bias DC when performing normal image forming is −300 V, the developing bias DC when forming interposing toner is set to −100 V, as illustrated in FIG. 9. Thus, the charging bias is already off when applying the −100 V developing bias DC, so the surface potential of the photosensitive drum 1*a* is approximately 0 V. Accordingly, the toner can be made to fly from the developing sleeve 42 to the surface of the photosensitive drum 1*a* by the 100 v potential difference (interposing toner contrast) to form the interposing toner.

Accordingly, the image forming can be ended with the interposing toner interposed at the primary transfer portion N1*a*, in the same way as in the first embodiment. As a result, part of the constituents of the intermediate transfer belt 51 such as rubber material, fluorine compounds, and so forth, can be prevented from migrating onto the surface of the photosensitive drum 1*a*, and thus occurrence of streaks can be suppressed when forming images after a predetermined amount of time has elapsed.

Although only developing bias DC is applied in the present embodiment to form the interposing toner, developing bias AC may be applied in a superimposed manner. That is to say, in a state where charging bias is stopped, developing bias AC toner may be applied in a state where the DC voltage having an absolute value lower than the DC voltage when forming an image (the developing bias DC may be −100 V, for example) is being applied, to form the interposing toner.

Third Embodiment

A third embodiment will be described with reference to FIG. 10. The control timing of each of the devices when ending image forming according to the present embodiment differs somewhat from that in the first embodiment. The idea regarding the control timings of each device when ending image forming and other configurations and operations are the same as in the first embodiment, so the same configurations will be denoted by the same reference numerals, and description thereof will be omitted or simplified. Description will be made primarily regarding feature portions of the third embodiment.

In the present embodiment as well, the diameter of the photosensitive drum 1*a* (1*b* through 1*d*) is 30 mm, the developing sleeve 42 and the primary transfer portion N1*a* are in a positional relationship approximately 90° from each other along the circumferential direction, with the distance following the rotational direction from the developing sleeve 42 to the primary transfer portion N1*a* being 23 mm. The process speed is 250 mm/sec.

Figure 10:
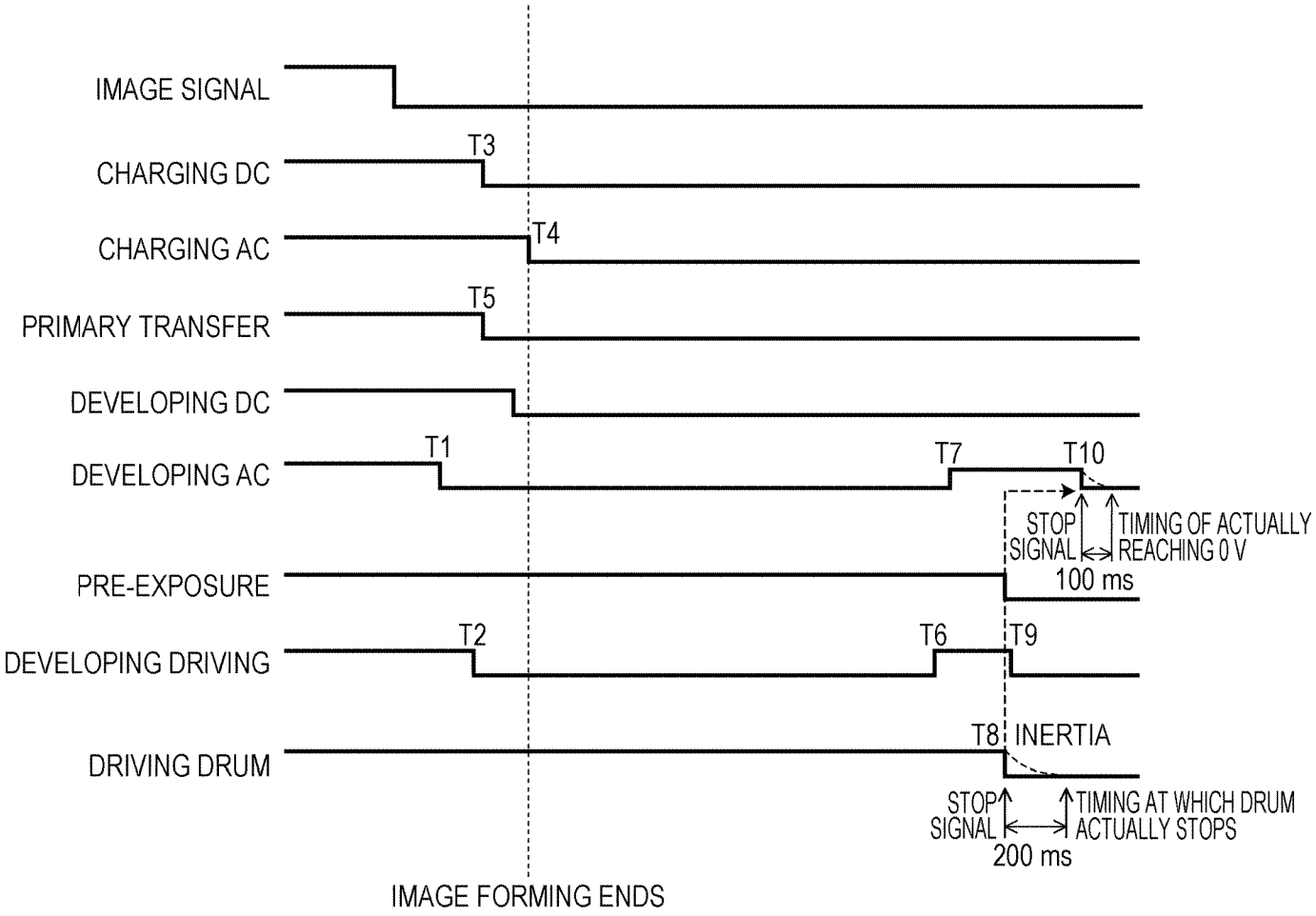
FIG. 10 is a timing chart illustrating the control timing of each device according to a third embodiment.

FIG. 10 illustrating control timing of each of the devices when ending image forming according to the present embodiment. When ending image forming, first, the developing bias AC (developing AC) is turned off (T1), and thereafter the developing driving is turned off (T2). At this time, if the developing driving is turned off and thereafter the developing AC is turned off, the developing AC is applied even though the toner on the developing sleeve 42 has not been switched. This state may result in the toner being charged up and a friction charge amount becoming markedly high. This can cause toner to remain upon the magnetic carrier, causing a defective image called "underbrush" that is understood to impede nap formation of the magnetic carrier. Accordingly, the developing driving is turned off after the developing AC is turned off in the present embodiment.

Next, the charging bias DC (charging DC) and developing bias DC (developing DC) are turned off (T3) in the same way in FIG. 4 described above, so that the difference between the surface potential on the photosensitive drum 1*a* and the developing bias DC value is maintained at a suitable value. Next, when the charging DC reaches 0, the charging bias AC (charging AC) is turned off (T4). The primary transfer bias turns off when the trailing edge (upstream end in the movement direction) of the last toner image in the image forming job passes the primary transfer portion N1*a* (T5).

1000 msec after turning the charging AC off, the developing driving is turned on (T6), and once driving has stabilized (20 msec after signal), the developing AC is turned on (T7). Next, 100 msec after having turned the developing driving on, driving of the photosensitive drum 1*a* and driving of the intermediate transfer belt 51 (drum driving) are turned off (T8). Further, 20 msec after driving of the photosensitive drum 1*a* and driving of the intermediate transfer belt 51 is turned off, developing driving is turned off (T9).

Now, in a state where there is no potential difference between the surface potential of the photosensitive drum 1*a* and the developing DC, and where the photosensitive drum 1*a* is rotating, if the developing AC is turned off, there may be cases where a great amount of toner is discharged onto the photosensitive drum 1*a*. That is to say, when the amplitude of the developing AC is small, the electromagnetic power discharging toner from the developing sleeve 42 to the photosensitive drum 1*a* becomes larger than the electromagnetic power pulling toner back from the photosensitive drum 1*a* to the developing sleeve 42. As a result, the toner on the developing sleeve 42 is discharged onto the photosensitive drum 1*a*. The density of toner discharged in this way was 0.10 when measured by a densitometer manufactured by X-Rite, Inc.

The amount of interposing toner in the present embodiment preferably is around 0.02 to 0.08 when measured by a densitometer manufactured by X-Rite, Inc., and 0.04 is more preferable. If the density is smaller than 0.02, migration of constituents of the intermediate transfer belt 51 to the surface layer of the photosensitive drum 1*a* cannot be sufficiently suppressed. If the density exceeds 0.08 on the other hand, the interposing toner will be transferred from the photosensitive drum 1*a* to the intermediate transfer belt 51 when first driving in the next image forming, thereby contaminating the surface of the secondary outer transfer roller 57 on the downstream side in the direction of rotation of the intermediate transfer belt 51. This in turn may involve extra time to clean the toner adhered to the secondary outer transfer roller 57 before image forming.

Accordingly, 200 msec after the drum driving has been turned off, the developing AC is turned off (T10). The driving of the photosensitive drum 1*a* has inertia, and involves a certain amount of time to stop after the stop signal. The present embodiment also sets the time from the stop signal for the photosensitive drum 1*a* until the photosensitive drum 1*a* stops to be 200 msec. Note however, that the time for the photosensitive drum 1*a* to stop after the stop signal will change depending on the process speed, whether or not a flywheel is included, short-circuit braking control and so forth, so the time to stop is to be appropriately set, regardless of the present embodiment.

According to this control, the image forming apparatus can be sopped in a state where the interposing toner is formed on the photosensitive drum 1*a* from the position of the developing sleeve to the primary transfer portion, as illustrated in FIG. 7.

Another Example of Third Embodiment

A different example of the third embodiment will be described with reference to FIG. 10. In the present embodiment, the process speed of the image forming apparatus is changeable, and the control timing when ending image forming is changed in accordance with the process speed. The process speed of the image forming apparatus 100 is changed depending on the type of recording medium being used. The process speed is changed based on the grammage of the recording medium in the present embodiment. If the grammage is less than 106 g/m$^2$, the process speed is 250 mm/sec (first speed), and if 106 g/m$^2$ or above, 150 mm/sec (second speed).

That is to say, the control circuit 50 (see FIG. 5) is capable of driving the photosensitive drum 1*a* and intermediate transfer belt 51 at the first speed (250 mm/sec), and the second speed (150 mm/sec) that is slower than the first speed. At the predetermined timing (when ending image forming), the time from stopping (turning off) the driving of the photosensitive drum 1*a* and intermediate transfer belt 51 (drum driving) until the application of the developing bias AC is stopped, is changed depending on the speed. Specifically, this time is shorter when being driven at the second speed as compared with when being driven at the first speed.

First, the operations in a case where a recording medium having grammage lighter than 106 g/m$^2$ is used (the case of the first speed) will be described. The operations in a case where a paper sheet having grammage lighter than 106 g/m$^2$ is used are the same as in the third embodiment. That is to say, the developing driving is turned on (T6) 100 msec before stopping the drum driving, and after driving has stabilized (20 msec after signal), the developing AC is turned on (T7). Thereafter, an off signal for driving of the drum is output (T8), and 20 msec later, a developing driving off signal is output (T9). 200 msec after the drum driving off signal, the developing AC is turned off (T10).

Next, the operations in a case where a recording medium 106 g/m$^2$ or heavier is used (the case of the second speed) will be described. In a case where a paper sheet 106 g/m$^2$ or heavier is used, the developing driving is turned on (T6) 180 msec before stopping the drum driving, and after driving has stabilized (20 msec after signal), the developing AC is turned on (T7). That is to say, the time from the developing AC turning on till the drum driving turning off is longer in the case of the second speed as compared to the first speed. This is because turning on the developing AC causes the interposing toner to be adhered to the photosensitive drum 1*a*, and the slower the process speed is, the longer it takes for the formed interposing toner to each the primary transfer portion N1*a*. Accordingly, in a case of the second speed that is the slower speed, the photosensitive drum 1*a* is driven for a longer time after the developing AC is turned on, so that the interposing toner can be interposed at the primary transfer portion N1*a*.

Thereafter, an off signal for driving of the drum is output (T8), and 20 msec later, a developing driving off signal is output (T9). Short braking is not applied when stopping the driving of the photosensitive drum in the present embodiment, so further, 150 msec after the drum driving off signal, the developing AC is turned off (T10). That is to say, the time after turning the drum driving off until the developing AC is turned off is shorter for the case of the second speed as compared to the case of the first speed. This is because the slower the process speed is, the smaller the effects of the inertia of the photosensitive drum 1*a* are, and the time involved for the photosensitive drum 1*a* to stop after the drum driving off signal is shorter. Accordingly, the developing AC is turned off in a shorter time after turning the drum driving off in the case of the second speed that is the slower speed. Other configurations and operations are the same as in the third embodiment. Further, this changing of the control timings when ending image forming in accordance to the process speed may be applied to the first and second embodiments, as well.

Fourth Embodiment

A fourth embodiment will be described with reference to FIGS. 11 through 13. A configuration has been made in the preceding embodiments where interposing toner is formed at each of the image forming stations, and interposing toner is interposed at the primary transfer portions of the respective stations. As opposed to this, the present embodiment is configured where the interposing toner is formed at an upstream image forming station, and the interposing toner is interposed at the primary transfer portion of a downstream image forming station. Other configurations and operations are the same as in the first embodiment, so the same configurations will be denoted by the same reference numerals, and description thereof will be omitted or simplified. Description will be made primarily regarding feature portions of the fourth embodiment.

The image forming apparatus 100 according to the present embodiment is capable of selection between a full-color mode where image forming is performed using all image forming stations Sa through Sd, and a monochrome mode where image forming is performed using only the black image forming station Sd. In a case where the monochrome mode is selected, image forming is performed in a state where only the photosensitive drum 1*d* of the black image forming station Sd is in contact with the intermediate transfer belt 51, as illustrated in FIG. 11.

Figure 11:
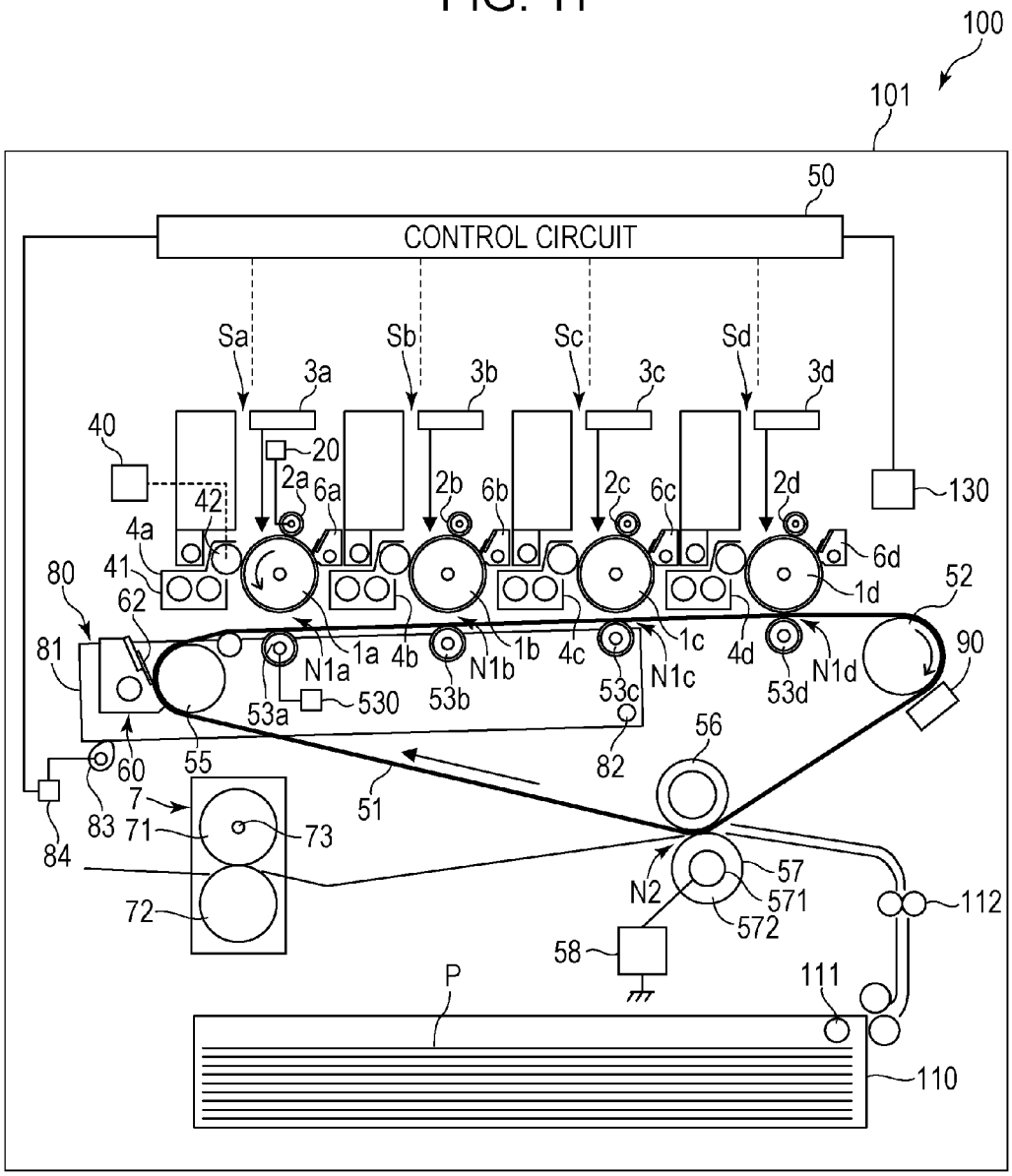
FIG. 11 is a schematic diagram illustrating a stopped state of the image forming apparatus according to a fourth embodiment.

To this end, the present embodiment includes a separating mechanism 80 serving as a separating unit to bring the photosensitive drums 1*a* through 1*c* of the image forming stations Sa through Sc into contact with the intermediate transfer belt 51, and to separate the contact thereof, as illustrated in FIG. 11. The separating mechanism 80 includes a supporting member 81 that supports the follower roller 55 of the intermediate transfer belt 51, the primary transfer rollers 53*a* through 53*c*, the belt cleaner 60, and so forth, a supporting shaft 82, a cam 83, and a driving roller 84. The supporting member 81 is rockably supported as to supporting shaft 82, and brings the intermediate transfer belt 51 into contact with or away from contact with the photosensitive drums 1*a* through 1*c* by the cam 83 rotating. The cam 83 is rotationally driven by the driving roller 84 controlled by the control circuit 50.

In the case of the present embodiment, when ending an image forming job, just the photosensitive drum 1*d* of the black image forming station Sd is left in contact with the intermediate transfer belt 51, in preparation for a case where a black monochrome image will be formed in the next job. The photosensitive drums 1*a* through 1*c* of the other image forming stations Sa through Sc are separated from the intermediate transfer belt 51. Accordingly, in a case where the monochrome mode is selected next, the image forming operations can be quickly started.

Accordingly, when an image forming job ends, the control circuit 50 performs idle rotation (post rotation) of the photosensitive drums for a while to clean transfer residual toner, discharge the surface thereof, and so forth, and thereafter stops the rotation of the photosensitive drums. At this time, the photosensitive drum 1*d* of the image forming station Sd farthest downstream is left in a state in contact with the intermediate transfer belt 51, and the photosensitive drums of the other image forming stations are separated from the intermediate transfer belt 51, as illustrated in FIG. 11. That is to say, the control circuit 50 stops the driving of the photosensitive drums of the image forming stations and intermediate transfer belt 51 when ending an image forming job, which is the predetermined timing. Thereafter, the separating mechanism 80 is controlled to separate the photosensitive drums 1*a* through 1*c* of the image forming stations Sa through Sc which are first image forming stations from the intermediate transfer belt 51. The photosensitive drum 1*d* of the image forming station Sd which is a second image forming station remains in contact with the intermediate transfer belt 51.

Accordingly, after ending image forming in the case of the present embodiment, only the photosensitive drum 1*d* is in contact with the intermediate transfer belt 51, so the interposing toner only needs to be interposed between the photosensitive drum 1*d* and the intermediate transfer belt 51. In the present embodiment as well, the diameter of the photosensitive drum 1*a* (1*b* through 1*d*) is 30 mm, which is small. The developing sleeve 42 and the primary transfer portion N1*a* (N1*b* through N1*d*) are in a positional relationship approximately 90° from each other along the circumferential direction of the photosensitive drum 1*a* (1*b* through 1*d*), with the distance following the rotational direction from the developing sleeve 42 to the primary transfer portion N1*a* being 23 mm. The process speed is 250 mm/sec. Accordingly, there are cases where the interposing toner formed at the respective image forming stations will overrun the primary transfer portions N1*a* through N1*d* when ending image forming, as described in the first embodiment. The present embodiment controls each of the units when ending image forming, which is the predetermined timing.

Figure 12:
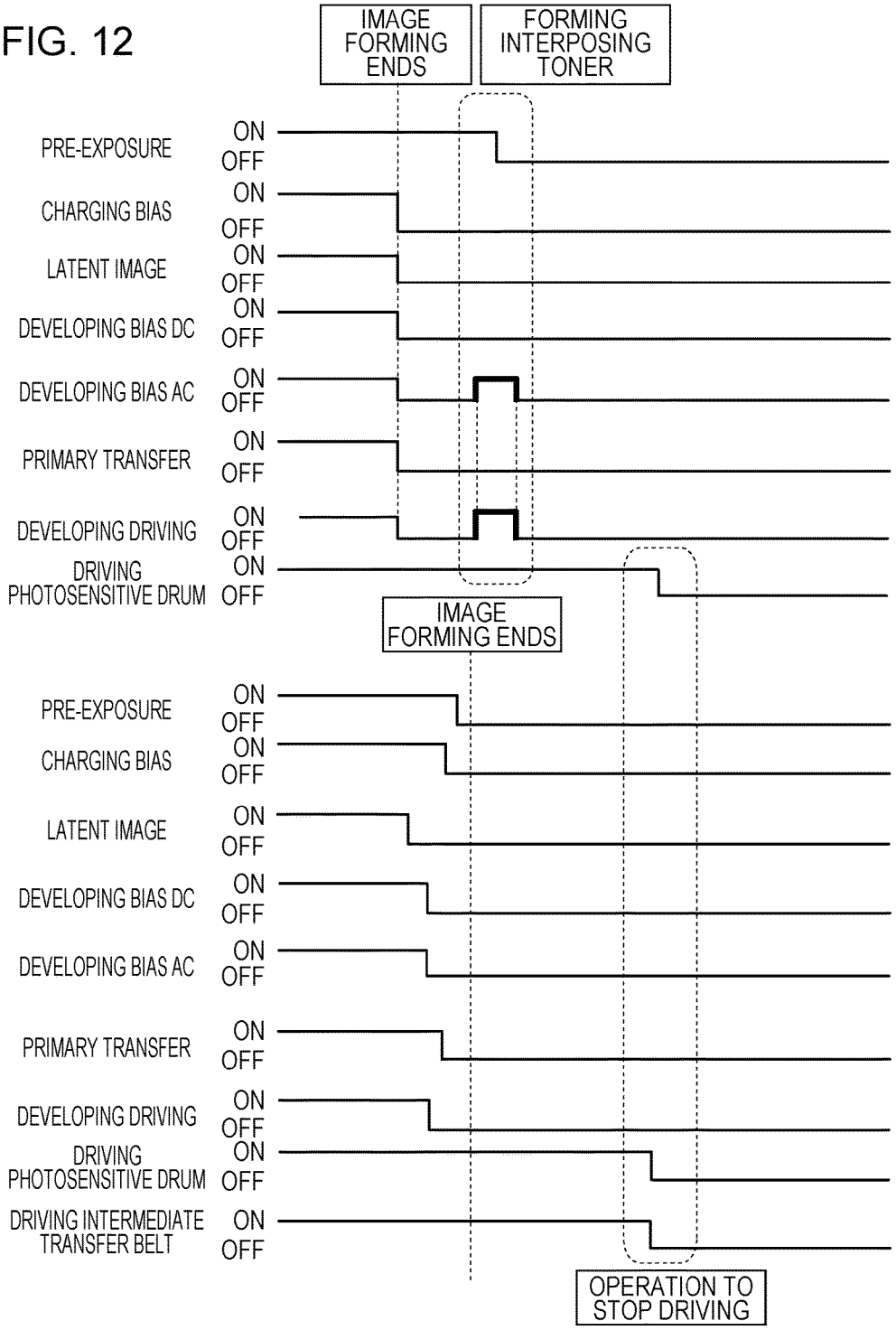
FIG. 12 is a timing chart illustrating the control timing for each device according to the fourth embodiment.

FIG. 12 shows control timing when ending image forming at each device. In the present embodiment, interposing toner is adhered to the surface of the photosensitive drum 1*b* of the image forming station Sb, which is a first image forming station, when ending image forming which is the predetermined timing. Forming of the interposing toner is performed in the same way as in the first embodiment. That is to say, the interposing toner t is formed by adhering toner to the surface of the photosensitive drum 1*b* by turning the developing AC on in a state where the charging DC is off and the developing DC is off.

This interposing toner is then interposed between the photosensitive drum 1*d* of the image forming station Sd, which is farthest downstream and serves as the second image forming station, and the intermediate transfer belt 51. That is to say, the interposing toner formed at the image forming station Sb is transferred onto the intermediate transfer belt 51. Accordingly, the primary transfer bias is applied until the interposing toner is transferred onto the intermediate transfer belt 51. Also, the driving of the photosensitive drums 1*a* through 1*d* and the intermediate transfer belt 51 (photosensitive drum driving) is continued until the interposing toner transferred into the intermediate transfer belt 51 reaches the point between the photosensitive drum 1*d* of the image forming station Sd and the intermediate transfer belt 51. At the timing that the interposing toner reaches the point between the photosensitive drum 1*d* and the intermediate transfer belt 51 (i.e., the primary transfer portion N1*d*), the driving of the photosensitive drum 1*d* of the image forming station Sd and the intermediate transfer belt 51 is stopped. Thereafter, the separating mechanism 80 separates the image forming stations Sa through Sc from the intermediate transfer belt 51.

Figure 13:
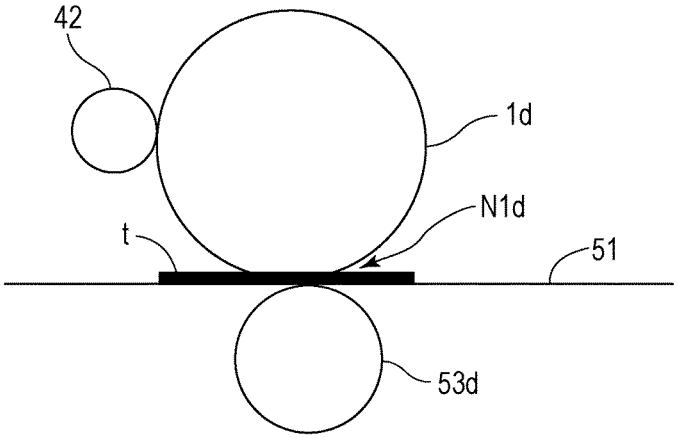
FIG. 13 is a schematic diagram illustrating a state in which interposing toner is interposed at primary transfer portion in the fourth embodiment.

Accordingly, the interposing toner t can be interposed at the primary transfer portion N1*d* of the image forming station Sd downstream, as illustrated in FIG. 13. That is to say, the interposing toner is formed at the image forming station Sb upstream, and the interposing toner t is interposed at the primary transfer portion N1*d* of the image forming station Sd downstream. Accordingly, even in a case where the photosensitive drum is small as described above, the interposing toner can be interposed at the primary transfer portion N1*d* of the image forming station Sd downstream in a more sure manner. As a result, part of the constituents of the intermediate transfer belt 51 such as rubber material, fluorine compounds, and so forth, can be prevented from migrating onto the surface of the photosensitive drum 1*d*, and thus occurrence of streaks can be suppressed.

Also, the photosensitive drums 1*a* through 1*c* of the image forming stations Sa through Sc are separated from the intermediate transfer belt 51 as described above after ending image forming. Accordingly, no streaks will occur at these even if not interposing toner is interposed between the photosensitive drums 1*a* through 1*c* and the intermediate transfer belt 51.

Although description has been made above where the image forming station Sb is used to send interposing toner to the primary transfer portion N1*d* of the image forming station Sd, this is not restrictive. For example, the same advantages can be obtained by using any station that is upstream by a sufficient distance as to the station where the photosensitive drum will be in contact with the intermediate transfer belt when ending image forming. The color of the toner forming the interposing toner is not restricted either.

Fifth Embodiment

A fifth embodiment will be described by way of FIGS. 14 and 15, with reference to FIG. 12. A configuration has been made in the fourth embodiment where interposing toner is formed at the image forming station Sb when ending image forming, but in the present embodiment, interposing toner t is formed at the image forming station Sa. Other configurations and operations are the same as in the fourth embodiment, so the same configurations will be denoted by the same reference numerals, and description thereof will be omitted or simplified. Description will be made primarily regarding feature portions of the fifth embodiment.

In a case of interposing the interposing toner between a photosensitive drum and the intermediate transfer belt when ending image forming, the interposing toner adheres to the secondary outer transfer roller 57 when forming the next image. In a case where cleaning of the secondary outer transfer roller 57 is insufficient, the back side of the recording medium conveyed to the secondary transfer portion N2 may be contaminated by the toner that has adhered to the secondary outer transfer roller 57 (backside contamination). This problem particularly readily occurs in modes where the cleaning time of the secondary outer transfer roller is short and starting of printing operations is fast.

Accordingly, in the present embodiment, the interposing toner is formed at the image forming station using the toner of which the visibility by eye is lowest even if adhered to the recording medium, out of the multiple image forming stations. Specifically, the interposing toner is formed at the image forming station Sa that uses yellow toner.

The control timing when ending image forming at each device is approximately the same as in FIG. 12 described in the fourth embodiment, but while the interposing toner is formed at the image forming station Sb in FIG. 12, the interposing toner is formed at the image forming station Sa in the present embodiment. That is to say, the interposing toner t is formed by adhering interposing toner t on the surface of the photosensitive drum 1*a* of the image forming station Sa when ending image forming, which is the predetermined timing. Forming of the interposing toner is performed in the same way as in the first embodiment. This interposing toner is then interposed between the photosensitive drum 1*d* of the image forming station Sd that is farthest downstream, and the intermediate transfer belt 51. That is to say, the interposing toner formed at the image forming station Sa is transferred into the intermediate transfer belt 51. Accordingly, the primary transfer bias is applied until the interposing toner is transferred onto the intermediate transfer belt 51.

Also, the driving of the photosensitive drums 1*a* through 1*d* and the intermediate transfer belt 51 (photosensitive drum driving) is continued until the interposing toner transferred into the intermediate transfer belt 51 reaches the point between the photosensitive drum 1*d* of the image forming station Sd and the intermediate transfer belt 51. At the timing that the interposing toner reaches the point between the photosensitive drum 1*d* and the intermediate transfer belt 51 (i.e., the primary transfer portion N1*d*), the driving of the photosensitive drum 1*d* of the image forming station Sd and the intermediate transfer belt 51 is stopped. Thereafter, the separating mechanism 80 separates the image forming stations Sa through Sc from the intermediate transfer belt 51.

Next, control from starting driving of the photosensitive drum up to starting of normal image forming operations, in accordance with a reprint operation instruction, will be described. As described above, interposing toner is interposed at the primary transfer portion N1*d* when ending image forming the previous time. When starting the next image forming, the interposing toner reaches the secondary transfer portion N2 due to driving of the photosensitive drums 1*a* through 1*d* and the intermediate transfer belt 51, and part of the interposing toner adheres to the secondary outer transfer roller 57.

Figure 14:
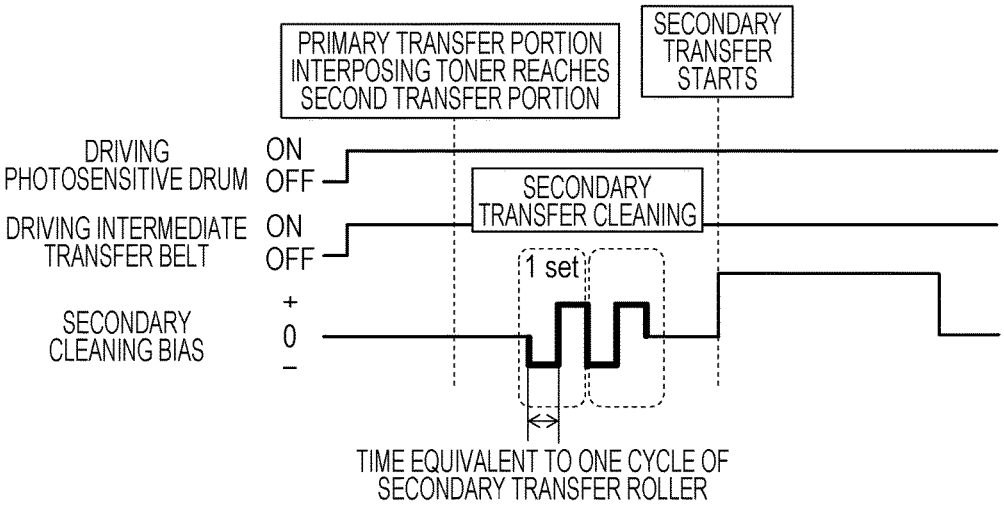
FIG. 14 is a timing chart illustrating control timing of each device in cleaning of a secondary outer transfer roller according to a fifth embodiment.

Accordingly, after the interposing toner has passed the secondary transfer portion N2, electrostatic cleaning is performed where the secondary outer transfer roller 57 is electrostatically cleaned, as illustrated in FIG. 14. First, while the secondary outer transfer roller 57 remains in a rotating state, negative polarity bias, that is of the same polarity as the toner, is applied to the secondary outer transfer roller 57 from the secondary transfer bias power source 58 serving as the electrostatic cleaning unit, for an amount of type equivalent to one turn (approximately 0.23 sec). Thereafter, positive polarity bias, that is of the opposite polarity to the toner, is applied to the secondary outer transfer roller 57 for an amount of type equivalent to one turn. Thus, one turn each of negative-polarity and positive-polarity bias (reversing cleaning bias) makes up one set, and changing the number of times changes the cleaning time.

In a case where the toner charge amount within the developer container is maintained within a predetermined range, after the interposing toner before starting of the secondary transfer passes the secondary transfer portion and then two sets of electrostatic cleaning is performed, the secondary transfer operations is performed in the present embodiment, as illustrated in FIG. 14. It was found in the present embodiment that a reverse polarity bias value of around −20 μA and a positive polarity bias value of around +40 μA was sufficient to avoid backside contamination. However, if the amount of interposing toner reaches a certain amount or more, even if these bias values are used, backside contamination occurs even after two sets of electrostatic cleaning even if the negative polarity and positive polarity bias is sufficiently high. Accordingly, backside contamination was found to be avoidable by increasing the number of times of cleaning and performing transfer to the intermediate transfer belt 51 side a little at a time.

Now, an experiment will be described in which the density of interposing toner was changed, regarding a case of using yellow toner (embodiment) and a case of using black toner (comparative example) as the interposing toner. The number of times of cleaning the secondary outer transfer roller 57, whether streaks occurred, whether backside contamination was conspicuous, and time from starting printing operation to output of first recording medium (printed output), were examined in the experiment regarding the embodiment and comparative example. The results are as shown in Table. Cases where streaks occurred are indicated by "poor", cases with no streaks by "good", cases where backside contamination was conspicuous to the eye by "poor", cases where somewhat conspicuous but in a tolerable range by "fair", and cases where not conspicuous by "good".

TABLE

| | Experiment No. | Toner used | Interposing toner density | Times secondary outer transfer roller cleaned | Streaks | Backside contamination |
|---|---|---|---|---|---|---|
| Embodiment | 1 | Yellow | a | 0 | Poor | Good |
| | 2 | | b | 0 | Good | Good |
| | 3 | | c | 0 | Good | Good |
| | 4 | | d | 0 | Good | Fair |
| | 5 | | | 1 | Good | Good |
| Comparative Example | 6 | Black | b | 0 | Good | Poor |
| | 7 | | | 2 | Good | Good |
| | 8 | | c | 2 | Good | Poor |
| | 9 | | | 3 | Good | Fair |
| | 10 | | | 4 | Good | Good |

Figure 15:
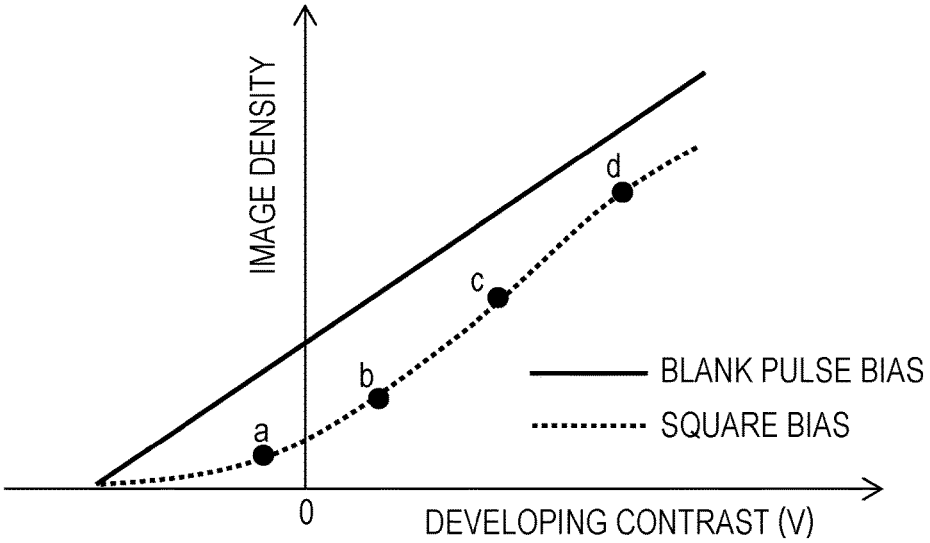
FIG. 15 is a diagram illustrating the relationship between development contrast and interposing toner density according to the fifth embodiment.

The interposing toner densities a through d shown in Table are densities at points on a developing contrast and toner density curve illustrated in FIG. 15. The farther away from a toward d on the curve, the higher the density of interposing toner is. The "blank pulse bias" in FIG. 15 is a case of using DC voltage and vibrating voltage alternating between a high-frequency portion where the frequency is 10.0 kHz and peak-to-peak voltage (Vpp) is 1.4 kV and a blank portion, as the developing bias. On the other hand, the "square bias" is a case of using vibrating voltage where DC voltage and square-wave AC voltage where the frequency is 10.0 kHz and peak-to-peak voltage (Vpp) is 1.4 kV are superimposed, as the developing bias. That is to say, the square bias has no blank portion. This point will be described later in detail in a sixth embodiment.

FIG. 15 illustrates the developing properties when using blank pulse bias and when using square bias. The horizontal axis represents the developing contrast potential (the potential difference between the photosensitive drum and the developing sleeve, i.e., the difference between the charging potential and the developing bias DC component), and the vertical axis represents image density.

In the experiments, the interposing toners having density a through d were formed by changing the DC voltage of the developing bias using square bias. In Experiment No. 1, it can be seen that streaks are occurring at density a where the interposing toner density is low, so a predetermined amount or more of interposing toner is necessary to prevent migration of constituents of the intermediate transfer belt 51 to the photosensitive drum. It was found from the experiments that streaks do not occur if the interposing toner density is b or above. On the other hand, it was found that using black interposing toner left conspicuous backside contamination depending on the number of times of cleaning.

Experiment No. 3 according to the embodiment and Experiment No. 7 according to the comparative example had hardly any conspicuous backside contamination. While Experiment No. 3 had no conspicuous backside contamination even without electrostatic cleaning, Experiment No. 7 involved electrostatic cleaning to be performed two times for backside contamination to not be conspicuous. Accordingly, Experiment No. 3 was able to reduce the time until outputting the first recording medium when reprinting by 1.3 seconds as compared to Experiment No. 7. Comparing Experiment No. 5 with Experiment No. 10 slows that backside contamination is less conspicuous even in cases where the density of interposing toner is high, by performing cleaning a fewer number of times as compared to the comparative example. It thus has been found that using yellow toner enables the density range of interposing toner used to be broadened.

As described above, the interposing toner was formed in the present embodiment using yellow toner that is least visible to the eye. Thus, backside contamination can be made less conspicuous even if the secondary outer transfer roller is contaminated, while preventing constituents of the intermediate transfer belt 51 from migrating to the photosensitive drum.

Although yellow toner is used as toner that is least visible to the eye in the present embodiment, transparent toner that does not contain pigments or dyes may be used instead. In this case, an image forming station that uses transparent toner is disposed on the upstream side of the image forming station that interposes the interposing toner at the primary transfer portion. In a case of using colored paper or the like for the recording medium, interposing toner may be formed at an image forming station having toner of a color that is similar to the color of the color paper. First Other Example of Fifth Embodiment A first other example of the fifth embodiment will be described. Description has been made above regarding the fifth embodiment that, after forming a full-color image, only the photosensitive drum 1*d* of the image forming station Sd is left in contact with the intermediate transfer belt 51 and image forming is ended. In comparison, description will be made in the present example where image forming is performed in the monochrome mode that performs image forming using only the black image forming station Sd.

In the post rotation when ending image forming in the monochrome mode, the photosensitive drums 1*a* through 1*c* of the image forming stations Sa through Sc are brought into contact with the intermediate transfer belt 51 by the separating mechanism 80 (see FIG. 11). Yellow interposing toner is then formed at the image forming station Sa in the same way as in the fifth embodiment, and this interposing toner is interposed at the primary transfer portion N1*d* of the image forming station Sd. Thereafter, the photosensitive drums 1*a* through 1*c* of the image forming stations Sa through Sc are separated from the intermediate transfer belt 51 by the separating mechanism 80.

In the case of the present example described above, the interposing toner can be formed using toner of an inconspicuous color even after having ended image forming in the monochrome mode. Other configurations and operations are the same as in the fifth embodiment.

Second Other Example of Fifth Embodiment

A second other example of the fifth embodiment will be described. Description has been made above regarding the fifth embodiment that, in a stopped state of the image forming apparatus, only the photosensitive drum 1*d* of the image forming station Sd is left in contact with the intermediate transfer belt 51 when the image forming apparatus is in a stopped state, and the other photosensitive drums are separated from the intermediate transfer belt 51. In comparison, description will be made in the present example where all image forming station photosensitive drums are left in contact with the intermediate transfer belt 51 when the image forming apparatus is in a stopped state.

In order to increase the speed for starting image forming of the first sheet in full-color mode, the photosensitive drums of all image forming stations are left in contact with the intermediate transfer belt in the stopped state of the image forming apparatus. According to the present embodiment, the image forming station Sa for yellow toner that is farthest upstream is used to form interposing toner for all of the stations in this case.

The image forming station Sa is used to form interposing toner for each of the stations during post rotation when ending image forming. The interposing toner is sequentially formed for the black image forming station Sd, cyan image forming station Sc, magenta image forming station Sb, and yellow image forming station Sa, in that order, with a predetermined distance between each. That is to say, the interposing toner is formed in order for the image forming stations downstream. The driving of the photosensitive drums and the intermediate transfer belt 51 is then stopped so that each interposing toner will stop at the primary transfer portion of each color station.

In the case of the present example described above, the interposing toner can be formed using toner of an inconspicuous color even after having ended image forming in the monochrome mode. Other configurations and operations are the same as in the fifth embodiment.

Sixth Embodiment

A sixth embodiment will be described by way of FIGS. 16 through 25, with reference to FIGS. 1 through 6. In the above embodiments, the duty ratio of the waveforms of AC voltage (developing bias AC) applied to the developing sleeve 42 when forming the interposing toner has been described as being constant. Conversely, in the present embodiment, at least one of duty ratio, amplitude, and frequency of the waveform of the developing bias AC is changed based on information relating to toner concentration. Other configurations and operations are the same as in the first embodiment, so the same configurations will be denoted by the same reference numerals, and description thereof will be omitted or simplified. Description will be made primarily regarding feature portions of the sixth embodiment. Although description is made regarding the image forming station Sa below, the same holds true for the other image forming stations as well.

In a case where the toner concentration or toner charge amount changes within the developer container 41, there is a possibility that the amount of toner for the interposing toner will change. That is to say, in a case where the toner concentration within the developer container 41 is high (the toner charge amount is low), the amount of toner for the interposing toner increases, and conversely, in a case where the toner concentration is low (the toner charge amount is high), the amount of toner for the interposing toner decreases.

Now, if the amount of toner for the interposing toner increases, migration of constituents of the intermediate transfer belt 51 such as fluorine compounds and so forth to the photosensitive drum 1*a* (1*b* through 1*d*) can be sufficiently suppressed, but the amount of toner consumption increases. Also, if the amount of toner for the interposing toner increases, interposing toner is transferred from the photosensitive drum 1*a* to the intermediate transfer belt 51 in the first driving at the next time of image forming, and a large amount of toner readily adheres to the surface of the secondary outer transfer roller 57. Accordingly, extra time may be involved to clean off the toner adhered to the secondary outer transfer roller 57 before forming images.

On the other hand, if the amount of toner for the interposing toner decreases, migration of constituents of the intermediate transfer belt 51 such as fluorine compounds and so forth to the photosensitive drum 1*a* (1*b* through 1*d*) cannot be sufficiently suppressed. Accordingly, streaks readily occur in halftone images when forming the next image. Accordingly, information relating to the density of toner images developed by the developing device 4*a* (4*b* through 4*d*) is detected in the present embodiment. Based on the detection results thereof, at least one of duty ratio, amplitude, and frequency of the waveform of the AC voltage applied to the developing device 4*a* when forming the interposing toner t is changed. This will be described next in detail.

Developing Device and Toner Replenishing Device

The developing device 4*a* (4*b* through 4*d*) and the toner replenishing device 49 according to the present embodiment will be described with reference to FIG. 16. Note that the developing devices 4*a*, 4*b*, 4*c*, and 4*d* are the same in configuration, and the toner replenishing devices 49 that replenish toner to the developing devices of the same color also are the same in configuration. Accordingly, description will be made below regarding the developing device 4*a* and the toner replenishing device 49 that replenishes toner to the developing device 4*a*, and description of other developing devices will be omitted.

Figure 16:
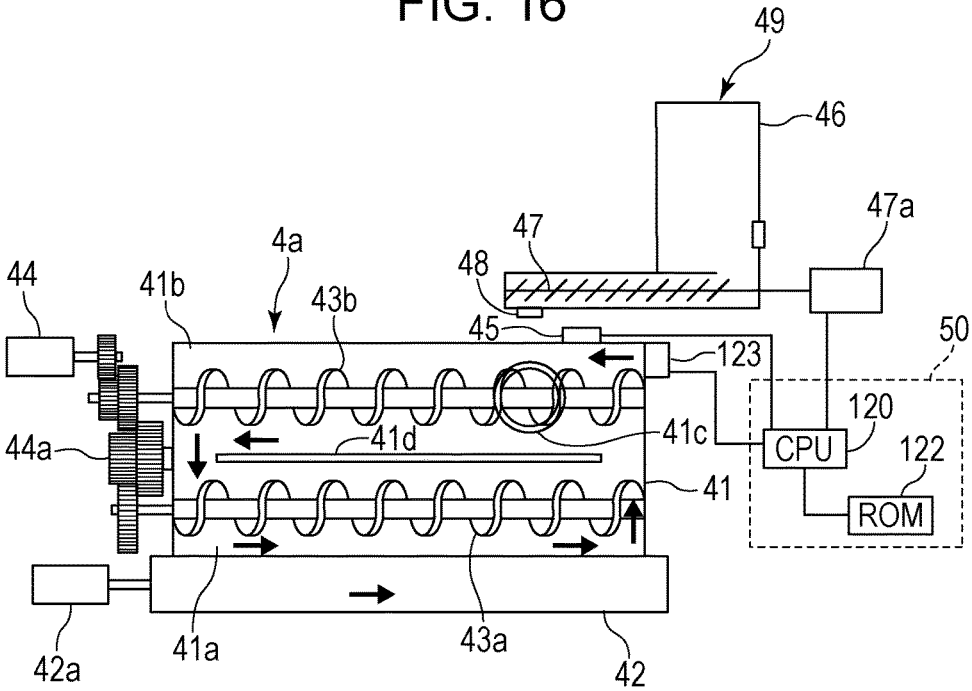
FIG. 16 is a schematic configuration diagram of a developing device according to a sixth embodiment.

FIG. 16 is a schematic planar view illustrating the developing device 4*a* from above in FIG. 1, while illustrating the toner replenishing device 49 as a schematic cross-sectional view taken along the rotational axis direction of the photosensitive drum 1*a*. The developing device 4*a* has the developer container 41 that stores two-component developer (developing agent), the primary components thereof being non-magnetic particles (toner) and magnetic carrier particles (carrier).

Toner includes colorant resin particles including binding resin, colorant, and other additives as necessary, and coloration particles to which external additives such as fine powder of colloidal silica have been added. Toner is a negatively-charging polyester resin manufactured by polymerization, preferably having a volume-average particle diameter of 5 μm or larger but 8 μm or smaller. The volume-average particle diameter according to the present embodiment is 6.2 μm.

Alternatively, preferably used for the carrier are superficially-oxidized or non-oxidized iron, nickel, cobalt, manganese, chromium, rare earths, and like metals, alloys thereof, ferrite oxides, and so forth. The manufacturing method of these magnetic particles is not particularly restricted. The carrier has a weight-average particle diameter of 20 to 50 μm, preferably 30 to 40 μm, with resistivity of $10^7$ Ω·cm or greater, preferably $10^8$ Ω·cm or greater. Carrier having resistivity of $10^8$ Ω·cm was used in the present embodiment. A low-specific-gravity carrier was manufactured by mixing magnetic metal oxides and non-magnetic metal oxides into a phenol binder resin at a predetermined ratio. Manufacturing was performed by polymerization thereof, yielding a resin magnetic carrier which was used in the present embodiment. The volume-average particle diameter of the carrier used in the present embodiment was 35 μm, the true density was 3.6 to 3.7 g/cm$^3$, and the magnetization level was 53 A·m$^2$/kg.

Two screws, a first conveying screw 43*a* and a second conveying screw 43*b*, are disposed within the developer container 41 as developer stirring and conveying members. Part of the developer container 41 that faces the photosensitive drum 1*a* is opened, and the developing sleeve 42 is rotatably disposed so as to be partially exposed from this opening, to serve as a developer bearing member. A magnet roll (omitted from illustration) is fixed within the developing sleeve 42, to serve as a magnetic field generating unit. The magnet roll has multiple magnetic poles along the circumferential direction, so as to attract the developer within the developer container 41 to be borne on the developing sleeve 42, and also forming a nap (magnetic brush) of the developer at a developing position facing the photosensitive drum 1*a*.

The developing sleeve 42 and the first and second conveying screws 43*a* and 43*b* are disposed in parallel. The developing sleeve 42 and the first and second conveying screws 43*a* and 43*b* are also disposed in parallel to the rotational axis direction of the photosensitive drum 1*a*. Inside of the developer container 41 is divided into a developing chamber (first chamber) 41*a* and a stirring chamber (second chamber) 41*b* by a partition 41*d*. The partition 41*d* has formed therein communicating portions at both ends in the longitudinal direction of the developer container 41 (direction parallel to the rotational axis direction of the photosensitive drum 1*a*, shown at the left and right ends in FIG. 16) communicating between the developing chamber 41*a* and stirring chamber 41*b*.

The first conveying screw 43*a* is disposed within the developing chamber 41*a*, and the second conveying screw 43*b* is disposed within the stirring chamber 41*b*. The first and second conveying screws 43*a* and 43*b* are rotationally driven in the same direction, by rotation of a motor 44 via a gear train 44*a*. This rotation causes the developer within the stirring chamber 41*b* to be moved to the left in FIG. 16 while being stirred by the second conveying screw 43*b*, and to move into the developing chamber 41*a*. On the other hand, the developer within the developing chamber 41*a* is moved to the right in FIG. 16 while being stirred by the first conveying screw 43*a*, and moves into the stirring chamber 41*b* through the communicating portion. That is to say, the developer is conveyed so as to circulate through the developer container 41 while being stirred by the first and second conveying screws 43*a* and 43*b*. This stirring conveyance of the toner in the developer is what imparts the charge thereto.

Replenishing toner to the developer container 41 is performed from a toner replenishing opening 41*c* provided at the upper part of the stirring chamber 41*b*, at the upstream end side in the direction of conveying the developer. A window is provided at the right end side of the stirring chamber 41*b* in FIG. 16, to visually conform the state inside from the outside. Toner replenished from the toner replenishing opening 41*c* is stirred with the developer and conveyed through the stirring chamber 41*b* by the second conveying screw 43*b* within the stirring chamber 41*b*.

The developing sleeve 42 is rotationally driven by a motor 42*a*. the developing sleeve 42 conveys, by the rotation thereof, developer applied in a layer on the surface thereof by a regulating blade (omitted from illustration), to the developing position facing the photosensitive drum 1*a*. A nap is formed of the developer on the developing sleeve 42 at the developing position by the magnetic force of the magnet roll, forming a magnetic brush that comes into contact or proximity with the surface of the photosensitive drum 1*a*. The developer (two-component developer) thus conveyed to the developing position supplies toner to the electrostatic latent image on the photosensitive drum 1*a*. Thus, toner selectively adheres to the image portion of the electrostatic latent image, and the electrostatic latent image is developed as a toner image.

To further extend the description, when the electrostatic image on the photosensitive drum 1*a* reaches the developing position, developing bias where AC voltage is superimposed on DC voltage is applied to the developing sleeve 42 from the developing bias power source 40 (see FIG. 1). The developing sleeve 42 is rotationally driven by the motor 42*a* at this time, so the toner in the developer moves onto the photosensitive drum 1*a* by the above-described developing bias, in accordance with the electrostatic latent image on the surface of the photosensitive drum 1*a*.

The toner in the two-component developer is consumed by the developing operations described above. The toner concentration within the developer in the developer container 41 thus gradually decreases. Accordingly, toner is supplied to the developer container 41 by the toner replenishing device 49. The toner replenishing device 49 has a toner container 46 that stores toner to be replenished to the developing device 4*a*. A toner discharging port 48 is provided to the toner container 46, and the lower left end in FIG. 16. The toner discharging port 48 is linked to the toner replenishing opening 41*c* of the developer container 41. A toner replenishing screw 47 is provided to the toner container 46, to serve as a toner replenishing member that conveys toner toward the toner discharging port 48. The toner replenishing screw 47 is rotationally driven by a motor 47*a*.

The rotations of the motor 47*a* are controlled by the CPU 120 of the control circuit 50 in the image forming apparatus main body. The corresponding relation between the rotation time of the motor 47*a* in a state where a predetermined amount of toner is stored in the toner container 46 and the amount of toner replenished to the developer container 41 via the toner discharging port 48 by the toner replenishing screw 47 has been found through experimentation beforehand. The results are stored in the ROM 122 connected to the CPU 120 (or within the CPU 120) in the form of table data, for example. That is to say, the CPU 120 adjusts the amount or toner replenished to the developer container 41 by controlling (adjusting) the rotation time of the motor 47*a*. The method of controlling the amount of toner to be replenished will be described later in detail.

The developing device 4*a* is provided with a storage device 123 in the present embodiment. The storage device 123 is realized by a read-write-capable route processor ROM (RP-ROM) in the present embodiment. The storage device 123 is electrically connected with the CPU 120 by being set inside the apparatus main unit of the image forming apparatus 100, and can read and write image forming processing information of the developing device 4*a* from and to the apparatus main unit side.

Method for Detecting Inductance

The developing device 4*a* according to the present embodiment has a magnetic permeability sensor 45 attached within the stirring chamber 41*b*, as a magnetic permeability detecting unit to detect the toner concentration of the developer. The magnetic permeability sensor 45 detects the toner concentration within the developer container 41 by detecting the magnetic permeability within the developer container 41, by inductance detection which will be described later. The magnetic permeability sensor 45 is disposed on a side wall of the developer container 41 at the upstream side from the toner replenishing opening 41*c* in the direction of conveying the developer within the stirring chamber 41*b*. If the position where toner is replenished from the toner replenishing device 49 is taken as being farthest upstream in the circulation of the developer, the position where the magnetic permeability sensor 45 is attached is the farthest downstream. That is to say, the magnetic permeability sensor 45 is disposed so as to be able to detect toner concentration of developer in a state where stirring is most advanced. The toner concentration in the developer container 41 affects the density of the toner image developed by the developing device 4*a*, so the magnetic permeability sensor 45 serves as a toner concentration information detecting unit that detects information relating to the density of the toner image developed by the developing device 4*a*.

Now, toner replenishing control by inductance detection will be described here. Image forming operations reduces the toner within the developer container 41. Accordingly, the toner concentration in the developer falls. The magnetic permeability sensor 45 detects the magnetic permeability of the developer in order to detect the toner concentration of the developer within the developer container 41. In a case where the toner concentration in the developer is small, the proportion of carrier having magnetism increases, so the magnetic permeability of the developer increases, and the output level of the magnetic permeability sensor 45 rises.

Figure 17:
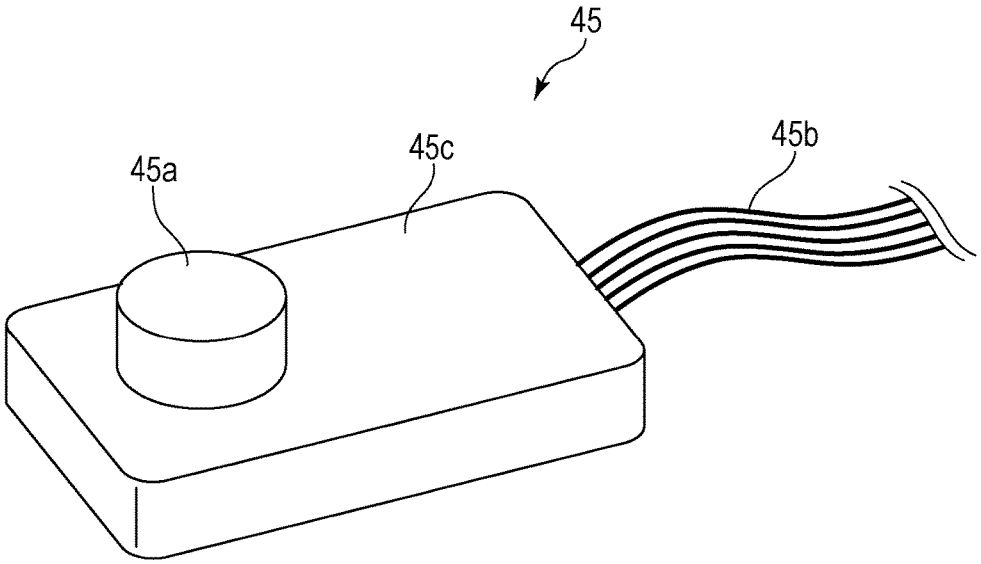
FIG. 17 is a perspective view of a magnetic permeability sensor according to the sixth embodiment.

FIG. 17 illustrates the magnetic permeability sensor 45, where a cylindrical detecting head 45*a* is integrally formed on a sensor main unit 45*c*. The magnetic permeability sensor 45 exchanges detection signals with the CPU 120 via a signal line 45*b* for input/output. The detecting head 45*a* has a detecting transform embedded therein. This detecting transform has a total of three coils; one primary coil, and two secondary coils which are a reference coil and a detecting coil. The detecting coil is situated at the ceiling side of the detecting head 45*a*, while the reference coil is situated at the rear side of the detecting head 45*a* across the primary coil. When current having a signal of a predetermined waveform is input to the primary coil from an oscillator disposed within the sensor main unit 45*c*, the current having the signal of the predetermined waveform flows through the two secondary coils made up of the reference coil and detecting coil by electromagnetic induction. The concentration of magnetic substance at the ceiling side of the detecting head 45*a* is then detected by a comparing circuit provided within the sensor main unit 45*c* judging the signals of the predetermined waveform from the oscillator at this time with the signals of the predetermined waveform from the detecting coil due to electromagnetic induction.

Figure 18:
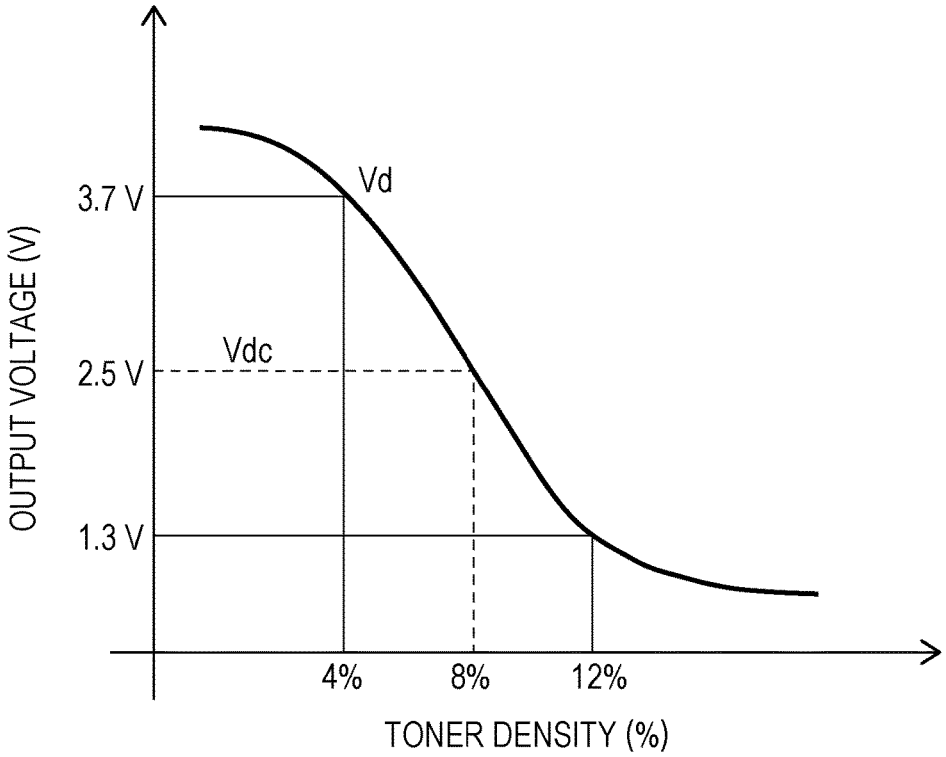
FIG. 18 is a diagram illustrating the relationship between toner concentration of developer and output of the magnetic permeability sensor according to the sixth embodiment.

FIG. 18 illustrates the relationship between the toner concentration of the developer and the output voltage of the magnetic permeability sensor 45. In the example in the drawing, the output voltage saturates at a large value in a range where the toner centration is small, and the output voltage gradually becomes small as the toner concentration increases. The present embodiment is adjusted such that the output voltage of the magnetic permeability sensor 45 is 2.5 V (target signal value) when the toner concentration is 8% (percent by weight, the same hereinafter). The output voltage changes almost linearly as to the toner concentration around the voltage value of 2.5 V. Note that the settings for the target signal value of the magnetic permeability sensor 45 are changed to a suitable target value in accordance with the usage state and usage environment of the developing device.

As described above, the toner concentration of developer within the developer container 41 is detected by the magnetic permeability sensor 45. The toner replenishing device 49 that stores the replenishment toner is driven based on the detection results thereof, so as to maintain the toner density within the developer container 41 within a predetermined range. That is to say, the CPU 120 decides the rotation time of the motor 47*a* (i.e., amount of toner replenishment) based on the detection results by the magnetic permeability sensor 45, and rotates the motor 47*a* for an amount of time according thereto. Specifically, toner is replenished to the developer container 41 by the toner replenishing device 49 based on the relationship between the detection results (detected signal value) of the magnetic permeability sensor 45 and the target signal value (first reference value).

The ROM 122 stores information for obtaining the amount of toner which should be replenished to the developing device 4*a* according to the output of the magnetic permeability sensor 45, based on the relationship between the output of the magnetic permeability sensor 45 and the toner concentration, such as illustrated in FIG. 18, the form of table data or the like. Accordingly, the CPU 120 calculates the number of rotations of the toner replenishing screw 47 from this information and the table data indicating the corresponding relation between the rotation time of the motor 47*a* and the amount of toner replenished, and thus can control the toner replenishing amount. Normally, in toner replenishing control using inductance detection, the number of rotations of the toner replenishing screw 47 is calculated and toner replenishment is performed each time an image forming operation is performed on one sheet of recording medium P.

Patch Image Detection

The present embodiment also involves patch detection along with the above described inductance detection, to perform toner replenishing control. First, patch image detection will be described. In the present embodiment, a predetermined control latent image (patch latent image) is formed on the photosensitive drum 1*a*, and thereafter this latent image is developed under predetermined developing conditions, thereby forming a control toner image (patch image) on the photosensitive drum 1*a*. This patch image is transferred onto the intermediate transfer belt 51, and thereafter the density of the patch image is detecting using an image density sensor 90 (see FIG. 1) serving as a density detecting unit (toner density information detecting unit). The image density sensor 90 inputs density signals corresponding to the image density (amount of toner adhered) to the patch image to the CPU 120. The CPU 120 compares the density signals from the image density sensor 90 with an initial reference signal, and performs control based on the comparison results thereof. A common light reflection type optical sensor may be used for the image density sensor 90.

In the initial installation of the image forming apparatus, the CPU 120 reads out an environment table decided beforehand, that is stored in the ROM 122. The environment table stores beforehand process conditions in accordance with temperature and humidity conditions, for example, and setting values of process conditions such as exposure intensity, developing bias, transfer bias, and so forth. Laser exposure of the charged photosensitive drum 1*a* is performed in accordance with this table, the patch latent image is formed, and this patch latent image is developed to form the patch image.

Toner Replenishing Control

Next, toner replenishing control involving patch detection along with inductance detection will be described. The target value for inductance detection signals is corrected based on the density signals of the patch image detected by the image density sensor 90. The toner charge amount of the developer changes markedly according to usage for extended periods, continued use, variation in the usage environment, and so forth, and also changes due to deterioration of the carrier. In this case, even if the toner concentration is maintained within the predetermined range, it may be difficult to maintain stable image density and color. Accordingly, the present embodiment suitably corrects the target signal value (first reference value) of the output signal of the magnetic permeability sensor 45, based on the density of the patch image detected by the image density sensor 90. Accordingly, variance in toner charge amount can be controller, and exaggerated image density shift can be suppressed. The following description will be made with reference to FIG. 19.

Figure 19:
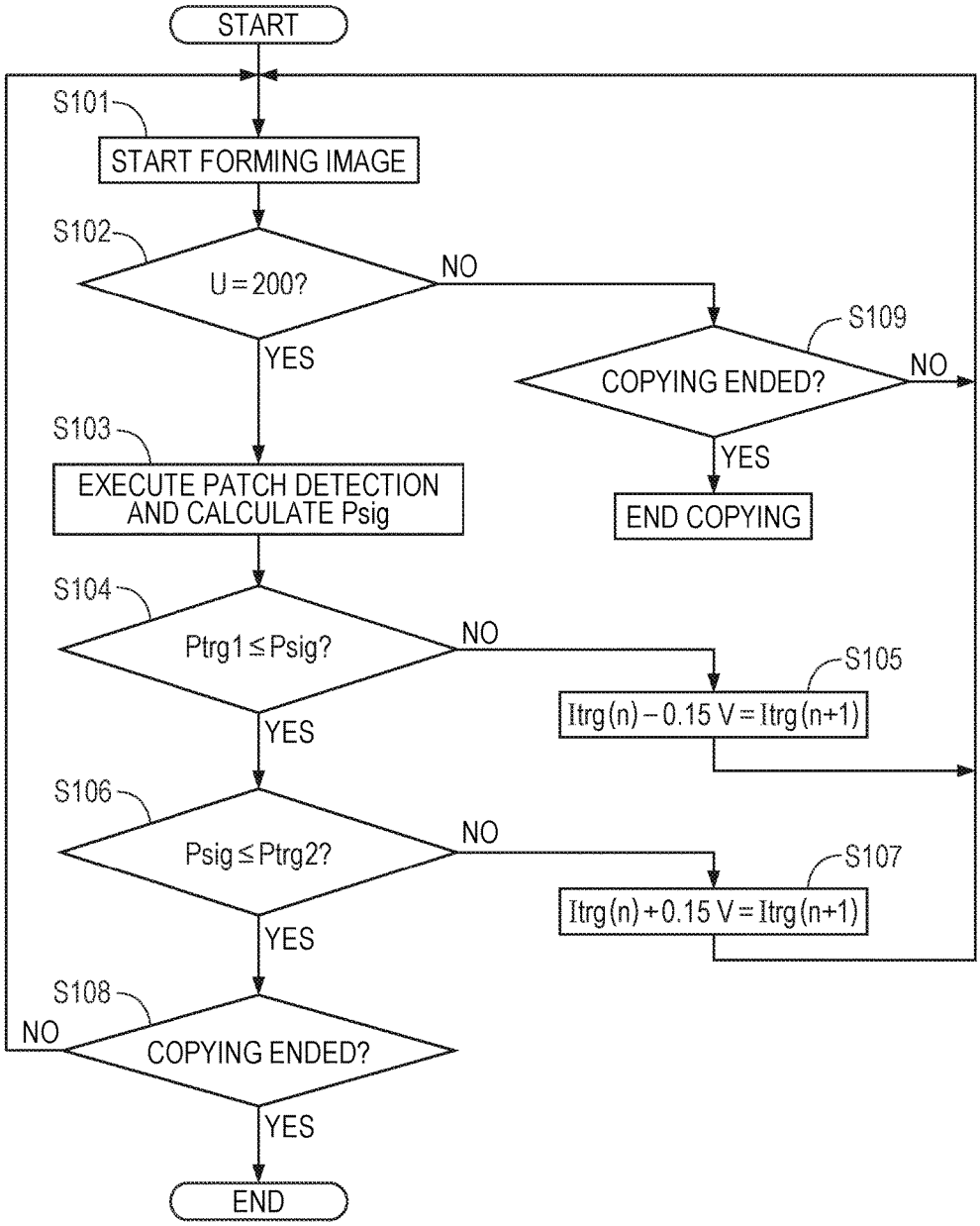
FIG. 19 is a flowchart illustrating a control flow for toner supply control according to the sixth embodiment.

FIG. 19 is a flowchart of toner replenishing control from the start to end of image forming. The symbol "T" used in FIG. 19 indicates the number of images output using the developing device 4*a* from the last time a patch image was formed. "Ptrg1" represents the target lower limit value of the patch image (second reference value), and "Ptrg2" represents the target upper limit value of the patch image (second reference value). "Psig" represents the image density signal value of the patch image (the detection result of the image density sensor 90). "Itrg(n)" represents the target signal value of the magnetic permeability sensor 45 before correction (inductance target signal value, first reference value), and Itrg(n+1) represents the inductance target signal value after correction. In the present embodiment, the number of images output using each developing device is accumulated by the CPU 120 and stored in a storage device built into or connected to the CPU 120.

In the flowchart in FIG. 19, first image forming is started (S101). In a case where the number of output images U from the time of having formed the patch image has reached 200 (S102), the patch image is formed, and thereafter the image density of the patch image (Psig) is detected by the image density sensor 90 (S103). Judgment is then made regarding whether or not the image density Psig of the patch image that has been detected (detection results) and the target lower limit value Ptrg1 (second reference value) satisfy the relationship of Ptrg1 Psig (S104). In a case where this relationship is not satisfied in S104, a predetermined value is subtracted from the inductance target signal value Itrg(n), thereby yielding the inductance target signal value Itrg(n+1) (S105). The predetermined value is 0.15 V (a value equivalent to 0.5% of toner density). Accordingly, the corrected inductance target signal value Itrg(n+1) is obtained from Itrg(n) by calculating Itrg(n)−0.15 (S105).

On the other hand, in a case where Ptrg1 Psig is satisfied in S104, judgment is then made regarding whether or not the patch image density Psig and the target upper limit value Ptrg2 (second reference value) satisfy the relationship of Psig Ptrg2 (S106). In a case where this relationship is not satisfied in S106, the predetermined value (0.15 V) is added to the inductance target signal value Itrg(n). Thus, Itrg(n)+0.15 yields the corrected inductance target signal value Itrg(n+1) from Itrg(n) (S107). That is to say, the inductance target signal value Itrg(n) serving as the first reference value is changed according to the relationship between the image density Psig and the target lower limit value Ptrg1 or target upper limit value Ptrg2 serving as the second reference value.

In a case where Psig Ptrg2 is satisfied in S106, as many images as necessary are output (S108), and the image output operation ends. In a case where the number of output images U from the time of having formed the patch image has not reached 200 in S102, as many images as necessary are output (S109), and the image output operation ends.

Also in the present embodiment, the inductance target signal value Itrg(n) has upper and lower limits for the amount of correction (predetermined upper limit value and lower limit value), with 2.5 V±0.6 V (equivalent to 8%±2% of toner density). This is because raising the toner density to an extremely high level may result in toner fogging or toner scattering frequently occurring. On the other hand, lowering the toner density to an extremely low level may result in carrier adhesion and coarse image quality. Accordingly, even in cases where Ptrg2<Psig or Ptrg1>Psig, Itrg(n+1) never exceeds 3.1 V (predetermined upper limit value) and never falls below 1.9 V (predetermined lower limit value). That is to say, in this case, the inductance target signal value is left at (does not move from) 3.1 V or 1.9 V.

Interposing Toner

The interposing toner is interposed between the photosensitive drums 1*a* through 1*d* and the intermediate transfer belt 51 when ending image forming, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

Thus, in the case of the present embodiment as well, the interposing toner is formed by turning just the developing bias AC on in a state where the charging bias and developing bias DC are off (a state where the surface potential of the photosensitive drum is almost 0 V). Note however, that this is not restrictive, and interposing toner may be formed by forming a potential difference between the photosensitive drum and the developing sleeve. For example, the interposing toner t may be formed by applying developing bias AC in a state where a DC voltage (developing bias DC; −100 V for example) lower than the absolute value of the DC voltage at the time of image forming is applied.

Waveform of Developing Bias AC

Figure 20A:
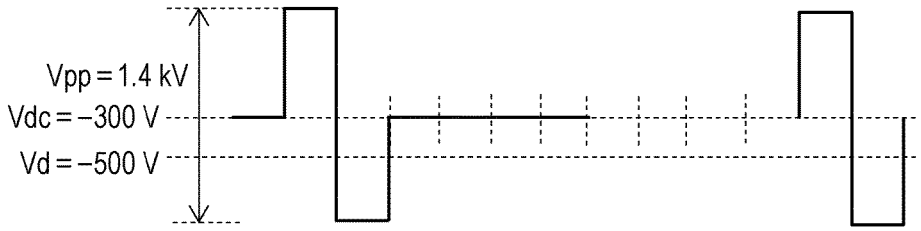
FIGS. 20A and 20B are diagrams illustrating waveforms of developing bias AC voltage according to the sixth embodiment, FIG. 20A illustrating blank pulse bias and FIG. 20B illustrating square bias.
Figure 20B:
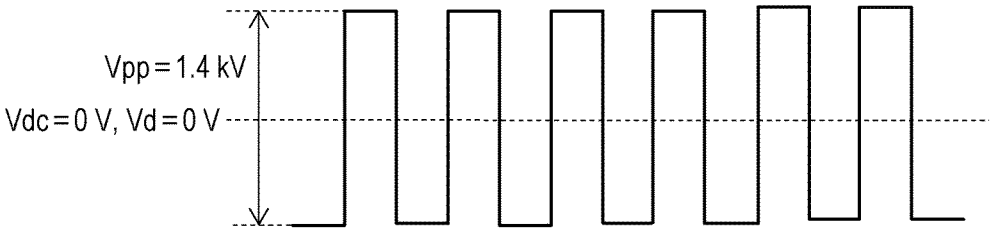

Next, the waveform of the developing bias AC used in the present embodiment will be described. Developing bias, where AC voltage has been superimposed on DC voltage from the developing bias power source 40 is applied to the developing sleeve 42. The waveform of the developing bias AC is changed in the present embodiment, depending on whether performing normal image forming or forming the interposing toner. When performing normal image forming, −300 V DC voltage and vibrating voltage alternating between a high-frequency portion where the frequency is 10.0 kHz and peak-to-peak voltage (Vpp) is 1.4 kV and a blank portion, is used as the developing bias, as illustrated in FIG. 20A. This sort of vibrating voltage will be referred to as "blank pulse bias" hereinafter. On the other hand, when forming the interposing toner, vibrating voltage where 0 V DC voltage and square-wave AC voltage where the frequency is 10.0 kHz and peak-to-peak voltage (Vpp) is 1.4 kV are superimposed, is used as the developing bias, as illustrated in FIG. 20B. This sort of vibrating voltage will be referred to as "square bias" hereinafter.

Figure 21:
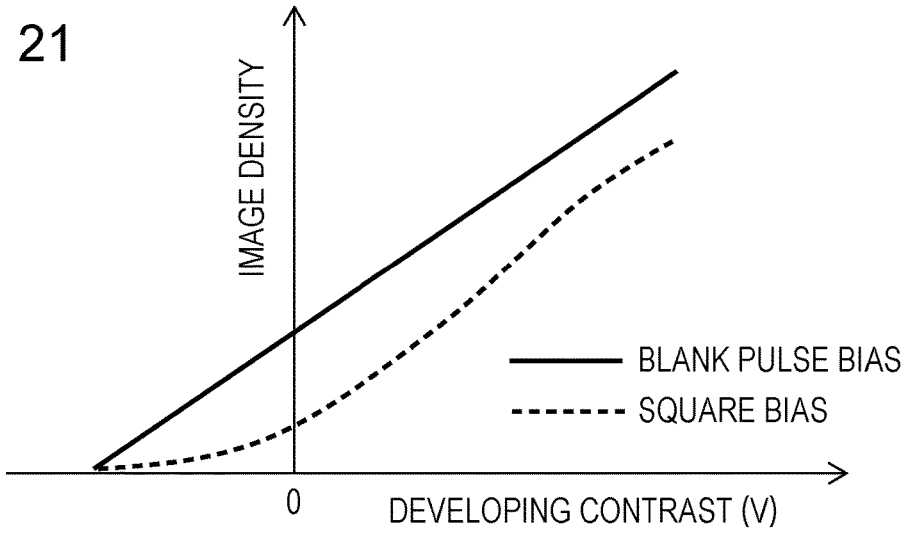
FIG. 21 is a diagram illustrating image density in a case of using each of blank pulse bias and square bias according to the sixth embodiment.

FIG. 21 illustrates developing properties in cases of using each of blank pulse bias and square bias. The horizontal axis represents developing contrast potential, and the vertical axis represents image density. In the case of using blank pulse, having the resting portion in the square waves and extending the developing time of the DC component as illustrated in FIG. 21 makes it easier for toner on the developing sleeve 42 to move toward the photosensitive drum 1*a*. Particularly, stable toner developing can be realized as compared to square bias, even in cases where electric field intensity of the latent image is weak, such as in highlight portions.

On the other hand, if the amount of interposing toner is too much, there are cases where the toner consumption is excessively great, and much toner adheres to the surface of the secondary outer transfer roller 57, as described above. In the case of the present embodiment as well, the density of the interposing toner preferably is around 0.02 to 0.08 when measured by a densitometer manufactured by X-Rite, Inc. However, when blank pulse bias is used, there were found to be cases where the toner density of the interposing toner was too great (around 0.10) in a state where the developing bias DC and charging bias were 0 V (i.e., where developing contrast was approximately 0 V). Accordingly, using square bias when forming the interposing toner t enabled the density of interposing toner to be made appropriate in a state where the developing bias DC and charging bias were 0 V.

Interposing Toner Density Control

Next, density control of the interposing toner according to the present embodiment will be described. In a case where the toner concentration or toner charge amount changes in the developer container 41, the amount of interposing toner may possibly change. The present embodiment has upper and lower limits established for the amount of correction that can be made to the inductance target signal value Itrg, with 2.5 V±0.6 V being the predetermined upper limit value and lower limit value, as described by way of FIG. 19. That is to say, when 1.9 V Itrg 3.1 V holds, the toner change amount in the developer container 41 is maintained generally, constant, so the density of interposing toner is maintained generally constant. On the other hand, in a case where Ptrg2<Psig or Ptrg1>Psig in a state where Itrg=1.9 V or Itrg=3.1 V, Itrg is not corrected, so the toner charge amount in the developer container 41 has changed.

Accordingly, in a case where the inductance target signal value (Itrg) does not move from the upper or lower limiters (1.9 V or 3.1 V), the following control is performed in the present embodiment. That is, the duty ratio of the waveform of developing bias AC (square bias) is changed in accordance with the difference of the newest patch image density as to the target lower limit value or target upper limit value.

This will be described in detail. In a state where the inductance target signal value (Itrg) serving as the first reference value has reached the predetermined upper limit value (3.1 V), the duty ratio is changed in accordance with the relationship between the detection results of patch image density and the target upper limit value (Ptrg2) serving as the second reference value. Specifically, the duty ratio of the waveform of developing bias AC is changed in accordance with Psig−Ptrg2=ΔVpatch.

Also, in a state where the inductance target signal value (Itrg) serving as the first reference value has reached the predetermined lower limit value (1.9 V), the duty ratio is changed in accordance with the relationship between the detection results of patch image density and the target lower limit value (Ptrg1) serving as the second reference value. Specifically, the duty ratio of the waveform of developing bias AC is changed in accordance with Psig−Ptrg1=ΔVpatch.

Figure 22:
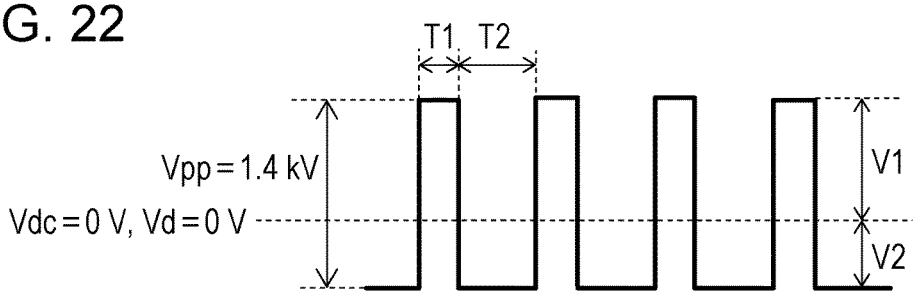
FIG. 22 is a diagram illustrating duty ratio of a square bias waveform according to the sixth embodiment.

The duty ratio of the waveform of the developing bias AC (square bias) here will be described with reference to FIG. 22. The duty ratio of square bias is controlled by controlling the temporal axis (horizontal axis) T1:T2 and the voltage axis (vertical axis) V1:V2 of the waveform, as illustrated in FIG. 22. For example, bias that is 50% duty is set so that temporal axis T1:T2=50:50, and voltage axis V1:V2=50:50. Bias that is 44% duty is set so that temporal axis T1:T2=44:56, and voltage axis V1:V2=56:44.

Figure 23:
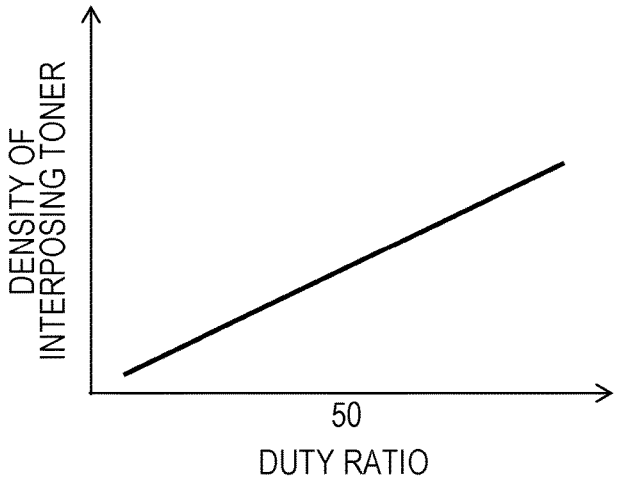
FIG. 23 is a diagram illustrating the relationship between duty ratio of a developing bias AC waveform and the density of interposing toner, according to the sixth embodiment.

FIG. 23 shows the relationship between the duty ratio of the waveform of the developing bias AC (square bias) and interposing toner density. The horizontal axis represents the duty ratio of the square bias, and the vertical axis represents the interposing toner density. ΔVpatch=0 at this time. Changing the duty ratio of the square bias waveform in this way enables the toner developing properties to be changed, and the interposing toner density can be changed. In other words, raising the duty ratio enables the density of the interposing toner to be increased.

Figures 24, 25:
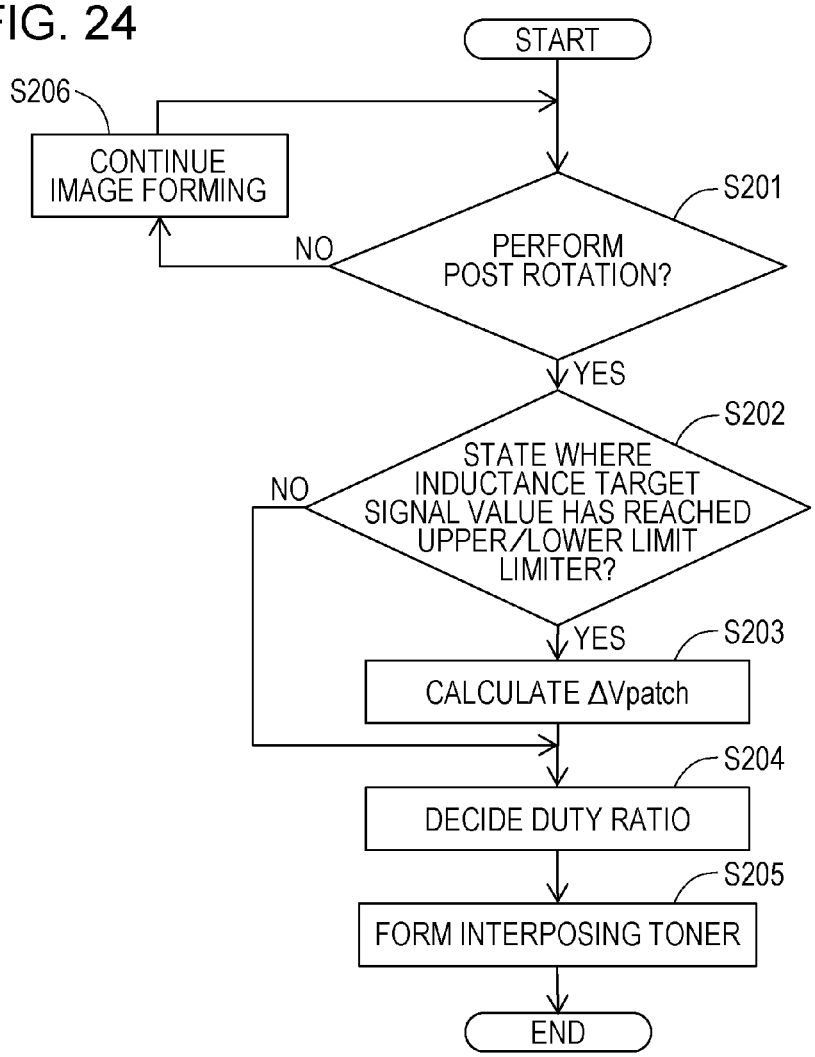
FIG. 24 is a flowchart illustrating a control flow for forming interposing toner, according to the sixth embodiment.
FIG. 25 is a diagram of a table showing duty ratio of the square bias waveform as to ΔVpatch according to a sixth embodiment.

Next, interposing toner density control according to the present embodiment will be described in detail with reference of FIGS. 24 and 25. The present embodiment controls the duty ratio of the waveform of developing bias AC (square bias) in accordance with ΔVpatch, as illustrated in FIG. 24. FIG. 25 is a table of duty ratio of the square bias waveform used when forming the interposing toner, as to ΔVpatch.

First, after starting image forming operations, judgment is made regarding whether or not to execute post rotation when ending image forming (S201). In a case of not executing post rotation operations, image forming continues (S206). In a case of judging to execute post rotation after ending image forming in S201, judgment is made regarding whether or not the inductance target signal value has reached the upper or lower limiters (1.9 V, 3.1 V) (S202). In a case where the inductance target signal value has not reached either of the upper and lower limiters, a 50% duty ratio is selected (S204), and interposing toner forming is performed (S205), following which image forming operations end.

On the other hand, in a case where the inductance target signal value has reached one or the other of the upper and lower limiters, ΔVpatch is calculated as described above (S203). The duty ratio of the waveform of developing bias AC (square bias) when forming the interposing toner is selected from the table in FIG. 25 (S204). The interposing toner is formed at this duty ratio (S205), following which image forming operations end.

By controlling the developing bias AC duty ratio in accordance with ΔVpatch in this way, interposing toner having a stable density can be formed even in a case where the toner charge amount within the developer container 41 changes. As a result, migration of constituents of the intermediate transfer belt 51 such as rubber material, fluorine compounds, and so forth to the photosensitive drum surface can be suppressed regardless of change in the toner charge amount within the developer container 41.

Although the duty ratio of the waveform of the developing bias AC is changed in accordance with ΔVpatch in the present embodiment, this is not restrictive. For example, the frequency or Vpp (amplitude) of the developing bias AC may be changed instead of changing the duty ratio, thereby stabilizing the interposing toner density in accordance with ΔVpatch.

For example, increasing the amplitude raises the interposing toner density. On the other hand, the higher the frequency of the developing bias AC is, the less the amount of interposing toner is. The reason is as follows. A higher frequency means that the number of times of oscillation of the developing bias AC per unit time increases in the developing region where the developing sleeve and photosensitive drum face each other. In regions where the amount of toner to be adhered to the photosensitive drum such as interposing toner is small, the increase in frequency increases the influence of toner pullback pulses, resulting in less toner adhering to the photosensitive drum.

Accordingly, by appropriately changing the amplitude and frequency, interposing toner of an appropriate density can be formed in accordance with the toner concentration within the developer container. The interposing toner density can be changed by changing at least one of duty ratio, amplitude, and frequency, but changing is not restricted to one, and any two of these, or all three, may be changed.

In a case where the inductance target signal value is in a state of having reached the upper or lower limiter, the duty ratio of the developing bias AC is changed in accordance with the ΔVpatch in the present embodiment, but this is not restrictive. For example, an arrangement may be made where the toner charge amount is predicted using only the output value of the magnetic permeability sensor or only the output value of the image density sensor 90, and the waveform of the developing bias AC is controlled to maintain the interposing toner density constant.

Specifically, in a case where the toner density is being controlled high as to a median value (8% in the present embodiment), the duty ratio is lowered to lower the interposing toner density. Conversely, in a case where the toner density is being controlled low as to the median value, the duty ratio is raised to raise the interposing toner density. The configuration of the present embodiment may be applied to the above-described fourth and fifth embodiments.

Seventh Embodiment

A seventh embodiment will be described with reference to FIGS. 26 and 27. In addition to the control of the sixth embodiment, the present embodiment offsets the duty ratio of the waveform of the developing bias AC in accordance with the difference between the output value of the magnetic permeability sensor 45 and the inductance target signal value. Other configurations and operations are the same as in the sixth embodiment, so the same configurations will be denoted by the same reference numerals, and description thereof will be omitted or simplified. Description will be made primarily regarding feature portions of the seventh embodiment.

In a case of continuously performing image forming with a high coverage rate, for example, the toner concentration within the developer container 41 may drop due to toner replenishing not keeping up. If interposing toner is formed in this state, there is a possibility that the interposing toner may be formed at a lower toner density than the original toner density target value. There may also be rare cases where variance in toner replenishing amount results in variance in the actual toner density as to the toner density target value. Accordingly, the developing bias AC waveform when forming the interposing toner is controlled in accordance with Itrg−In=ΔI, which is the difference value between the newest output value In of the magnetic permeability sensor 45 and the inductance target signal value Itrg.

Figure 26:
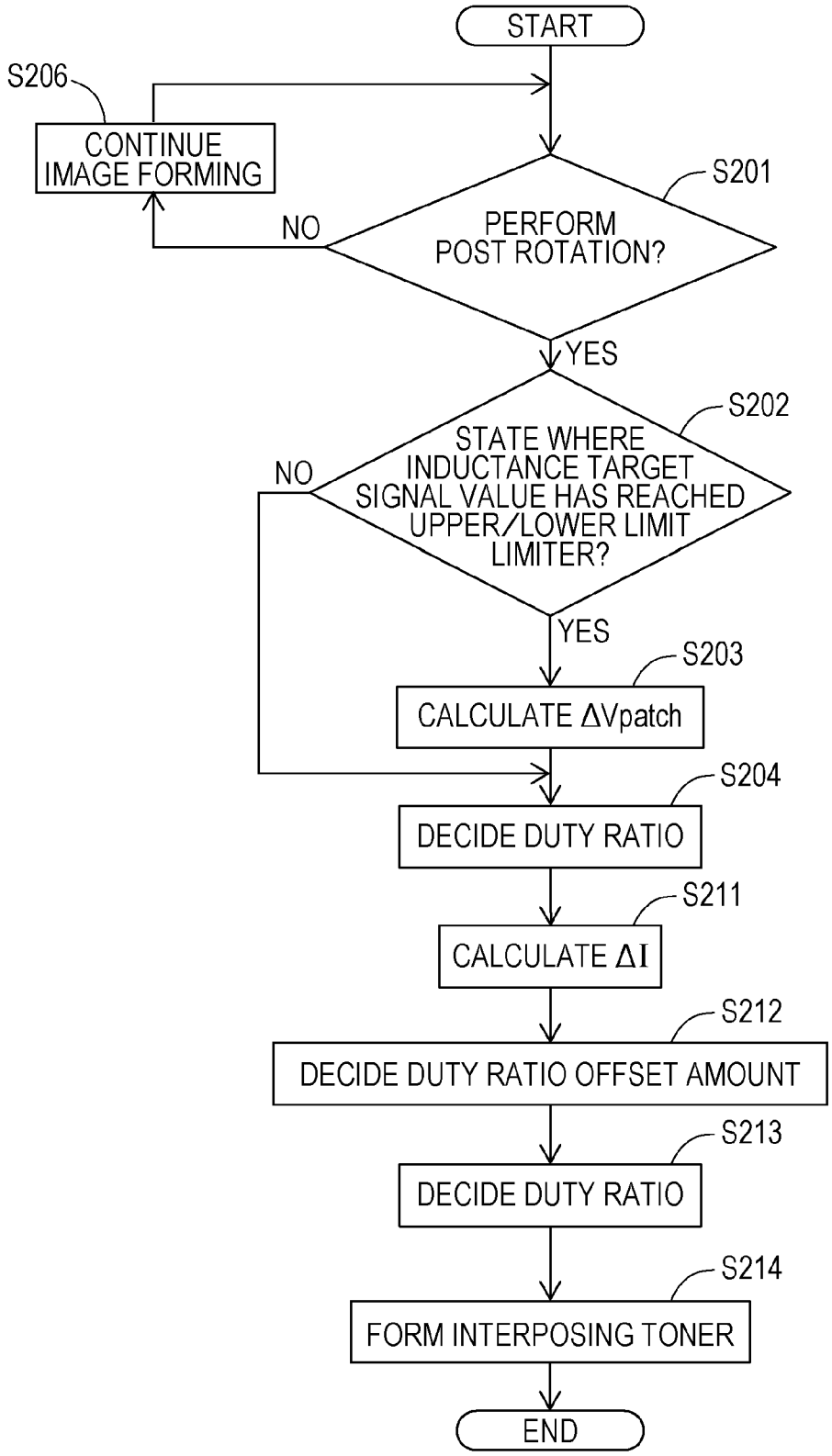
FIG. 26 is a flowchart illustrating a control flow for forming interposing toner according to a seventh embodiment.
Figures 27, 28:
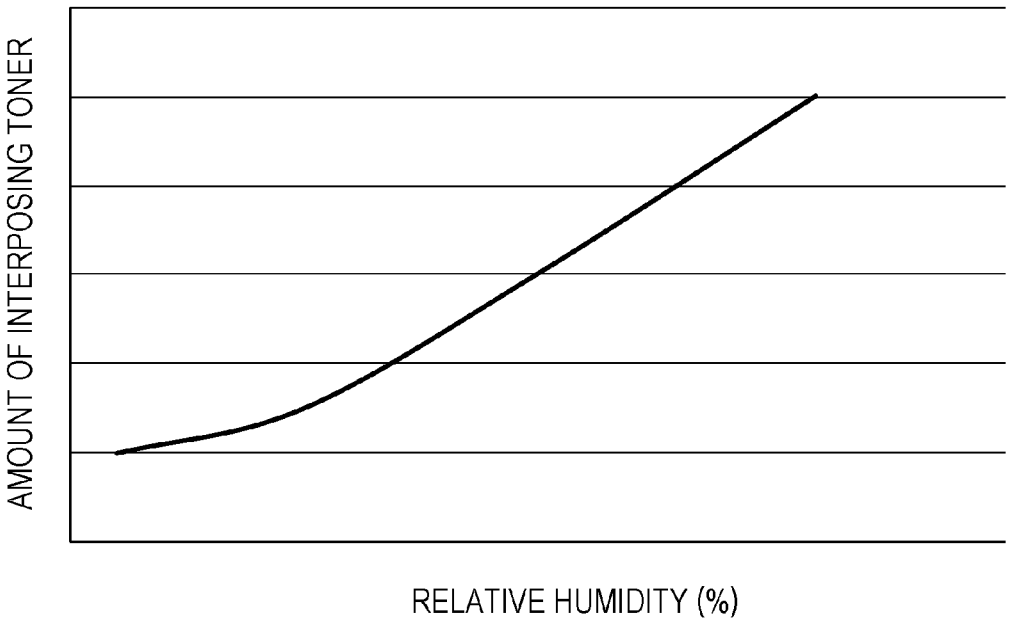
FIG. 27 is a diagram illustrating a correction table for square bias waveform duty ratio as to ΔI according to the seventh embodiment.
FIG. 28 is a diagram illustrating the relationship between relative humidity and interposing toner amount according to an eighth embodiment.

The duty ratio of the waveform of the developing bias AC (square bias) is controlled in accordance with ΔVpatch and ΔI in the present embodiment, as shown in FIG. 26. FIG. 27 shows a table of offset amount for the square bias waveform duty ratio used when forming the interposing toner, as to ΔI. S201 through S204 in FIG. 26 are the same as in FIG. 24 in the sixth embodiment, so description will be omitted.

As illustrated in FIG. 26, upon the duty ratio of the developing bias AC being selected from the table in FIG. 25 in S204, ΔI is calculated from the newest output value from the magnetic permeability sensor 45 (S211). Next, the offset amount of the duty ratio of the developing bias AC is decided from the table in FIG. 27 (S212). Further, the duty ratio of the developing bias AC for forming the interposing toner is finally decided from the offset amount (S213). The interposing toner is formed according to this duty ratio (S214), and thereafter the image forming operations end.

Thus, according to the present embodiment, the duty ratio obtained in accordance with ΔVpatch is offset by ΔI as described above. Accordingly, in a case of continuously performing image forming with a high coverage rate resulting in the toner concentration within the developer container 41 dropping, or variance in toner replenishing amount resulting in variance in the actual toner density as to the toner density target value, the interposing toner density can be stabilized. That is to say, even in cases where variance in the toner centration within the developer container 41 is great, or the toner concentration is unstable, interposing toner can be formed with stable density.

Eighth Embodiment

Figure 29:
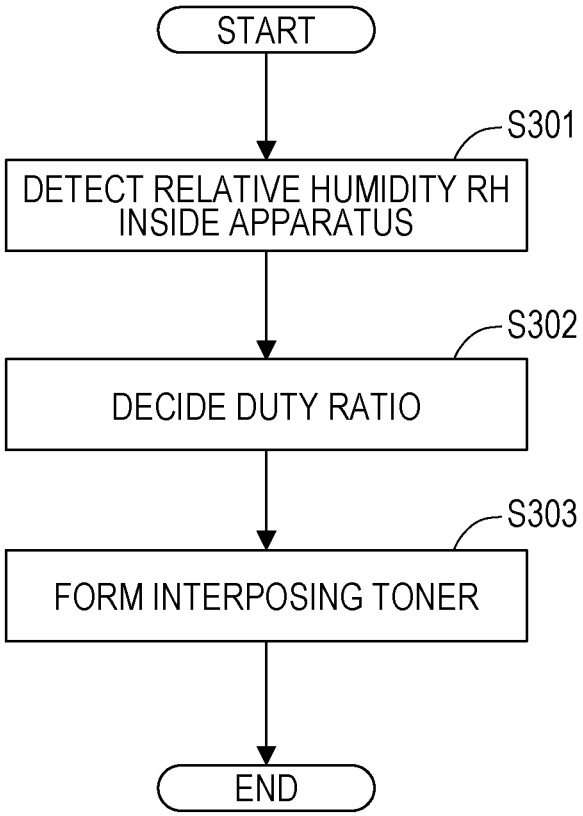
FIG. 29 is a flowchart illustrating a control flow for forming interposing toner according to the eighth embodiment.
Figures 30, 31:
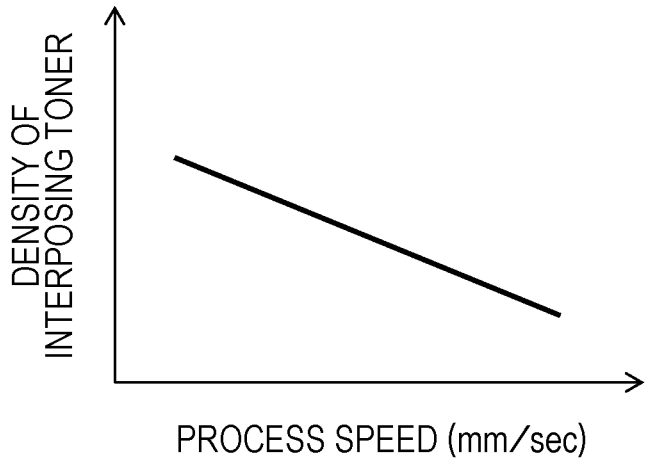
FIG. 30 is a diagram of a table showing duty ratio of the square bias waveform as to relative humidity according to the eighth embodiment.
FIG. 31 is a diagram illustrating the relationship between process speed and interposing toner amount according to a ninth embodiment.

An eighth embodiment will be described by way of FIGS. 28 through 30, with reference to FIGS. 1 through 6. In the above sixth and seventh embodiments, at least one of duty ratio, amplitude, and frequency of the waveform of the developing bias AC is changed based on information relating to toner concentration. Conversely, in the present embodiment, at least one of duty ratio, amplitude, and frequency of the waveform of the developing bias AC is changed in accordance with the environment within the apparatus main unit. Other configurations and operations are the same as in the sixth embodiment, so the same configurations will be denoted by the same reference numerals, and description thereof will be omitted or simplified. Description will be made primarily regarding feature portions of the eighth embodiment. Although description is made regarding the image forming station Sa below, the same holds true for the other image forming stations as well.

In a case where the environment changes within the apparatus main unit, there is a possibility that the amount of toner for the interposing toner will change. For example, in a case where the relative humidity is high (toner charge amount is low), the amount of toner for the interposing toner increases, and conversely, in a case where the relative humidity is low (the toner charge amount is high), the amount of toner for the interposing toner decreases. Accordingly, at least one of duty ratio, amplitude, and frequency of the waveform of the developing bias AC is changed in accordance with the relative humidity within the apparatus main unit in the present embodiment. This will be described in detail below.

The interposing toner is interposed between the photosensitive drums 1*a* through 1*d* and the intermediate transfer belt 51 when ending image forming, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

Next, environmental change of interposing toner will be described. FIG. 28 is a graph illustrating the relationship between the relative humidity and the amount of interposing toner. The horizontal axis represents the relative humidity RH within the apparatus main unit 101 (FIG. 1) of the image forming apparatus 100, and the vertical axis represents the amount of interposing toner on the photosensitive drum when developed at a developing bias AC according to a constant condition. It can be seen from FIG. 28 that the amount of interposing toner increases as the relative humidity RH rises, since the amount of charge of the toner decreases. In an environment where the temperature was 25° and the relative humidity RH was 50%, the amount of interposing toner in terms of density was around 0.04 when measured by a densitometer manufactured by X-Rite, Inc. in the present embodiment. On the other hand, at 30° and 80%, the density was around 0.10. Hereinafter, all values for density of interposing toner have been measured by an X-Rite, Inc. densitometer.

Accordingly, a thermo-hygro sensor 130 serving as an environment detecting unit is disposed near the image forming station Sd (preferably near the developing device 4*d*) as an environment detecting unit, to detect environment information in the apparatus main unit 101 (in the apparatus) by detecting temperature T and relative humidity RH within the apparatus. The thermo-hygro sensor 130 transmits the detection results thereof to the control circuit 50 as appropriate, so as to be stored in the ROM 122 (see FIG. 5), as illustrated in FIG. 1. Information stored in the ROM 122 is transmitted to the CPU 120 as appropriate, and thus can be used to control the image forming apparatus.

In order to control the amount of interposing toner in the present embodiment, the duty ratio of the waveform of the developing bias AC is changed in accordance with the relative humidity RH that has been detected by the thermo-hygro sensor 130. The interposing toner is formed in the present embodiment using the square bias illustrated in FIG.

20B in the sixth embodiment. The duty ratio of the square bias waveform is the same as described in FIGS. 22 and 23. Note that FIG. 23 illustrates the relationship between the duty ratio of square bias waveform and the density of interposing toner under an environment of 25° C. in temperature and 50% in RH.

Next, density control for interposing toner according to the present embodiment will be described in detail with reference to FIGS. 29 and 30. The duty ratio of the waveform of the developing bias AC (square bias) is controlled in accordance with relative humidity RH in the present embodiment, as illustrated in FIG. 29. FIG. 30 is a table showing the duty ratio of square bias waveform used when forming the interposing toner, as to the relative humidity RH.

After starting image forming operations, the thermos-hygro sensor 130 is used to detect the relative humidity RH within the apparatus (S301) in a case of executing post rotation operations when ending image forming. The duty ratio of the waveform of the developing bias AC for when forming the interposing toner is selected from the table in FIG. 30 (S302). The interposing toner forming is performed (S303), after which the image forming operations end.

By controlling the developing bias AC duty ratio in accordance with the relative humidity RH in this way, interposing toner having a stable density can be formed even in a case where the toner charge amount within the developer container 41 changes. As a result, migration of constituents of the intermediate transfer belt 51 such as rubber material, fluorine compounds, and so forth to the photosensitive drum surface can be suppressed regardless of change in the toner charge amount within the developer container 41.

Instead of changing the duty ratio, the frequency or Vpp (amplitude) of the developing bias AC, for example, may be changed in the case of the present embodiment as well. Changing is not restricted to one of duty ratio, amplitude, and frequency, and any two of these, or all three, may be changed. The configuration of the present embodiment may be applied to the above-described fourth and fifth embodiments as well.

Ninth Embodiment

Figure 32:
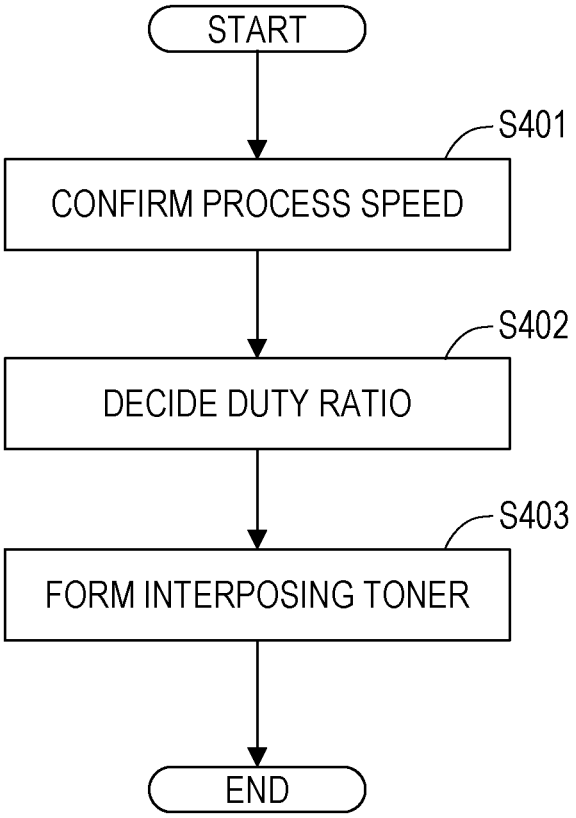
FIG. 32 is a flowchart illustrating a control flow for forming interposing toner according to the ninth embodiment.

A ninth embodiment will be described by way of FIGS. 31 through 33, with reference to FIGS. 1 through 6. In the above sixth and seventh embodiments, at least one of duty ratio, amplitude, and frequency of the waveform of the developing bias AC is changed based on information relating to toner concentration. Conversely, in the present embodiment, at least one of duty ratio, amplitude, and frequency of the waveform of the developing bias AC is changed in accordance with the process speed. Other configurations and operations are the same as in the sixth embodiment, so the same configurations will be denoted by the same reference numerals, and description thereof will be omitted or simplified. Description will be made primarily regarding feature portions of the ninth embodiment. Although description is made regarding the image forming station Sa below, the same holds true for the other image forming stations as well.

In a case where the process speed of the apparatus (speed of photosensitive drums and intermediate transfer belt) changes, there is a possibility that the amount of toner for the interposing toner will change. For example, in a case where the process speed changes, the way in which developing bias is applied per increment of time changes, so the amount of interposing toner also changes. Accordingly, at least one of duty ratio, amplitude, and frequency of the waveform of the developing bias AC is changed in accordance with the process speed in the present embodiment. This will be described in detail below.

The interposing toner is interposed between the photosensitive drums 1*a* through 1*d* and the intermediate transfer belt 51 when ending image forming, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

The image forming apparatus according to the present embodiment can change the process speed to multiple levels form the perspective of maintaining fixability of the fixing device 7. That is to say, the speed of the photosensitive drum 1*a* and intermediate transfer belt 51 can be driven at multiple speeds (process speeds), and the process speed is changed according to the grammage of the recording medium on which image forming is to be performed. Specifically, the process speed is 250 mm/sec for plain paper of which the grammage is below 128 g/m$^2$, and is halved to 125 mm/sec for plain paper or coated paper of which the grammage is 128 g/m$^2$ or heavier.

The relationship between this process speed and density (amount) of interposing toner will be described with reference to FIG. 31. The horizontal axis in FIG. 31 is process speed, and the vertical axis is density of interposing toner on the photosensitive drum. It can be seen from FIG. 31 that increasing the process speed reduces the interposing toner density. The reason is that when using a square bias waveform as the developing bias AC, the number of times of oscillation of the developing bias AC per unit time increases in the developing region when the process speed is slow, increasing the influence of toner pullback pulses.

In order to control the density of interposing toner in the present embodiment, the duty ratio of the waveform of the developing bias AC is changed in accordance with the process speed. The interposing toner is formed in the present embodiment using the square bias illustrated in FIG. 20B in the sixth embodiment. The duty ratio of the square bias waveform is the same as described in FIGS. 22 and 23.

Next, density control for interposing toner according to the present embodiment will be described in detail with reference to FIGS. 32 and 33. The duty ratio of the waveform of the developing bias AC (square bias) is controlled in accordance with process speed in the present embodiment, as illustrated in FIG. 32. FIG. 33 is a table showing the duty ratio of square bias waveform used when forming the interposing toner, as to the process speed.

After starting image forming operations, the process speed of the apparatus is confirmed (S401) in a case of executing post rotation operations when ending image forming. The duty ratio of the waveform of the developing bias AC for when forming the interposing toner is selected from the table in FIG. 33 (S402). The interposing toner forming is performed (S403), after which the image forming operations end.

By controlling the developing bias AC duty ratio in accordance with the process speed in this way, interposing toner having a stable density can be formed regardless of the type of recording medium P used for image forming. As a result, migration of constituents of the intermediate transfer belt 51 such as rubber material, fluorine compounds, and so forth to the photosensitive drum surface can be suppressed regardless of change in the toner charge amount within the developer container 41.

Instead of changing the duty ratio, the frequency or Vpp (amplitude) of the developing bias AC, for example, may be changed in the case of the present embodiment as well. Changing is not restricted to one of duty ratio, amplitude, and frequency, and any two of these, or all three, may be changed. The configuration of the present embodiment may be applied to the above-described fourth and fifth embodiments as well.

Tenth Embodiment

Figure 35:
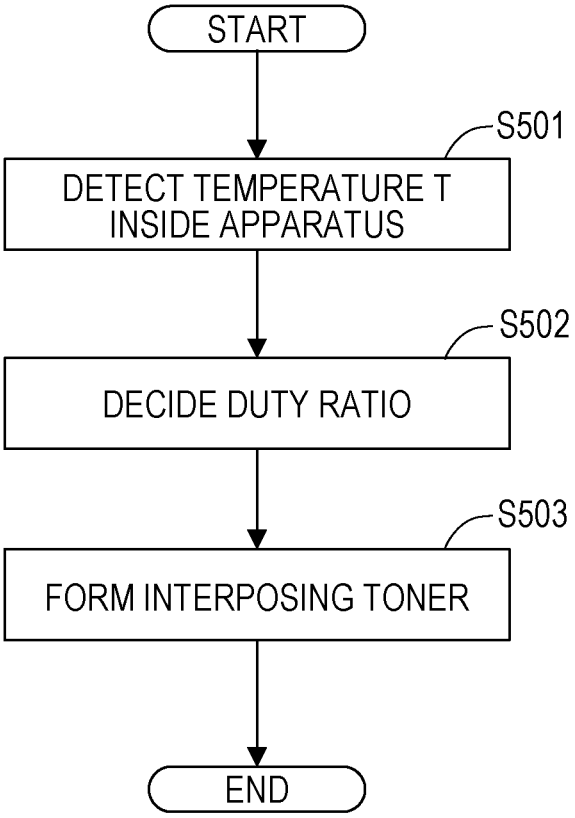
FIG. 35 is a flowchart illustrating a control flow for forming interposing toner according to the tenth embodiment.

A tenth embodiment will be described by way of FIGS. 34 through 36, with reference to FIGS. 1 through 6. In the above eighth seventh embodiment, at least one of duty ratio, amplitude, and frequency of the waveform of the developing bias AC is changed based on relative humidity in the apparatus main unit. Conversely, in the present embodiment, at least one of duty ratio, amplitude, and frequency of the waveform of the developing bias AC is changed in accordance with the temperature within the apparatus main unit. Other configurations and operations are the same as in the eighth embodiment, so the same configurations will be denoted by the same reference numerals, and description thereof will be omitted or simplified. Description will be made primarily regarding feature portions of the tenth embodiment. Although description is made regarding the image forming station Sa below, the same holds true for the other image forming stations as well.

The present inventors have found through study that the degree of migration of constituents of the intermediate transfer belt such as fluorine compounds and so forth to the photosensitive drum surface changes according to the environment within the apparatus main unit. In a case where the temperature is low, the amount of migration of fluorine compounds and so forth from the intermediate transfer belt to the photosensitive drum is small, but the amount of migration increases if the temperature is high. That is to say, in a case where the environment around the image forming apparatus becomes hot, or inside of the apparatus main unit becomes hot due to the image forming apparatus being used for a prolonged time, migration of fluorine compounds from the intermediate transfer belt to the photosensitive drum surface may not be able to be sufficiently suppressed using the same amount of interposing toner as with when the temperature is normal. Accordingly, at least one of duty ratio, amplitude, and frequency of the waveform of the developing bias AC is changed in accordance with the temperature within the apparatus main unit in the present embodiment. This will be described in detail below.

The interposing toner is interposed between the photosensitive drums 1*a* through 1*d* and the intermediate transfer belt 51 when ending image forming, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

Next, how the streak level due to the constituents of the intermediate transfer belt change according to change of the temperature T in the apparatus main unit 101 (in the apparatus) as to the density (amount) of interposing toner, will be described with reference to FIG. 34. In the table, "good" means that there are no streaks, "fair" means that there are slight streaks (recovering after several dozen sheets), and "poor" means that streaks are conspicuous (not recovering even after 100 sheets). The values for density of interposing toner have been measured by an X-Rite, Inc. densitometer.

As shown in FIG. 34, in a case where the interposing toner density is 0.04, migration of intermediate transfer belt constituents was not sufficiently suppress of the temperature within the apparatus reached 35° C., and streaks occurred. On the other hand, in a case where the temperature T within the apparatus was 15° C., it was confirmed that streaks did not occur even for interposing toner density of 0.01 where slight streaks occur at normal temperature (25° C.)

The duty ratio of the waveform of the developing bias AC is changed in accordance with the temperature T within the apparatus main unit 101 in the present embodiment. The temperature T within the apparatus main unit 101 is detected by the thermo-hygro sensor 130 (FIG. 1). The duty ratio of the waveform of the developing bias AC is changed so that higher the temperature T detected by the thermo-hygro sensor 130 is, the greater the amount of interposing toner is used. Although the amount of interposing toner is controlled to be very little when the temperature is low in the present embodiment, but an arrangement may be made where this control is not performed below a certain temperature. For example, an arrangement may be made where no interposing toner is formed at 15° C. or lower.

Next, density control for interposing toner according to the present embodiment will be described in detail with reference to FIGS. 35 and 36. The duty ratio of the waveform of the developing bias AC (square bias) is controlled in accordance with temperature T in the apparatus in the present embodiment, as illustrated in FIG. 35. FIG. 36 is a table showing the duty ratio of square bias waveform used when forming the interposing toner, as to the temperature T.

After starting image forming operations, the thermo-hygro sensor 130 is used to detect the temperature T within the apparatus (S501) in a case of executing post rotation operations when ending image forming. The duty ratio of the waveform of the developing bias AC for when forming the interposing toner is selected from the table in FIG. 36 (S502). The interposing toner forming is performed (S503), after which the image forming operations end.

By controlling the developing bias AC duty ratio in accordance with the temperature T in this way, migration of constituents of the intermediate transfer belt to the photosensitive drum can be prevented in an environment where the amount of migration is large, by interposing a sufficient amount of toner. At the same time, needless consumption of toner can be prevented in environments where the amount of migration is small.

Instead of changing the duty ratio, the frequency or Vpp (amplitude) of the developing bias AC, for example, may be changed in the case of the present embodiment as well. Changing is not restricted to one of duty ratio, amplitude, and frequency, and any two of these, or all three, may be changed. The configuration of the present embodiment may be applied to the above-described fourth and fifth embodiments as well.

Eleventh Embodiment

An eleventh embodiment will be described by way of FIGS. 37 through 40, with reference to FIGS. 1 through 6. In the above eighth embodiment, at least one of duty ratio, amplitude, and frequency of the waveform of the developing bias AC is changed based on relative humidity in the apparatus main unit. Conversely, in the present embodiment, at least one of duty ratio, amplitude, and frequency of the waveform of the developing bias AC is changed in accordance with the moisture content in the apparatus main unit. Other configurations and operations are the same as in the eighth embodiment, so the same configurations will be denoted by the same reference numerals, and description thereof will be omitted or simplified. Description will be made primarily regarding feature portions of the eleventh embodiment. Although description is made regarding the image forming station Sa below, the same holds true for the other image forming stations as well.

Generally, a photosensitive drum used in an electrophotography image forming apparatus generates discharge products around itself when being charged by the charging roller. In an environment where the moisture content Hum is high, the discharge products discharged by the charging roller in the surrounding atmosphere react with the moisture thereat, adhere to the surface of the photosensitive drum, resulting in faulty charging and faulty exposure, making image density particularly hard to be realized in low-density regions. Accordingly, the amount of interposing toner may markedly decrease in an environment where the moisture content Hum is high, and migration of constituents of the intermediate transfer belt to the photosensitive drum may not be sufficiently prevented. Accordingly, at least one of duty ratio, amplitude, and frequency of the waveform of the developing bias AC is changed in accordance with the moisture content in the apparatus main unit in the present embodiment. This will be described in detail below.

The interposing toner is interposed between the photosensitive drums 1*a* through 1*d* and the intermediate transfer belt 51 when ending image forming, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

FIG. 37 is a graph illustrating the relationship between moisture content and interposing toner density. The vertical axis represents interposing toner density, and the horizontal axis represents moisture content Hum. The solid line represents the results of Vpp=1000 V for the square bias waveform, and the dashed line represents the results of Vpp=800 V.

FIG. 38 illustrates the relationship between the Vpp (amplitude) of developing bias AC and the interposing toner density. In the case of the square bias waveform, the smaller the Vpp is, the greater the interposing toner density is, as illustrated in FIG. 38. This is because the contribution of toner drawback pulse component in the square bias waveform falls in low-density regions as the Vpp decreases, and consequently the amount of developed toner increases.

Accordingly, in the present embodiment, the amount of interposing toner is maintained within a predetermined range by controlling the amplitude (Vpp) of the waveform of the developing bias AC in accordance with the moisture content Hum within the apparatus main unit 101 (within the apparatus). The moisture content Hum can be calculated by the values of temperature and humidity calculated by the thermo-hygro sensor 130 (FIG. 1), and information of saturated moisture content (moisture vapor) at each temperature. The interposing toner is formed in the present embodiment using the square bias illustrated in FIG. 20B in the sixth embodiment.

Figure 39:
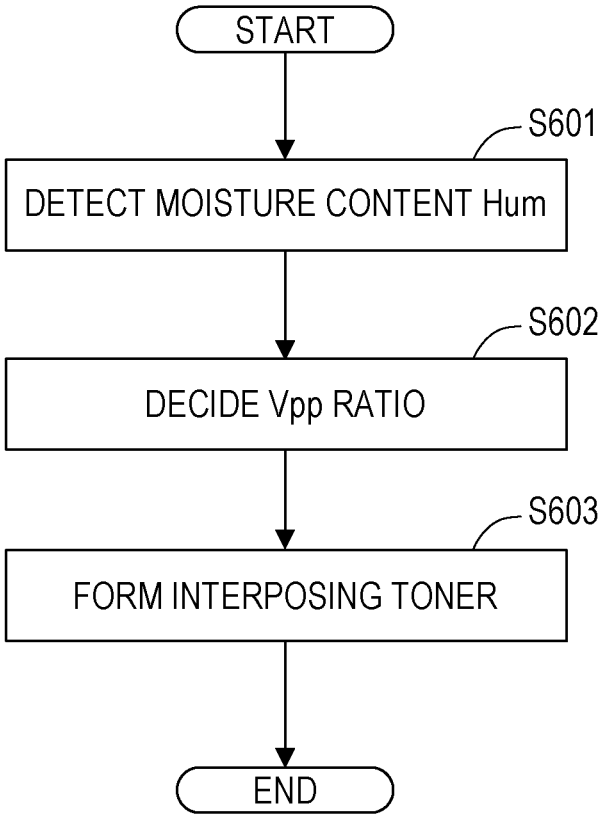
FIG. 39 is a flowchart illustrating a control flow for forming interposing toner according to the eleventh embodiment.
Figures 40, 41:
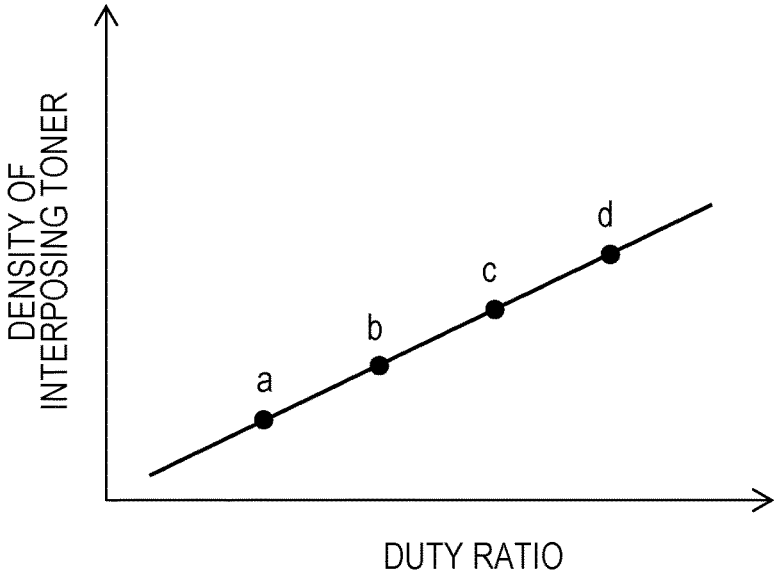
FIG. 40 is a diagram of a table showing Vpp of the square bias waveform as to moisture content according to the eleventh embodiment.
FIG. 41 is a diagram illustrating the relationship between duty ratio of a developing bias AC waveform and the density of interposing toner, according to a twelfth embodiment.

Next, density control for interposing toner according to the present embodiment will be described in detail with reference to FIGS. 39 and 40. The Vpp of the developing bias AC (square bias) is controlled in accordance with moisture content Hum in the present embodiment, as illustrated in FIG. 39. FIG. 40 is a table showing the Vpp of square bias waveform used when forming the interposing toner, as to the moisture content Hum.

After starting image forming operations, the thermo-hygro sensor 130 is used to detect the moisture content Hum within the apparatus (S601) in a case of executing post rotation operations when ending image forming. The Vpp for the developing bias AC for when forming the interposing toner is selected from the table in FIG. 40 (S602). The interposing toner forming is performed (S603), after which the image forming operations end.

By controlling the Vpp for the developing bias AC in accordance with the moisture content Hum in this way, sufficient amount of interposing toner can be interposed at the primary transfer portion even in a case where reactants discharge products and water adhere to the surface of the photosensitive drum 1*a* in a high-moisture environment.

Instead of changing the Vpp (amplitude), the frequency or duty ratio of the developing bias AC, for example, may be changed in the case of the present embodiment as well. Changing is not restricted to one of duty ratio, amplitude, and frequency, and any two of these, or all three, may be changed. As for the environment within the apparatus main unit, at least one of temperature, relative temperature, and moisture content may be detected, and the interposing toner density be changed in accordance with the detection results. The configuration of the present embodiment may be applied to the above-described fourth and fifth embodiments as well.

Twelfth Embodiment

A twelfth embodiment will be described by way of FIGS. 41 through 43, with reference to FIGS. 1 through 6. In the above sixth through eleventh embodiments, at least one of duty ratio, amplitude, and frequency of the waveform of the developing bias AC is changed based on information relating to toner density or the environment within the apparatus main unit. Conversely, in the present embodiment, the interposing toner density is adjusted in accordance with the number of times of use of the intermediate transfer belt (usage history). Other configurations and operations are the same as in the sixth embodiment, so the same configurations will be denoted by the same reference numerals, and description thereof will be omitted or simplified. Description will be made primarily regarding feature portions of the twelfth embodiment. Although description is made regarding the image forming station Sa below, the same holds true for the other image forming stations as well.

As the number of times of usage of the intermediate transfer belt increases, migration of constituents of the intermediate transfer belt such as fluorine compounds and so forth to the photosensitive drum surface decreases. Accordingly, when the number of times of usage of the intermediate transfer belt is great, less interposing toner needs to be used. Accordingly, if the interposing toner is formed having the same amount as when the intermediate transfer belt is in a new state, toner will be consumed unnecessarily. On the other hand, in a case where the amount of interposing toner is decided in accordance with a case where the number of times of usage of the intermediate transfer belt is great and the interposing toner is formed for an intermediate transfer belt in a new state, formation of streaks due to migration of constituents of the intermediate transfer belt such as fluorine compounds and so forth to the photosensitive drum surface cannot be sufficiently suppressed. Accordingly, the interposing toner density is changed in accordance with the number of times of use (usage history) of the intermediate transfer belt in the present embodiment. This will be described in detail below.

The interposing toner is interposed between the photosensitive drums 1*a* through 1*d* and the intermediate transfer belt 51 when ending image forming, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

In the present embodiment, the density of the interposing toner is adjusted in accordance with the number of times of use of the intermediate transfer belt 51. This adjustment is performed by changing at least one of the duty ratio, amplitude, and frequency of the waveform of the developing bias AC. Particularly in the present embodiment, the duty ratio of the waveform of the developing bias AC is changed. FIG. 41 shows the relationship between the duty ratio of the waveform of the developing bias AC (square bias) and interposing toner density. The horizontal axis represents the duty ratio of the square bias waveform, and the vertical axis represents the interposing toner density. $\Delta Vpatch=0$ at this time. Changing the duty ratio of the square bias waveform in this way enables the toner developing properties to be changed, and the interposing toner density can be changed. In other words, raising the duty ratio enables the density of the interposing toner to be increased in the order of a, b, c, and d.

Next, interposing toner density control according to the present embodiment will be described with reference to FIGS. 42A through 43. The image forming apparatus according to the present embodiment includes the control circuit 50, and the control circuit 50 includes the CPU 120, RAM 121, and ROM 122 (FIGS. 1 and 5). The RAM 121 has a usage history counter that comprehends the usage history of the intermediate transfer belt 51. In the present embodiment, the usage history counter counts the amount of use of the intermediate transfer belt 51 after having been installed in the image forming apparatus. The CPU 120 then decides the amount of toner to be used for the interposing toner when ending image forming, based on the value of the usage history counter stored in the RAM 121 (usage history count n), and setting values for interposing toner corresponding to usage history.

FIG. 42A illustrates the results of forming interposing toner at the densities a, b, and c in FIG. 41, and judging how the level of streaks due to constituents of the intermediate transfer belt change with regard to the usage history count n of the intermediate transfer belt in each. The 100 k, 200 k, 300 k, and 500 k in FIG. 42A indicate the amount of use in cases of recording 100,000, 200,000, 300,000, and 500,000 sheets of A4 size recording medium, respectively. In the table, "good" means that there are no streaks, "fair" means that there are slight streaks, and "poor" means that streaks are conspicuous. It can be seen from FIG. 42A that the longer the intermediate transfer belt has been used, the less interposing toner density (amount) is needed to suppress streaks.

Accordingly, the duty ratio of the waveform of the developing bias AC (square bias) is controlled in accordance to the number of times of use of the intermediate transfer belt 51 (usage history count n), thereby adjusting the interposing toner density. FIG. 42B shows an interposing toner density control table. The 100 k, 200 k, and 300 k in FIG. 42B mean the same as in FIG. 42A. The a and c in FIG. 42B correspond to the densities in FIG. 41. This table is arranged to reduce the interposing toner amount as the usage history count n increases.

Figure 43:
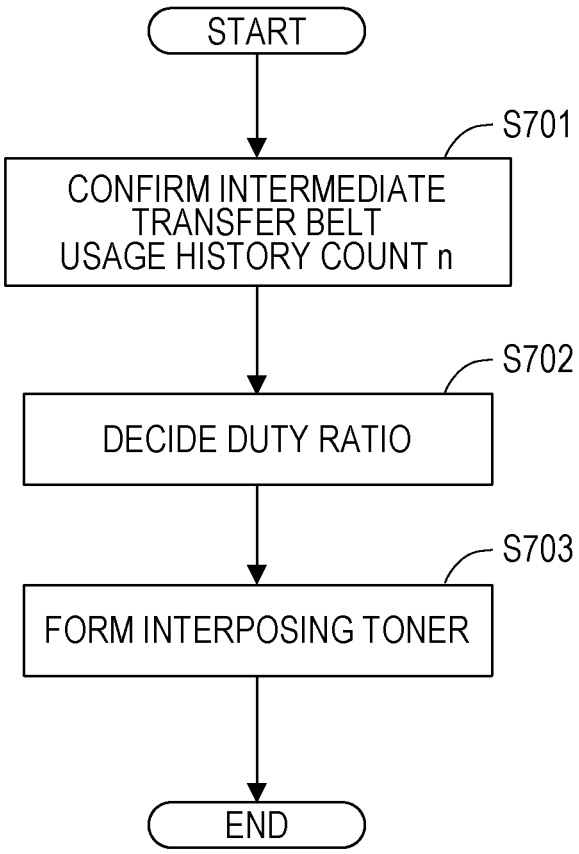
FIG. 43 is a flowchart illustrating a control flow for forming interposing toner according to the twelfth embodiment.

After starting image forming operations, the value of the usage history count n of the intermediate transfer belt 51 is confirmed (S701) in a case of executing post rotation operations when ending image forming, as illustrated in FIG. 43. The interposing toner density is decided from the table in FIG. 42B, and the duty ratio of the waveform of the developing bias AC corresponding to the decided density is selected (S702). The interposing toner forming is performed (S703), after which the image forming operations end.

By adjusting the interposing toner density in accordance with the usage history count n of the intermediate transfer belt 51, toner consumption amount can be suppressed and occurrence of streaks can be suppressed.

Instead of changing the duty ratio, the frequency or Vpp (amplitude) of the developing bias AC, for example, may be changed in the case of the present embodiment as well. Changing is not restricted to one of duty ratio, amplitude, and frequency, and any two of these, or all three, may be changed. The configuration of the present embodiment may be applied to the above-described fourth and fifth embodiments as well.

Thirteenth Embodiment

A thirteenth embodiment will be described by way of FIGS. 44 through 46. In the present embodiment, in addition to the control of the twelfth embodiment, no interposing toner is formed in a case where the number of times of use of the intermediate transfer belt is a predetermined number or more. Other configurations and operations are the same as in the twelfth embodiment, so the same configurations will be denoted by the same reference numerals, and description thereof will be omitted or simplified. Description will be made primarily regarding feature portions of the thirteenth embodiment.

FIG. 44 illustrates the results of forming interposing toner at the densities a, b, and c in FIG. 41, and also not forming any interposing toner t, and judging how the level of streaks due to constituents of the intermediate transfer belt change with regard to the usage history count n of the intermediate transfer belt in each. The 100 k, 200 k, 300 k, and 500 k in FIG. 44 mean the same as in FIG. 42A. It can be seen from FIG. 44 that when the usage history count n reaches 500,000 sheets or more, no streaks occur even if there is no interposing toner.

FIG. 45 shows an interposing toner density control table corresponding to the usage history count n of the intermediate transfer belt 51. The 100 k, 200 k, 300 k, and 500 k in FIG. 45 mean the same as in FIG. 42A. The a and c in FIG. 45 correspond to the densities in FIG. 41, and "none" indicates a case where no interposing toner is formed.

Figure 46:
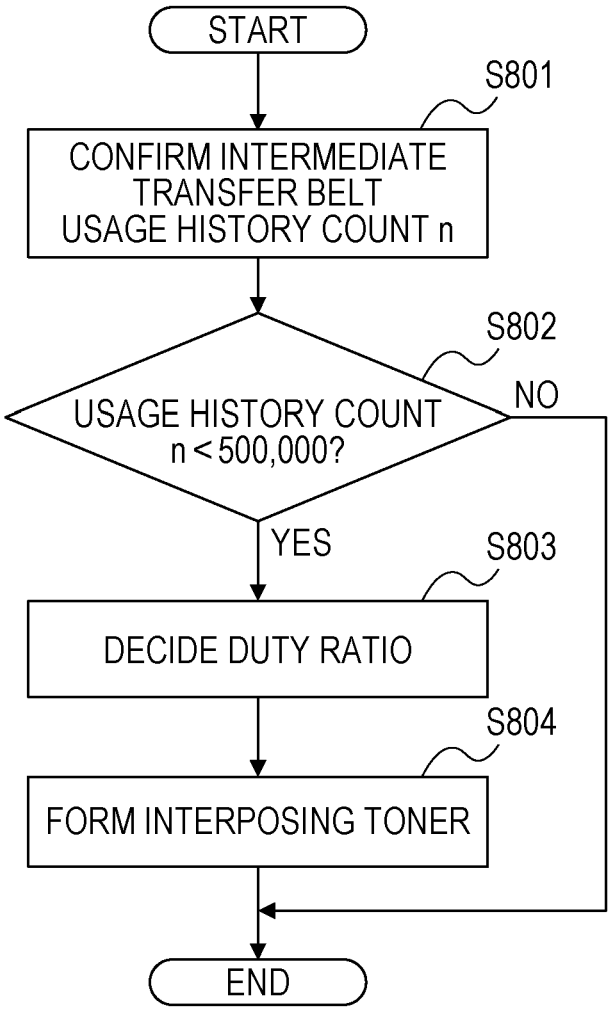
FIG. 46 is a flowchart illustrating a control flow for forming interposing toner according to the thirteenth embodiment.

As illustrated in FIG. 46, after starting image forming operations, the value of the usage history count n of the intermediate transfer belt 51 is confirmed (S801) in a case of executing post rotation operations when ending image forming. Judgment is made regarding whether the usage history count n is the predetermined number of times or not (S802). This predetermined number is 500,000 in the present embodiment, so if the usage history count n is less than 500,000, formation of the interposing toner starts. The interposing toner density is decided from the table in FIG. 45, and the duty ratio of the waveform of the developing bias AC corresponding to the decided density is selected (S803). The interposing toner forming is performed (S804), after which the image forming operations end. On the other hand, in a case where the usage history count n in S802 is 500,000 or more, the interposing toner is not formed, and the image forming operations end.

As described above, in a case where the number of times of use of the intermediate transfer belt 51 is great, and the amount of ion-conductive component and polymeric rubber component at the surface of the intermediate transfer belt 51 that will migrate to the photosensitive drum is sufficiently small, no interposing toner formation is performed. This can further reduce toner consumption.

Fourteenth Embodiment

A fourteenth embodiment will be described by way of FIGS. 47 and 48, with reference to FIGS. 1, 6, and 14. In the above sixth embodiment, at least one of duty ratio, amplitude, and frequency of the waveform of the developing bias AC is changed based on information relating to toner density, so as to adjust the density of the interposing toner. Conversely, in the present embodiment, cleaning conditions for performing electrostatic cleaning of the secondary outer transfer roller 57 are changed based on information relating to toner density. Other configurations and operations are the same as in the sixth embodiment, so the same configurations will be denoted by the same reference numerals, and description thereof will be omitted or simplified. Description will be made primarily regarding feature portions of the fourteenth embodiment. Although description is made regarding the image forming station Sa below, the same holds true for the other image forming stations as well.

In a case where interposing toner is interposed between the photosensitive drum and intermediate transfer belt when ending image forming, the interposing toner adheres to the secondary outer transfer roller 57 at the time of performing image forming the next time. Accordingly, electrostatic cleaning of the secondary outer transfer roller 57 is performed before starting image forming, as described in the fifth embodiment.

Now, in a case where the toner concentration or toner charge amount changes within the developer container 41, there is a possibility that the amount of toner for the interposing toner will change. That is to say, in a case where the toner concentration within the developer container 41 is high (the toner charge amount is low), the amount of toner for the interposing toner increases, and conversely, in a case where the toner concentration is low (the toner charge amount is high), the amount of toner for the interposing toner decreases. The time involved for electrostatic cleaning for removing the interposing toner from the secondary outer transfer roller 57 changes accordingly. Thus, if the cleaning time is set in accordance with cases where the amount of interposing toner is large, excessive cleaning time is taken in cases when the amount of interposing toner is small, taking more time to start image forming than necessary. If the cleaning time is set in accordance with cases where the amount of interposing toner is small, insufficient cleaning may result in backside contamination of the recording medium if the amount of interposing toner is large. Accordingly, the cleaning conditions for electrostatic cleaning of the secondary outer transfer roller 57 are changed in accordance with information relating to toner density in the present embodiment.

The interposing toner is interposed between the photosensitive drums 1*a* through 1*d* and the intermediate transfer belt 51 when ending image forming, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

Thus, when ending image forming from the previous time, there is interposing toner interposed at the primary transfer portion N1*a*. Accordingly, the interposing toner reaches the secondary transfer portion N2 due to driving of the photosensitive drum 1*a* and intermediate transfer belt 51, and part of the interposing toner adheres to the secondary outer transfer roller 57. Accordingly, after the interposing toner passes through the secondary transfer portion N2, electrostatic cleaning of the secondary outer transfer roller 57 is performed in the present embodiment as well, as described in FIG. 14 in the fifth embodiment.

First, while the secondary outer transfer roller 57 remains in a rotating state, negative polarity bias, that is of the same polarity as the toner, is applied to the secondary outer transfer roller 57 from the secondary transfer bias power source 58 serving as the electrostatic cleaning unit, for an amount of type equivalent to one turn (approximately 0.23 sec). Thereafter, positive polarity bias, that is of the opposite polarity to the toner, is applied to the secondary outer transfer roller 57 for an amount of type equivalent to one turn. Thus, one turn each of negative-polarity and positive-polarity bias (reversing cleaning bias) makes up one set, and changing the number of times changes the cleaning time.

In a case where the toner charge amount within the developer container is maintained within a predetermined range, after the interposing toner before starting of the secondary transfer passes the secondary transfer portion and then two sets of electrostatic cleaning is performed, the secondary transfer operations is performed in the present embodiment, as illustrated in FIG. 14. It was found in the present embodiment that a reverse polarity bias value of around −20 μA and a positive polarity bias value of around +40 μA was sufficient to avoid backside contamination. However, if the amount of interposing toner reaches a certain amount or more, even if these bias values are used, backside contamination occurs even after two sets of electrostatic cleaning even if the negative polarity and positive polarity bias is sufficiently high. Accordingly, backside contamination was found to be avoidable by increasing the number of times of cleaning and performing transfer to the intermediate transfer belt 51 side a little at a time.

Induction detection involving patch detection is performed in the toner replenishing control according to the present embodiment, in the same way as in the sixth embodiment. If the toner concentration or toner charge amount in the developer container 41 changes, the toner amount of the interposing toner may change. In the present embodiment, the inductance target signal value Itrg has upper and lower limits for the amount of correction, with 2.5 V±0.6 V being the predetermined upper limit value and lower limit value, as described by way of FIG. 19 in the sixth embodiment. That is to say, when 1.9 V≤Itrg≤3.1 V holds, the toner change amount in the developer container 41 is maintained generally, constant, so the density of interposing toner is maintained generally constant. On the other hand, in a case where Ptrg2<Psig or Ptrg1>Psig in a state where Itrg=1.9 V or Itrg=3.1 V, Itrg is not corrected, so the toner charge amount in the developer container 41 may have changed, and the interposing toner concentration may be high.

Accordingly, in a case where the inductance target signal value (Itrg) does not move from the upper or lower limiters (1.9 V or 3.1 V), the following control is performed in the present embodiment. That is, the cleaning conditions of the secondary outer transfer roller 57 are changed in accordance with the difference of the newest patch image density as to the target lower limit value or target upper limit value.

This will be described in detail. In a state where the inductance target signal value (Itrg) serving as the first reference value has reached the predetermined upper limit value (3.1 V), the cleaning conditions are changed in accordance with the relationship between the detection results of patch image density and the target upper limit value (Ptrg2) serving as the second reference value. Specifically, the cleaning time is changed in accordance with Psig−Ptrg2=ΔVpatch.

Also, in a state where the inductance target signal value (Itrg) serving as the first reference value has reached the predetermined lower limit value (1.9 V), the cleaning conditions are changed in accordance with the relationship between the detection results of patch image density and the target lower limit value (Ptrg1) serving as the second reference value. Specifically, the cleaning time is changed in accordance with Psig−Ptrg1=ΔVpatch.

Control of electrostatic cleaning of the secondary outer transfer roller 57 (secondary transfer cleaning) according to the present embodiment will be described in detail with reference to FIGS. 47 and 48. The cleaning time of the secondary outer transfer roller 57 (number of times of secondary transfer cleaning) in the present embodiment is charged in accordance with ΔVpatch, as illustrated in FIG. 47. FIG. 48 illustrates a table of the number of times of secondary transfer cleaning as to ΔVpatch, to prevent backside contamination of the recording medium performed after the interposing toner has passed through the secondary transfer portion N2. FIG. 48 shows the number of sets described in FIG. 14.

First, after starting image forming operations, judgment is made regarding whether or not the inductance target signal value has reached the upper or lower limiters (1.9 V, 3.1 V) (S901). In a case where the inductance target signal value has not reached either of the upper and lower limiters, two sets of secondary transfer cleaning are performed (S904), following which secondary transfer operations start (S905).

On the other hand, in a case where the inductance target signal value has reached one or the other of the upper and lower limiters, ΔVpatch is calculated as described above (S902). The number of times of secondary transfer cleaning is selected from the table in FIG. 48 (S903). The secondary transfer cleaning is performed according to this number of times for secondary transfer cleaning (S904), following which secondary transfer operations start (S905).

By controlling the time of secondary transfer cleaning in accordance with ΔVpatch in this way, the secondary transfer cleaning time can be optimized even in a case where the toner charge amount within the developer container 41 changes. As a result, backside contamination due to interposing toner can be suppressed without unnecessarily extending the time from starting image forming operation up to starting secondary transfer operations.

Also, although the secondary cleaning timing is changed in accordance with ΔVpatch in a case where the inductance target signal value has reached one or the other of the upper and lower limiters, this is not restrictive. For example, an arrangement may be made where the secondary transfer cleaning time is changed only using the output value of the magnetic permeability sensor, or only using the output value of the image density sensor 90. Note that the configuration of the present embodiment and the above-described sixth through thirteenth embodiments may be combined as suitable.

Fifteenth Embodiment

A fifteenth embodiment will be described by way of FIGS. 49 and 50. In the present embodiment, secondary transfer cleaning time is offset in accordance with the difference of the output value of the magnetic permeability sensor 45 and the inductance target signal value, in addition to the control of the fourteenth embodiment. Other configurations and operations are the same as in the fourteenth embodiment, so the same configurations will be denoted by the same reference numerals, and description thereof will be omitted or simplified. Description will be made primarily regarding feature portions of the fifteenth embodiment.

In a case of continuously performing image forming with a high coverage rate, for example, the toner concentration within the developer container 41 may drop due to toner replenishing not keeping up. If interposing toner is formed in this state, there is a possibility that the interposing toner may be formed at a lower toner density than the original toner density target value. There may also be rare cases where variance in toner replenishing amount results in variance in the actual toner density as to the toner density target value. Accordingly, the secondary transfer cleaning time is controlled in accordance with Itrg−In=ΔI, which is the difference value between the newest output value In of the magnetic permeability sensor 45 and the inductance target signal value Itrg.

Figure 49:
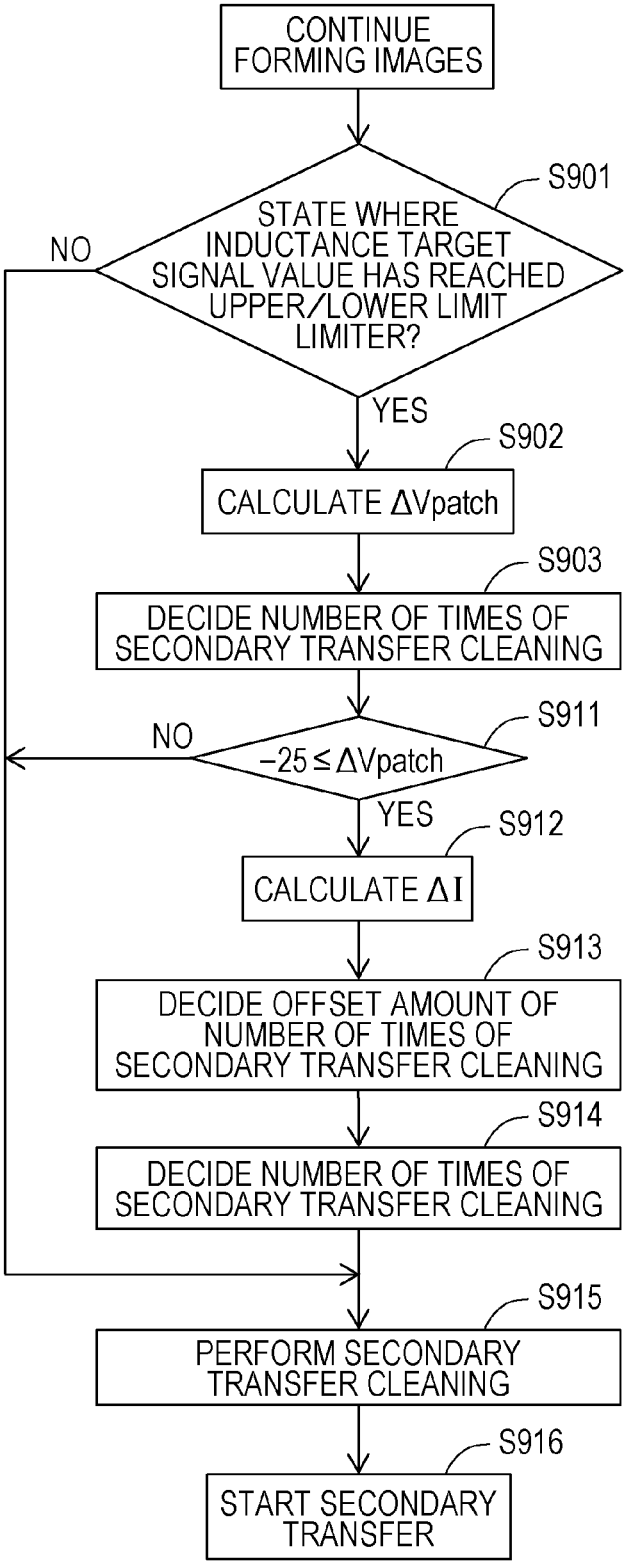
FIG. 49 is a flowchart illustrating a control flow for cleaning the secondary transfer roller according to a fifteenth embodiment.
Figures 50, 51:
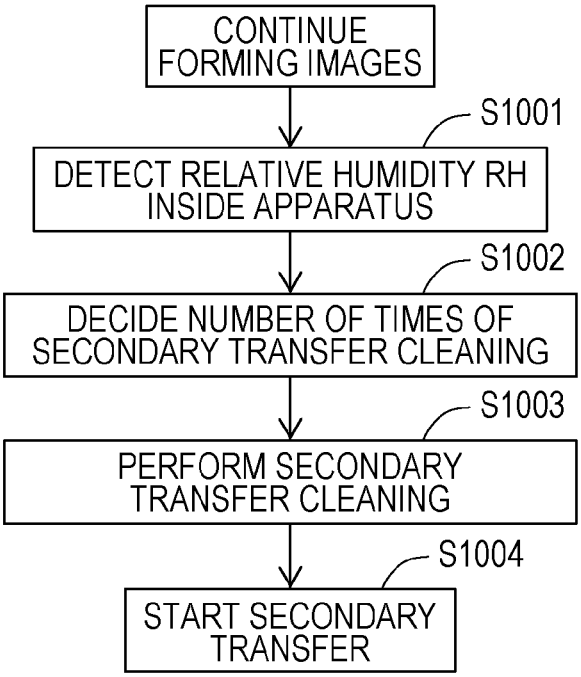
FIG. 50 is a diagram illustrating a correction table for the number of times of cleaning, as to ΔI according to the fifteenth embodiment.
FIG. 51 is a flowchart illustrating a control flow for cleaning the secondary transfer roller according to a sixteenth embodiment.

The number of times of secondary transfer cleaning is controlled in accordance with ΔVpatch and ΔI in the present embodiment, as shown in FIG. 49. FIG. 50 shows a table of offset amount for the number of times of secondary transfer cleaning as to ΔI. S901 through S903 in FIG. 49 are the same as in FIG. 47 in the fourteenth embodiment, so description will be omitted.

Figures 47, 48:
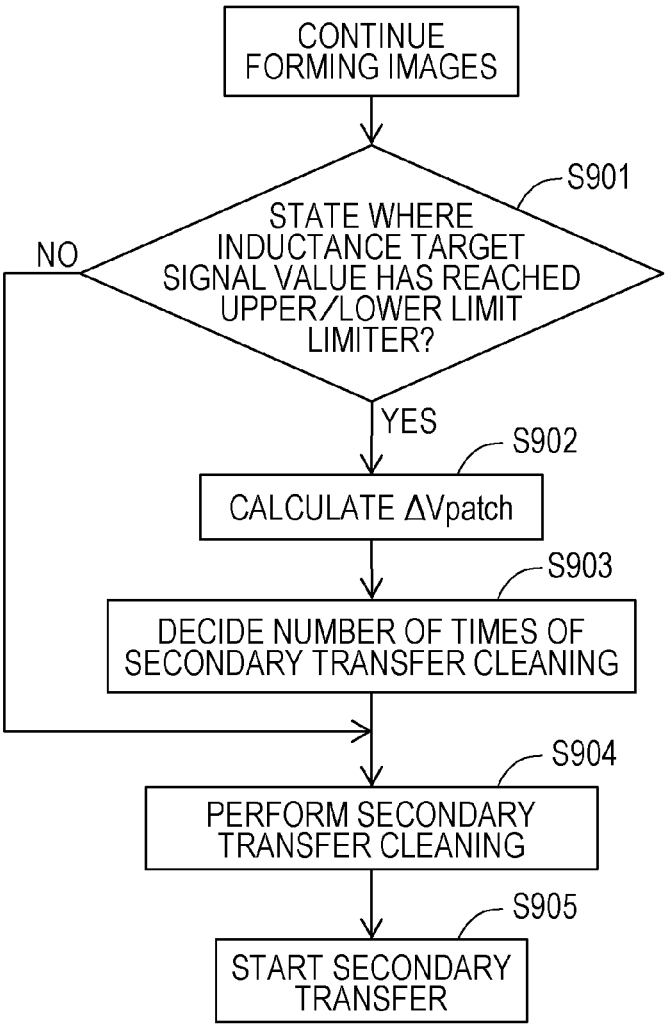
FIG. 47 is a flowchart illustrating a control flow for cleaning a secondary transfer roller according to a fourteenth embodiment.
FIG. 48 is a diagram of a table showing the number of times of cleaning, as to ΔVpatch according to the fourteenth embodiment.

As illustrated in FIG. 49, upon the number of times of secondary transfer cleaning being selected from the table in FIG. 48 in S903, determination is made regarding whether or not the ΔVpatch calculated in S902 is −25 or more (S911). If ΔVpatch is smaller than −25, secondary transfer cleaning is performed by the number of times of secondary transfer cleaning selected from the table in FIG. 48 (S915), and secondary transfer operations start (S916).

On the other hand, in a case where ΔVpatch is −25 or more in S911, ΔI is calculated from the newest output value of the magnetic permeability sensor 45 (S912). Next, the offset amount of the number of times of secondary transfer cleaning is decided from the table in FIG. 50 (S913). Further, final decision of the number of times of secondary transfer cleaning is made from the offset amount (S914). Secondary transfer cleaning is then performed by the number of times of secondary transfer cleaning (S915), and secondary transfer operations start (S916).

As described above, the number of times of secondary transfer cleaning is offset in accordance with ΔI and ΔVpatch in the present embodiment. Accordingly, in a case of continuously performing image forming with a high coverage rate resulting in the toner concentration within the developer container 41 dropping, or variance in toner replenishing amount resulting in variance in the actual toner density as to the toner density target value, time for secondary transfer cleaning can be optimized.

Sixteenth Embodiment

Figures 52, 53:
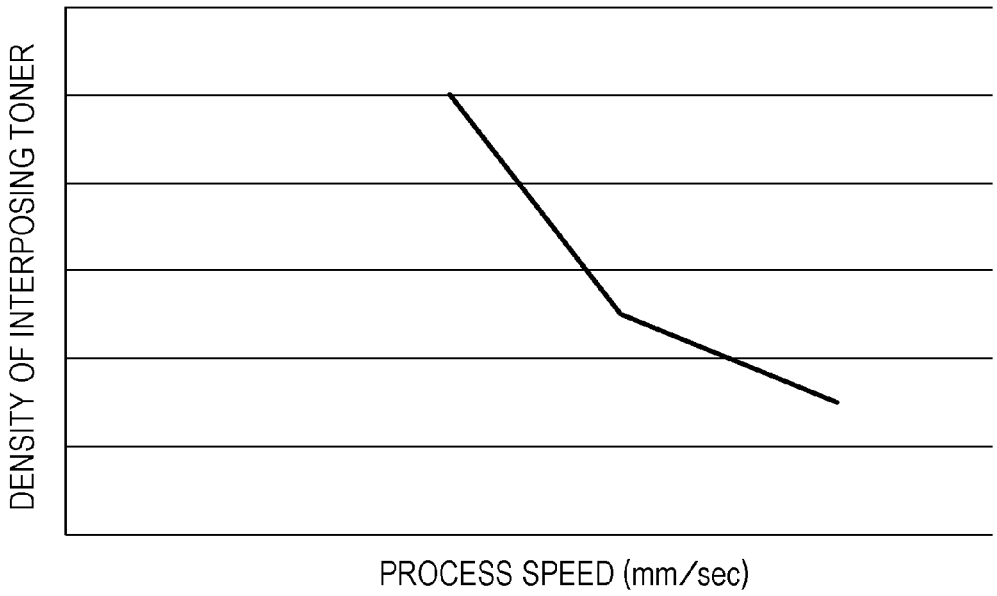
FIG. 52 is a diagram illustrating a table for the number of times of cleaning as to relative humidity according to the sixteen the embodiment.
FIG. 53 is a diagram illustrating the relationship between process speed and interposing toner amount according to a seventeenth embodiment.

A sixteenth embodiment will be described by way of FIGS. 51 and 52, with reference to FIGS. 1, 6, and 14. In the above fourteenth and fifteenth embodiments, cleaning conditions for performing electrostatic cleaning of the secondary outer transfer roller 57 have been changed based on information relating to toner density. Conversely, in the present embodiment, cleaning conditions for performing electrostatic cleaning of the secondary outer transfer roller (secondary transfer cleaning time) are changed based on the environment within the apparatus main unit. Other configurations and operations are the same as in the fourteenth embodiment, so the same configurations will be denoted by the same reference numerals, and description thereof will be omitted or simplified. Description will be made primarily regarding feature portions of the sixteenth embodiment. Although description is made regarding the image forming station Sa below, the same holds true for the other image forming stations as well.

Now, in a case where the environment in the apparatus main unit changes, there is a possibility that the amount of toner for the interposing toner will change. That is to say, in a case where the toner concentration within the developer container 41 is high (the toner charge amount is low), the amount of toner for the interposing toner increases, and conversely, in a case where the toner concentration is low (the toner charge amount is high), the amount of toner for the interposing toner decreases, and the cleaning time for removing interposing toner from the secondary outer transfer roller 57 changes accordingly. Thus, the cleaning conditions for cleaning the secondary outer transfer roller 57 is changed in accordance with relative humidity in the apparatus main unit in the present embodiment.

The interposing toner is interposed between the photosensitive drums 1*a* through 1*d* and the intermediate transfer belt 51 when ending image forming, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

In the case of the present embodiment as well, a thermo-hygro sensor 130 serving as an environment detecting unit is disposed near the image forming station Sd (preferably near the developing device 4*d*) as an environment detecting unit, to detect environment information in the apparatus main unit 101 (in the apparatus) by detecting temperature T and relative humidity RH within the apparatus, in the same way as in the eighth embodiment. The environmental change of the interposing toner is as illustrated in FIG. 28 in the eighth embodiment. It can be seen from FIG. 28 that the amount of interposing toner increases as the relative humidity RH rises, since the amount of charge of the toner decreases. In an environment where the temperature was 25° and the relative humidity RH was 50%, the amount of interposing toner in terms of density was around 0.01 $mg/cm^2$. On the other hand, at 30° and 80%, the density was around 0.2 $mg/cm^2$.

After the interposing toner has passed the secondary transfer portion N2, electrostatic cleaning is performed where the secondary outer transfer roller 57 is electrostatically cleaned in the case of the present embodiment as well, in the same way as described in FIG. 14 in the fifth embodiment. First, while the secondary outer transfer roller 57 remains in a rotating state, negative polarity bias, that is of the same polarity as the toner, is applied to the secondary outer transfer roller 57 from the secondary transfer bias power source 58 serving as the electrostatic cleaning unit, for an amount of type equivalent to one turn (approximately 0.23 sec). Thereafter, positive polarity bias, that is of the opposite polarity to the toner, is applied to the secondary outer transfer roller 57 for an amount of type equivalent to one turn. Thus, one turn each of negative-polarity and positive-polarity bias (reversing cleaning bias) makes up one set, and changing the number of times changes the cleaning time.

Next, the electrostatic cleaning (secondary transfer cleaning) of the secondary outer transfer roller 57 according to the present embodiment will be described in detail with reference to FIGS. 51 and 52. In the present embodiment, the cleaning time (number of times of secondary transfer cleaning) of the secondary outer transfer roller 57 is changed in accordance with the relative humidity RH, as illustrated in FIG. 51. FIG. 52 is a table showing the number of times of secondary transfer cleaning to prevent backside contamination of the recording medium after the interposing toner has passed through the secondary transfer portion N2, as to the relative humidity RH. FIG. 52 shows the number of sets described in FIG. 14.

First, after starting image forming operations, the relative humidity RH within the apparatus is detected by the thermo-hygro sensor 130 (S1001). Thereafter, the number of times of secondary transfer cleaning is selected from the table in FIG. 52 (S1002). Secondary transfer cleaning is then performed by this number of times of secondary transfer cleaning (S1003), and secondary transfer operations start (S1004).

By controlling the secondary transfer cleaning time in accordance with the relative humidity RH as described above, the secondary transfer cleaning time can be optimized even in a case where the amount of interposing toner changes due to the relative humidity in the apparatus changing. As a result, backside contamination due to interposing toner can be suppressed without unnecessarily extending the time from starting image forming operation up to starting secondary transfer operations.

Note that the configuration of the present embodiment and the above-described sixth through thirteenth embodiments may be combined as suitable. Also, although the secondary transfer cleaning time is changed in the present embodiment in accordance with the relative humidity RH, the environment within the apparatus main unit is not restricted to relative humidity RH, and temperature or moisture content may be used in the same way. That is to say, there are cases wherein the density of interposing toner changes according to the moisture content, as in the above-described eleventh embodiment. Accordingly, the secondary transfer cleaning time may be changed in accordance with the moisture content. Also, in cases of changing the amount of interposing toner in accordance with temperature, the secondary transfer cleaning time may be changed in accordance with the temperature, as in the above-described tenth embodiment. At least one of temperature, relative temperature, and moisture content may be detected as the environment within the apparatus main unit, and the secondary cleaning time be changed in accordance with the detection results.

Seventeenth Embodiment

Figures 54, 55:
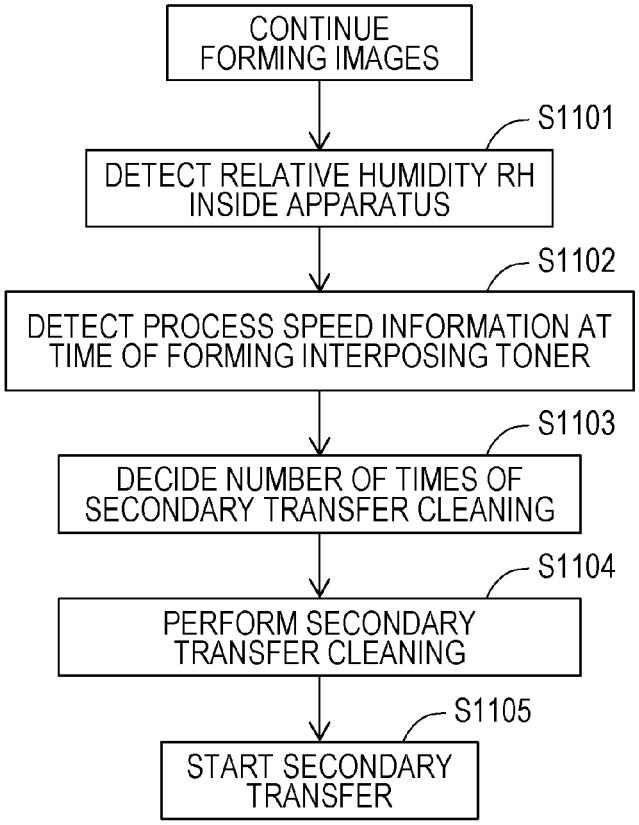
FIG. 54 is a flowchart illustrating a control flow for cleaning the secondary transfer roller according to a seventeenth embodiment.
FIG. 55 is a diagram illustrating a table for the number of times of cleaning as to relative humidity and process speed according to the seventeenth embodiment.

A seventeenth embodiment will be described by way of FIGS. 53 through 55, with reference to FIGS. 1, 6, and 14. In the above fourteenth and fifteenth embodiments, cleaning conditions for performing electrostatic cleaning of the secondary outer transfer roller 57 have been changed based on information relating to toner density. Conversely, in the present embodiment, cleaning conditions for performing electrostatic cleaning of the secondary outer transfer roller 57 (secondary transfer cleaning time) are changed based on the process speed. Other configurations and operations are the same as in the fourteenth embodiment, so the same configurations will be denoted by the same reference numerals, and description thereof will be omitted or simplified. Description will be made primarily regarding feature portions of the seventeenth embodiment. Although description is made regarding the image forming station Sa below, the same holds true for the other image forming stations as well.

Now, in a case where the process speed (the speed of the photosensitive drum and intermediate transfer belt) changes, there is a possibility that the amount of toner for the interposing toner will change. For example, in a case where the process speed changes, the way in which developing bias is applied per increment of time changes, so the amount of interposing toner also changes. Accordingly, at least one of duty ratio, amplitude, and frequency of the waveform of the developing bias AC is changed in accordance with the process speed in the present embodiment. This will be described in detail below.

The interposing toner is interposed between the photosensitive drums 1*a* through 1*d* and the intermediate transfer belt 51 when ending image forming, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

The image forming apparatus according to the present embodiment can change the process speed to multiple levels form the perspective of maintaining fixability of the fixing device 7. That is to say, the speed of the photosensitive drum 1*a* and intermediate transfer belt 51 can be driven at multiple speeds (process speeds), and the process speed is changed according to the grammage of the recording medium on which image forming is to be performed. Specifically, the process speed is 250 mm/sec for plain paper of which the grammage is below 128 g/m$^2$, and is halved to 125 mm/sec for plain paper or coated paper of which the grammage is 128 g/m$^2$ or heavier.

Now, if the developing bias AC is constant, the amount of interposing toner changes in accordance with the process speed. FIG. 53 shows the relationship between process speed under a constant temperature-humidity environment, and amount of interposing toner in the image forming apparatus according to the present embodiment. The horizontal axis in FIG. 53 is process speed, and the vertical axis is density of interposing toner on the photosensitive drum. It can be seen from FIG. 53 that increasing the process speed reduces the interposing toner density. The reason is that when using a square bias waveform as the developing bias AC, the number of times of oscillation of the developing bias AC per unit time increases in the developing region when the process speed is slow, increasing the influence of toner pullback pulses.

In the case of the present embodiment as well, a thermo-hygro sensor 130 serving as an environment detecting unit is disposed near the image forming station Sd (preferably near the developing device 4*d*) as an environment detecting unit, to detect environment information in the apparatus main unit 101 (in the apparatus) by detecting temperature T and relative humidity RH within the apparatus, as in the eighth embodiment.

After the interposing toner has passed the secondary transfer portion N2, electrostatic cleaning is performed where the secondary outer transfer roller 57 is electrostatically cleaned in the case of the present embodiment as well, in the same way as described in FIG. 14 in the fifth embodiment. First, while the secondary outer transfer roller 57 remains in a rotating state, negative polarity bias, that is of the same polarity as the toner, is applied to the secondary outer transfer roller 57 from the secondary transfer bias power source 58 serving as the electrostatic cleaning unit, for an amount of type equivalent to one turn (approximately 0.23 sec). Thereafter, positive polarity bias, that is of the opposite polarity to the toner, is applied to the secondary outer transfer roller 57 for an amount of type equivalent to one turn. Thus, one turn each of negative-polarity and positive-polarity bias (reversing cleaning bias) makes up one set, and changing the number of times changes the cleaning time.

Next, the electrostatic cleaning (secondary transfer cleaning) of the secondary outer transfer roller 57 according to the present embodiment will be described in detail with reference to FIGS. 54 and 55. In the present embodiment, the cleaning time (number of times of secondary transfer cleaning) of the secondary outer transfer roller 57 is changed in accordance with the relative humidity RH, and further the number of times of secondary transfer cleaning is changed is accordance with the process speed, as illustrated in FIG. 54. That is to say, the number of times of secondary transfer cleaning is changed in accordance with the relative humidity RH and the process speed at the time of forming the interposing toner. FIG. 55 is a table showing the number of times of secondary transfer cleaning to prevent backside contamination of the recording medium after the interposing toner has passed through the secondary transfer portion N2, as to the relative humidity RH and process speed (PS). FIG. 55 shows the number of sets described in FIG. 14.

First, after starting image forming operations, the relative humidity RH within the apparatus is detected by the thermo-hygro sensor 130 (S1101). Thereafter, information of the process speed at the time of having formed the interposing toner immediately prior is detected (S1102). The number of times of secondary transfer cleaning is selected from the table in FIG. 55 (S1103). Secondary transfer cleaning is then performed by this number of times of secondary transfer cleaning (S1104), and secondary transfer operations start (S1105).

The secondary transfer cleaning time is controlled in accordance with the relative humidity RH and process speed as described above. Accordingly, the secondary transfer cleaning time can be optimized even in a case where the amount of interposing toner changes due to the relative humidity in the apparatus changing or the process speed at the time of forming the interposing toner changing. As a result, backside contamination due to interposing toner can be suppressed without unnecessarily extending the time from starting image forming operation up to starting secondary transfer operations.

Note that the configuration of the present embodiment and the above-described sixth through thirteenth embodiments may be combined as suitable. Also, although the secondary transfer cleaning time is changed in the present embodiment in accordance with the relative humidity and process speed, the secondary transfer cleaning time may be changed in accordance with the process speed along. For example, the slower the process speed, the longer the secondary cleaning time.

Further, although the secondary transfer cleaning time is changed in the present embodiment in accordance with the relative humidity RH, the environment within the apparatus main unit is not restricted to relative humidity RH, and temperature or moisture content may be used in the same way. That is to say, there are cases wherein the density of interposing toner changes according to the moisture content, as in the above-described eleventh embodiment. Accordingly, the secondary transfer cleaning time may be changed in accordance with the moisture content. Also, in cases of changing the amount of interposing toner in accordance with temperature, as in the above tenth embodiment, the secondary transfer cleaning time may be changed in accordance with the temperature. At least one of temperature, relative temperature, and moisture content may be detected, and the secondary cleaning time be changed in accordance with the detection results.

Eighteenth Embodiment

An eighteenth embodiment will be described by way of FIGS. 56 through 58, with reference to FIGS. 1, 6, and 14. In the above fourteenth and fifteenth embodiments, cleaning conditions for performing electrostatic cleaning of the secondary outer transfer roller 57 have been changed based on information relating to toner density. Conversely, in the present embodiment, cleaning conditions for performing electrostatic cleaning of the secondary outer transfer roller 57 (secondary transfer cleaning time) are changed based on information of surface properties of the recording medium. Other configurations and operations are the same as in the fourteenth embodiment, so the same configurations will be denoted by the same reference numerals, and description thereof will be omitted or simplified. Description will be made primarily regarding feature portions of the seventeenth embodiment. Although description is made regarding the image forming station Sa below, the same holds true for the other image forming stations as well.

In a case of having formed interposing toner, toner that has adhered to the surface of the secondary outer transfer roller 57 may be transferred to back side of the recording medium, resulting in backside contamination. The degree of how much toner is transferred to the recording medium depends on the surface properties of the recording medium being used. In a case where the unevenness of the surface of the recording medium is small, a larger amount of toner tends to be transferred from the secondary outer transfer roller 57. On the other hand, in a case where the unevenness of the surface of the recording medium is large, a smaller amount of toner tends to be transferred from the secondary outer transfer roller 57. Accordingly, cleaning conditions necessary for cleaning the secondary outer transfer roller 57 to where no backside contamination of the recording medium will occur differ depending on the surface properties of the recording medium. Accordingly, the cleaning conditions for cleaning the secondary outer transfer roller 57 are changed in the present embodiment according to information regarding the surface properties of the recording medium.

The interposing toner is interposed between the photosensitive drums 1*a* through 1*d* and the intermediate transfer belt 51 when ending image forming, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, AC voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

After the interposing toner has passed the secondary transfer portion N2, electrostatic cleaning is performed where the secondary outer transfer roller 57 is electrostatically cleaned in the case of the present embodiment as well, in the same way as described in FIG. 14 in the fifth embodiment. First, while the secondary outer transfer roller 57 remains in a rotating state, negative polarity bias, that is of the same polarity as the toner, is applied to the secondary outer transfer roller 57 from the secondary transfer bias power source 58 serving as the electrostatic cleaning unit, for an amount of type equivalent to one turn (approximately 0.23 sec). Thereafter, positive polarity bias, that is of the opposite polarity to the toner, is applied to the secondary outer transfer roller 57 for an amount of type equivalent to one turn. Thus, one turn each of negative-polarity and positive-polarity bias (reversing cleaning bias) makes up one set, and changing the number of times changes the cleaning time.

Figure 56:
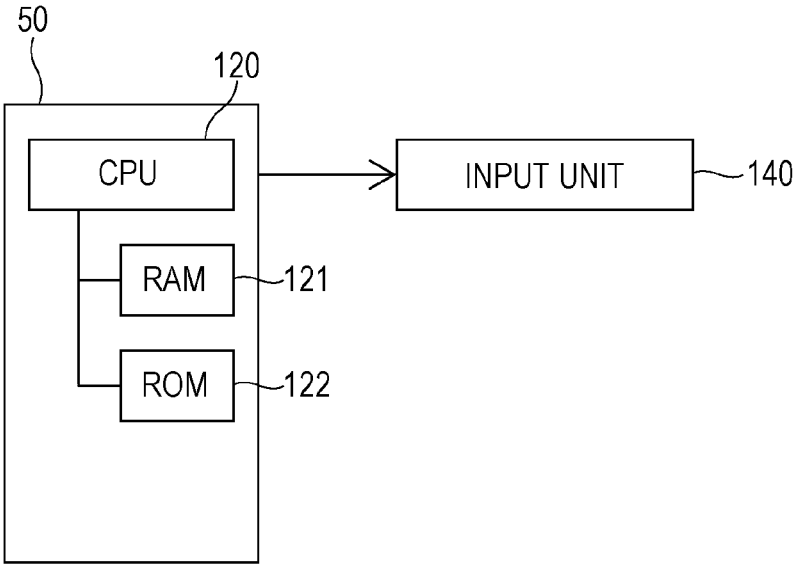
FIG. 56 is a control block diagram of an image forming apparatus according to an eighteenth embodiment.
Figure 57:
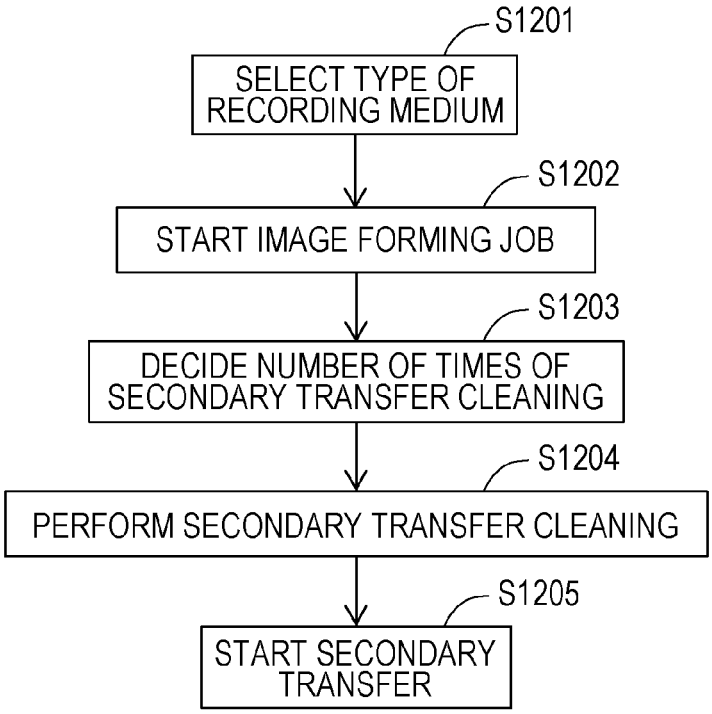
FIG. 57 is a flowchart illustrating a control flow for cleaning the secondary transfer roller according to the eighteenth embodiment.

Also, in the case of the present embodiment, the image forming apparatus 100 includes an input unit 140 serving as an information obtaining unit of the user to input information relating to the recording medium being used, as illustrated in FIG. 56. The input unit 140 is an operating panel provided to the image forming apparatus, for example, and the user inputs the type of recording medium as the information regarding the recording medium, by operating this operating panel. For example, the operating panel displays, as types of recording medium, high-quality paper, recycled paper, one-side coated paper coated on one side, both-side coated paper coated on both sides, embossed paper, vellum, and so forth. The type of recording medium is input by the user selecting one of these.

Next, the electrostatic cleaning (secondary transfer cleaning) of the secondary outer transfer roller 57 according to the present embodiment will be described in detail with reference to FIGS. 57 and 58. In the present embodiment, the cleaning time (number of times of secondary transfer cleaning) of the secondary outer transfer roller 57 is changed in accordance with the type (information) of the recording medium, as illustrated in FIG. 57. FIG. 58 is a table showing the number of times of secondary transfer cleaning to prevent backside contamination of the recording medium after the interposing toner has passed through the secondary transfer portion N2. FIG. 58 shows the number of sets described in FIG. 14.

First, before starting an image forming job, the user selects the type of recording medium from the input unit 140 (S1201). The selected recording medium type information is input to the control circuit 50 as illustrated in FIG. 56. Thereafter, the image forming job is started (S1202). The CPU 120 decides the number of times of secondary transfer cleaning based on the type of recording medium that has been input, and the table stored in ROM 122 beforehand regarding the type of recording medium and number of times of secondary transfer cleaning (FIG. 58) (S1203). Secondary transfer cleaning is then performed by this number of times of secondary transfer cleaning (S1204), and secondary transfer operations start (S1205).

As described above, the secondary transfer cleaning time can be optimized while suppressing occurrence of backside contamination of the recording medium, by controlling the secondary transfer cleaning time in accordance with the type of recording medium being used. Note that the configuration of the present embodiment and the above-described sixth through thirteenth embodiments may be combined as suitable.

Nineteenth Embodiment

A nineteenth embodiment will be described by way of FIGS. 59 through 62, with reference to FIGS. 1, 6, and 14. In the above eighteenth embodiment, information of the recording medium is obtained by the user inputting from the input unit 140. Conversely, in the present embodiment, information of the recording medium is obtained by detecting the surface of the recording medium stored in the cassette 110. Other configurations and operations are the same as in the eighteenth embodiment, so the same configurations will be denoted by the same reference numerals, and description thereof will be omitted or simplified. Description will be made primarily regarding feature portions of the nineteenth embodiment.

Figures 58, 59:
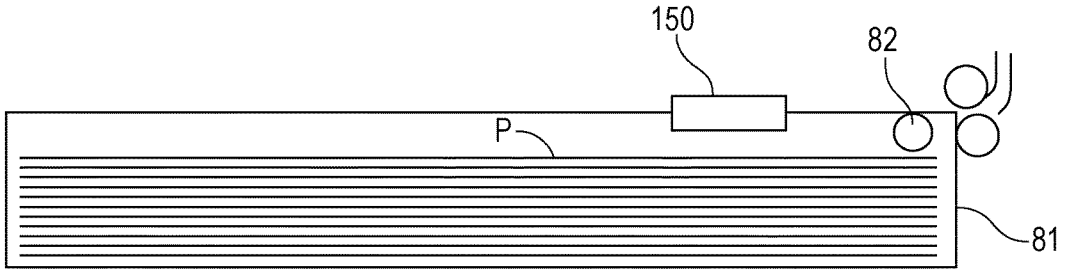
FIG. 58 is a diagram of a table showing the number of times of cleaning as to types of recording medium, according to the eighteenth embodiment.
FIG. 59 is a diagram illustrating a surface detection sensor disposed on a cassette according to a nineteenth embodiment.
Figure 60:
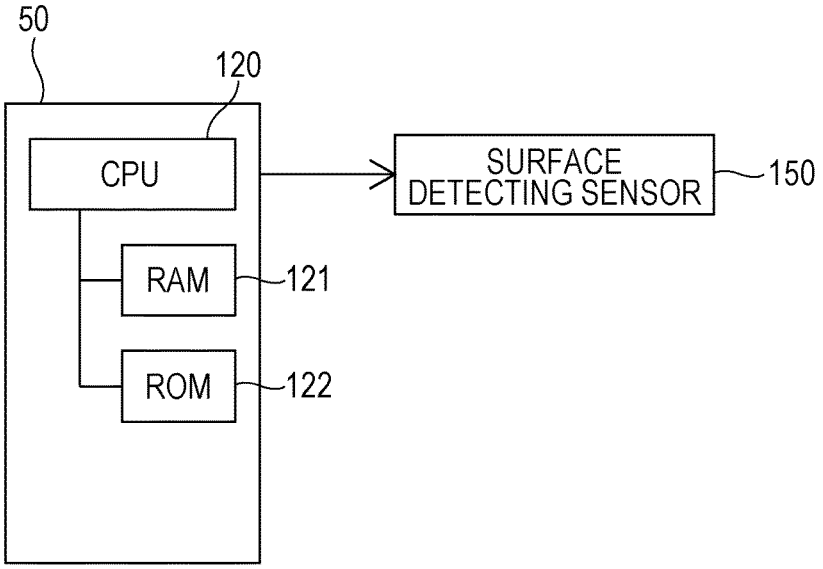
FIG. 60 is a control block diagram of an image forming apparatus according to a nineteenth embodiment.

A surface detection sensor 150, serving as a surface detecting unit (information obtaining unit) to detect the surface properties of the recording medium, is disposed vertically above the cassette 110 storing the recording medium, as illustrated in FIG. 59. The surface detection sensor 150 includes a light-emitting unit (light-emitting diode (LED)) and a light-receiving unit. The surface of the recording medium within the cassette 110 is irradiated by the incident light emitted by the LED, and the reflected light is received by the light-receiving unit and the intensity thereof is read as a signal value. The signal value of the surface detection sensor 150 obtained in this way is input to the control circuit 50 as illustrated in FIG. 60. The intensity of light received by the light-receiving unit differs depending on the surface properties (unevenness), so the CPU 120 can judge the surface properties of the recording medium based on the signal value of intensity of the received light (can obtain information of the recording medium).

Figure 61:
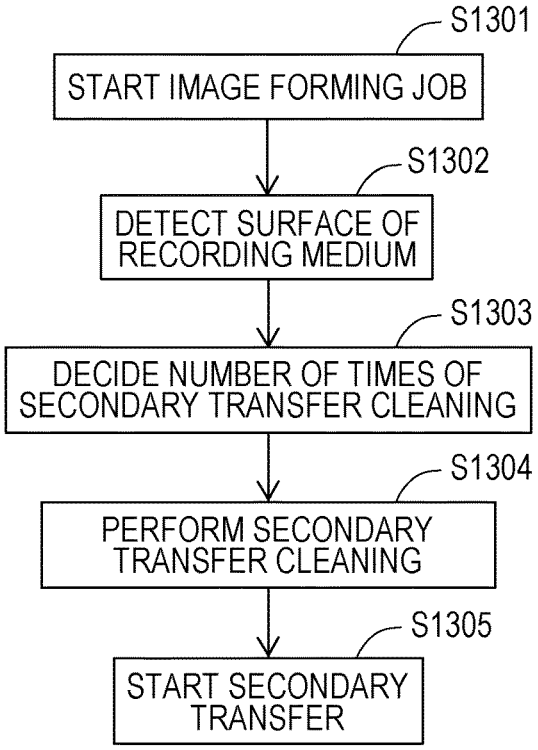
FIG. 61 is a flowchart illustrating a control flow for cleaning the secondary transfer roller according to the nineteenth embodiment.

Next, the electrostatic cleaning (secondary transfer cleaning) of the secondary outer transfer roller 57 according to the present embodiment will be described in detail with reference to FIGS. 61 and 62. In the present embodiment, the cleaning time (number of times of secondary transfer cleaning) of the secondary outer transfer roller 57 is changed in accordance with the detection results of the surface detection sensor 150 (information of the recording medium), as illustrated in FIG. 61. FIG. 62 is a table showing the number of times of secondary transfer cleaning to prevent backside contamination of the recording medium after the interposing toner has passed through the secondary transfer portion N2, as to the detection results of the surface detection sensor 150 (signal value). FIG. 62 shows the number of sets described in FIG. 14.

First, upon starting an image forming job (S1301), the surface detection sensor 150 detects the surface properties of the recording medium in the cassette 110 (S1302). The signal value of the surface detection sensor 150 is input to the control circuit 50. The CPU 120 decides the number of times of secondary transfer cleaning based on the input signal value, and the table stored in ROM 122 beforehand regarding the signal value and number of times of secondary transfer cleaning (FIG. 62) (S1303). Secondary transfer cleaning is then performed by this number of times of secondary transfer cleaning (S1304), and secondary transfer operations start (S1305).

As described above, the secondary transfer cleaning time can be optimized while suppressing occurrence of backside contamination of the recording medium, by controlling the secondary transfer cleaning time in accordance with information of the surface properties of recording medium being used. Note that the configuration of the present embodiment and the above-described sixth through thirteenth embodiments may be combined as suitable.

Twentieth Embodiment

A nineteenth embodiment will be described by way of FIGS. 63 through 66, with reference to FIG. 1. In the above embodiments, the interposing toner is formed when ending image forming as the predetermined timing. Conversely, in the present embodiment, the interposing toner is formed in a case where predetermined conditions are satisfied in standby mode, when no image forming job is being performed, as the predetermined timing. Other configurations and operations are the same as in the first embodiment, so the same configurations will be denoted by the same reference numerals, and description thereof will be omitted or simplified. Description will be made primarily regarding feature portions of the twentieth embodiment. Although description is made regarding the image forming station Sa below, the same holds true for the other image forming stations as well.

In a case where a interposing toner is formed to suppress streaks from occurring each time image forming ends, the more times the image forming apparatus is used, the greater the amount of toner consume for forming the interposing toner is. Increased toner consumption is problematic, since running costs increase, the residual toner box to accommodate toner collected within the apparatus by cleaning various parts becomes full prematurely, and so forth.

On the other hand, regarding the part of the constituents of the intermediate transfer belt such as rubber material, fluorine compounds, and so forth that migrate onto the photosensitive drum, the amount of constituents that leach out from the surface of the intermediate transfer belt depends on the amount of time that the intermediate transfer belt and photosensitive drum have been left in contact, the moisture content in the environment at that time, and so forth. For example, even in an environment where the environmental moisture content is high, there is little leaching out of the constituents if the time left standing is short, so this may not be manifested as streaks even if no interposing toner is formed. Accordingly, not forming interposing toner in such cases can avoid needless toner consumption. Accordingly, the interposing toner is formed in the present embodiment in a case where predetermined conditions are satisfied in standby mode, when no image forming job is being performed. Particularly, the predetermined conditions are judged from the environment (moisture content) within the apparatus main unit, and the standby time over which the photosensitive drum and intermediate transfer belt have not been driven, in the present embodiment.

Accordingly, a thermo-hygro sensor 130 serving as an environment detecting unit is disposed in the present embodiment to detect environment information in the apparatus main unit 101 (in the apparatus) by detecting temperature T and relative humidity RH within the apparatus, in the same way as in the eighth embodiment (FIG. 1). The thermo-hygro sensor 130 transmits the detection results thereof to the control circuit 50 as appropriate, so as to be stored in the ROM 122 (see FIG. 5). The CPU 120 calculates the moisture content from the temperature and humidity values detected by the thermo-hygro sensor 130, and information of saturated moisture content at each temperature. The CPU 120 counts standby time, for example, the amount of time that the apparatus has been stopped from ending an image forming job.

As described above, the interposing toner forming sequence is activated in accordance with the standby time (time over which the photosensitive drum and intermediate transfer belt have been left in contact) and the moisture content in the environment where the apparatus is situated (environmental moisture amount). First, FIG. 63 illustrates the results of researching whether or not streaks will occur depending on the time over which the intermediate transfer belt 51 and photosensitive drum 1*a* have been left in contact, and the environmental moisture amount. It can be seen from FIG. 63 that the greater then environmental moisture content is, the more readily streaks occur.

Figure 64:
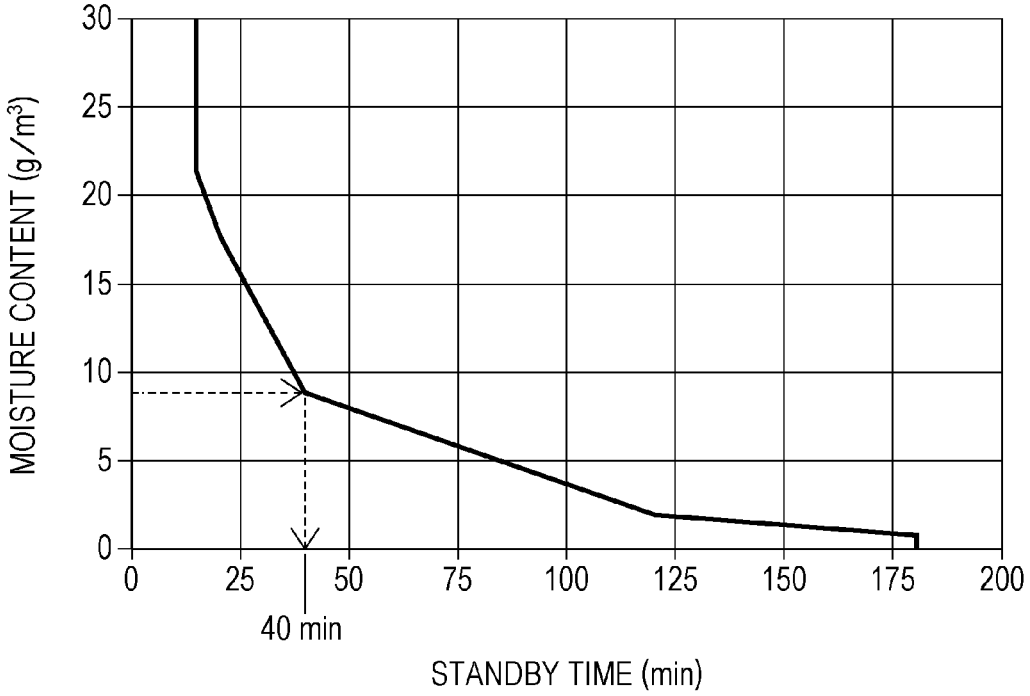
FIG. 64 is a diagram illustrating timing for running an interposing toner forming sequence according to the twentieth embodiment.

FIG. 64 is a timing table for activating the interposing toner forming sequence in the apparatus according to the present embodiment, compiled based on the results obtained from FIG. 63. The boundary of occurrence of streaks is indicated by the solid line, and the boundary (threshold value) conditions are points at which the interposing toner forming sequence is activated. For example, in a case where the environment in which the apparatus is situated is 23° C. and 50% relative humidity RH, and the environmental moisture content at this time is 8.9 g/m$^3$, the CPU 120 emits a signal to activate the sequence at a point that 40 minutes have elapsed as standby time.

As described above, the CPU 120 monitors the standby time and the environmental moisture amount calculated from the detection results of the thermo-hygro sensor 130 within the apparatus main unit. At a point that the relationship between the standby time and the environmental moisture content reaches the threshold value plotted in the graph in FIG. 64, the CPU 120 emits a signal to activate the interposing toner forming sequence.

Interposing Toner Forming Sequence

Figure 65:
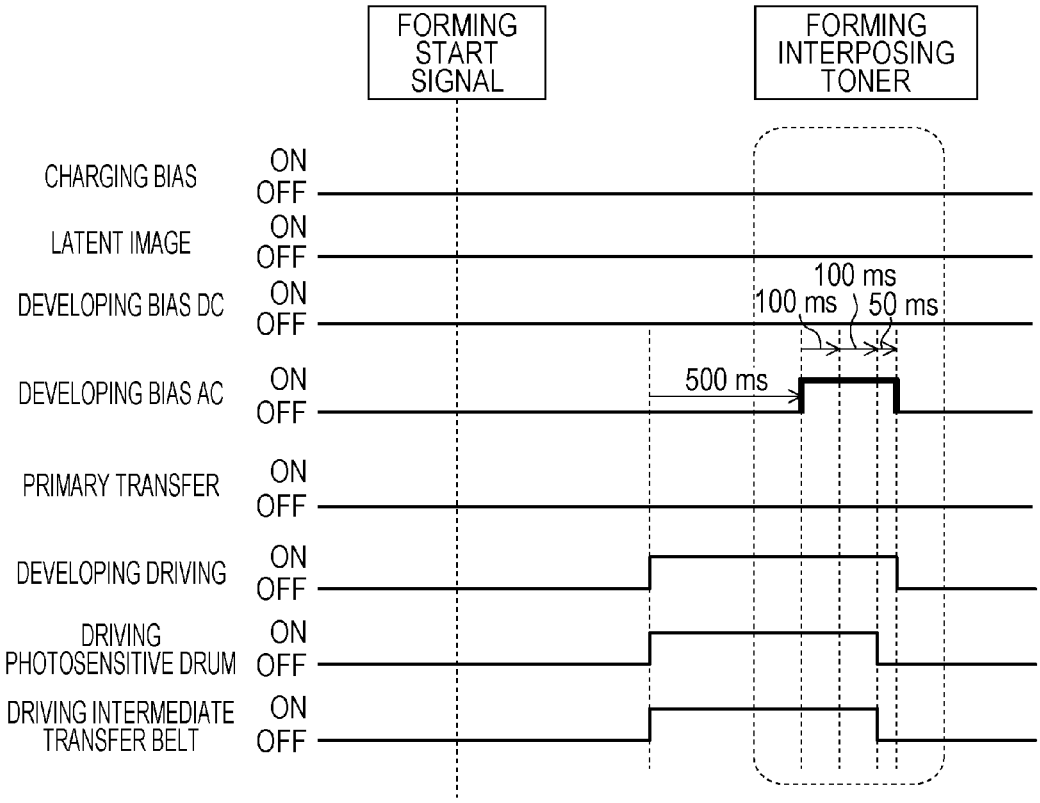
FIG. 65 is a timing chart illustrating the control timing of each device according to the twentieth embodiment.

This interposing toner forming sequence will be described with reference to FIG. 65. The photosensitive drum 1*a* (1*b* through 1*d*) according to the present embodiment is 30 mm in diameter, and the positional relationship between the developing sleeve 42 and the primary transfer portion N1*a* in the circumferential direction is 110° (see FIG. 1). The distance from the developing sleeve 42 to the primary transfer portion N1*a* in the circumferential direction is 28.8 mm. The process speed is 250 mm/s.

In a state where operations of the image forming apparatus are stopped, the interposing toner forming sequence is started after the CPU 120 issues the interposing toner forming start signal based on the graph shown in FIG. 64 as described above, as illustrated in FIG. 65.

The interposing toner forming start signal from the CPU 120 causes the image forming apparatus to output on signals for driving the photosensitive drum 1*a* and intermediate transfer belt 51, and for driving the developing sleeve 42, based on set values stored in the ROM 121 and RAM 122. 500 msec later, after the driving speed has stabilized, the developing bias AC is turned on. After 100 msec has elapsed and the developing bias AC has stabilized, the developing bias AC is maintained in an applied state for 100 msec to form the interposing toner. Accordingly, the interposing toner is formed on the photosensitive drum 1*a*. Thereafter, the CPU 120 outputs an off signal for driving of the photosensitive drum 1*a* and intermediate transfer belt 51. Further, an off signal for driving of the developing bias AC and developing sleeve 42 is output 50 msec after the signal for driving of the photosensitive drum 1*a* and intermediate transfer belt 51.

Accordingly, the image forming apparatus can be stopped in a state where the interposing toner t is formed on the photosensitive drum 1*a*, from the position of the developing sleeve 42 to the primary transfer portion N1*a*, as illustrated in FIG. 7 described above. That is to say, in the present embodiment, a state is realized where charging by the charging roller 2*a* is stopped (charging bias off) and also DC voltage application by the developing device 4*a* is stopped (developing bias DC off) in a case where predetermined conditions are satisfied when in standby mode. In this state, AC voltage is applied (to the developing device 4*a* (developing bias AC on), thereby adhering toner onto the surface of the photosensitive drum 1*a* and forming the interposing toner t. The driving of the photosensitive drum 1*a* and intermediate transfer belt 51 is then stopped in a state where interposing toner t is interposed between the photosensitive drum 1*a* and intermediate transfer belt 51. Delaying the timing to turn the developing bias AC off as compared to the timing to turn off driving of the photosensitive drum 1*a* prevents the interposing toner t from overrunning the primary transfer portion N1*a* due to inertia of the motor of the photosensitive drum 1*a* or the like.

Figure 66:
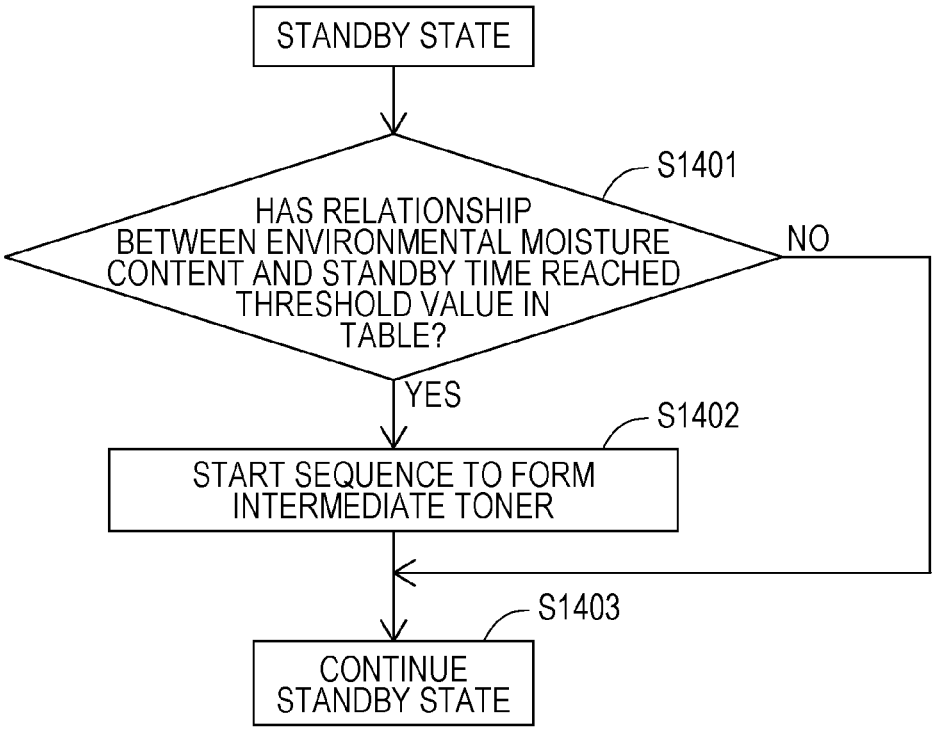
FIG. 66 is a flowchart illustrating a control flow for running the interposing toner forming sequence according to the twentieth embodiment.

FIG. 66 illustrates the flow of the interposing toner forming sequence according to the present embodiment. First, judgment is made by the CPU 120 regarding whether or not the relationship between environmental moisture amount and standby time in the environment where the image forming apparatus in standby state (standby mode) has reached the threshold value in the graph in FIG. 64 (S1401). If YES, the interposing toner forming sequence in FIG. 65 is started (S1402). After the interposing toner is formed, the standby state is continued (S1403). If NO, the standby state is continued without the interposing toner being formed (S1404).

Thus, forming the interposing toner in accordance with environmental moisture content and standby time of the apparatus enables streaks due to constituents of the intermediate transfer belt migrating to the surface of the photosensitive drum to be suppressed, without excessively consuming toner.

Although formation of the interposing toner is performed by applying developing bias AC along in the present embodiment, this is not restrictive, as long as a desired amount of interposing toner can be obtained. For example, a developing bias DC having a lower absolute value as compared to normal image forming may be applied, as in the second embodiment. Also, forming of the interposing toner may be performed as in the first through thirteenth embodiments. When starting image forming thereafter, electrostatic cleaning of the secondary outer transfer roller 57 may be performed in the same way as in the fourteenth through nineteenth embodiments.

Although the interposing toner forming sequence start signal is emitted in accordance with the amount of environmental moisture in the present embodiment, this is not restrictive. The interposing toner forming sequence start signal may be emitted in accordance with parameters having correlation with the amount of constituents leaching out, such as temperature, humidity, etc., depending on type of the intermediate transfer belt.

Twenty-First Embodiment

A twenty-first embodiment will be described by way of FIGS. 67 and 68, with reference to FIG. 1. In the above-described twentieth embodiment, the interposing toner is formed in a case where predetermined conditions are satisfied when in standby mode. Conversely, in the present embodiment, the interposing toner is also formed when the image forming apparatus enters sleep mode, in addition to the control according to the twentieth embodiment. Other configurations and operations are the same as in the twentieth embodiment, so the same configurations will be denoted by the same reference numerals, and description thereof will be omitted or simplified. Description will be made primarily regarding feature portions of the twenty-first embodiment. Although description is made regarding the image forming station Sa below, the same holds true for the other image forming stations as well.

The image forming apparatus according to the present embodiment is capable of executing a standby mode in a case where no image forming job is being executed, and a sleep mode where the apparatus consumes less electric power than the standby mode. The sleep mode is a mode where part of the operations of the apparatus are temporarily stopped. When the apparatus operates in sleep mode, power supply is stopped to part of the apparatus, so the electric power consumption is less than when in standby mode. For example, while the heater 73 of the fixing device 7 (FIG. 1) remains on in standby mode, the heater 73 of the fixing device 7 turns off (electric power supply is stopped) in the sleep mode.

Figure 67:
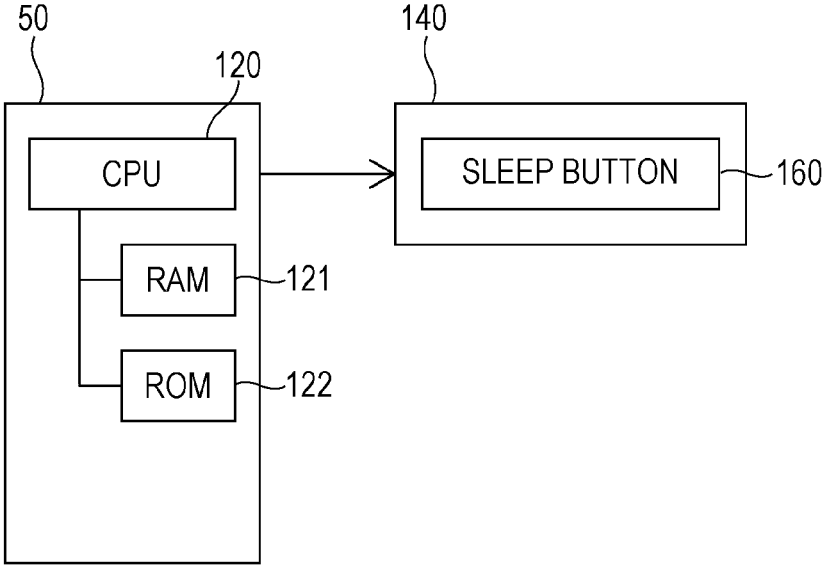
FIG. 67 is a control block diagram of an image forming apparatus according to a twenty-first embodiment.
Figure 68:
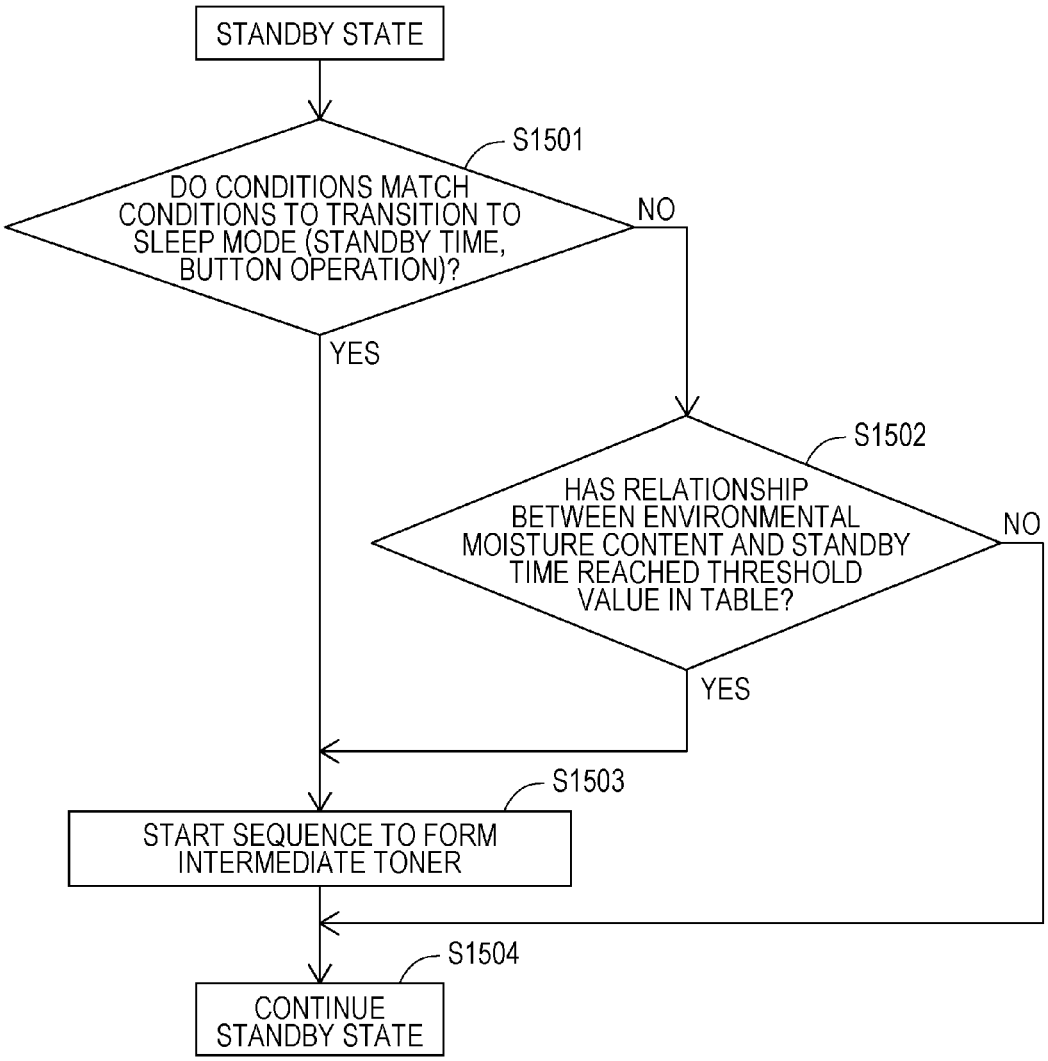
FIG. 68 is a flowchart illustrating a control flow for running the interposing toner forming sequence according to the twenty-first embodiment.

In the case of the present embodiment, a sleep button 160 is provided to the input unit 140 such as an operating panel or the like that the image forming apparatus has, for example, as illustrated in FIG. 67. The CPU 120 transitions the apparatus to the sleep mode in a case where the following conditions are satisfied. Conditions to transition to the sleep mode are a case where a state has continued for a predetermined amount of time where the image forming apparatus has received no image forming jobs, or a case where the sleep button 160 has been operated by the user. The initial settings for the predetermined amount of time to transition to the sleep mode described above is 10 minutes in the present embodiment.

In a case where the CPU 120 judges to transition to the sleep mode, the apparatus is transitioned to the sleep mode. Conditions for recovering from the sleep mode are a case where the user has operated the input unit 140, and a case where image data is transmitted to the apparatus, for example.

When the image forming apparatus transitions to the sleep mode in the present embodiment, the interposing toner forming sequence is activated. This is in order to keep the interposing toner forming sequence from being activated during the sleep mode, to suppress energy consumption. Accordingly, the interposing toner forming sequence is activated at the time of transitioning to the sleep mode, to prevent streaks from forming due to migration of constituents of the intermediate transfer belt to the surface of the photosensitive drum if the sleep mode happens to continue for a long time. Details of the interposing toner forming sequence are the same as in the twentieth embodiment.

In the twentieth embodiment described above, starting of the interposing toner forming sequence was judged by the environmental moisture amount and standby time of the apparatus. However, in the present embodiment, the interposing toner forming sequence is activated when entering the sleep mode, regardless of environmental moisture amount and standby time. FIG. 68 illustrates a control flow according to the present embodiment.

Whether or not conditions to transition to the sleep mode have been reached, in the environment where the image forming apparatus in the standby state (standby mode) is situated, is judged by the CPU 120 (S1501). That is to say, whether a predetermined amount of time has elapsed from the previous image forming job ending (10 minutes for example), or whether the user has operated the sleep button 160, is judged. If YES, the interposing toner forming sequence is started as in FIG. 65 (S1503). After the interposing toner has been formed, the standby state is maintained (S1504).

If NO in S1501, the CPU 120 judges whether or not the relationship between environmental moisture amount and standby time has reached the threshold value in the graph in FIG. 64 described above (S1502). If YES, the interposing toner forming sequence is started as in FIG. 65 (S1503). After the interposing toner has been formed, the standby state is maintained (S1504). If NO, the standby state is maintained without forming the interposing toner (S1504).

As described above, interposing toner is formed when starting the sleep mode, thereby preventing streaks from occurring due to migration of constituents of the intermediate transfer belt to the surface of the photosensitive drum even if the sleep mode happens to continue for a long time, without consuming excessive amounts of toner.

Twenty-Second Embodiment

A twenty-second embodiment will be described by way of FIGS. 69 through 75, with reference to FIGS. 1 and 6. In the above-described embodiments (particularly the fourteenth through nineteenth embodiments), electrostatic cleaning of the secondary outer transfer roller 57 is performed when starting image forming. Conversely, in the present embodiment, test bias is raised at the time of starting image forming if interposing toner has been formed. Other configurations and operations are the same as in the first embodiment, so the same configurations will be denoted by the same reference numerals, and description thereof will be omitted or simplified. Description will be made primarily regarding feature portions of the twenty-second embodiment. Although description is made regarding the image forming station Sa below, the same holds true for the other image forming stations as well.

Interposing Toner

The interposing toner is interposed between the photosensitive drums 1*a* through 1*d* and the intermediate transfer belt 51 when ending image forming, which is the predetermined timing, in the present embodiment as well. The interposing toner is formed in the same way as illustrated in FIGS. 6 and 7 in the first embodiment. To briefly describe this, when ending image forming which is the predetermined timing, a state is realized where charging by the charging roller 2*a* is stopped (charging bias off) and also applying DC voltage at the developing device 4*a* is stopped (developing bias DC off). In this state, Ac voltage is applied to the developing device 4*a* (developing bias AC on), thereby adhering toner to the surface of the photosensitive drum 1*a* and forming the interposing toner t. The driving of the photosensitive drum 1*a* and the intermediate transfer belt 51 is then stopped in the state with the interposing toner t interposed between the photosensitive drum 1*a* and intermediate transfer belt 51.

Thus, in the case of interposing the interposing toner between the photosensitive drum and intermediate transfer belt when ending image forming, the interposing toner adheres to the secondary outer transfer roller 57 when forming the next image. Accordingly, the above-described fourteenth through nineteenth embodiments perform electrostatic cleaning of the secondary outer transfer roller 57 when starting image forming. However, cleaning the secondary outer transfer roller 57 when starting image forming results in image output being delayed by an amount of time equivalent to that involved for the cleaning.

Figures 69, 70, 71:
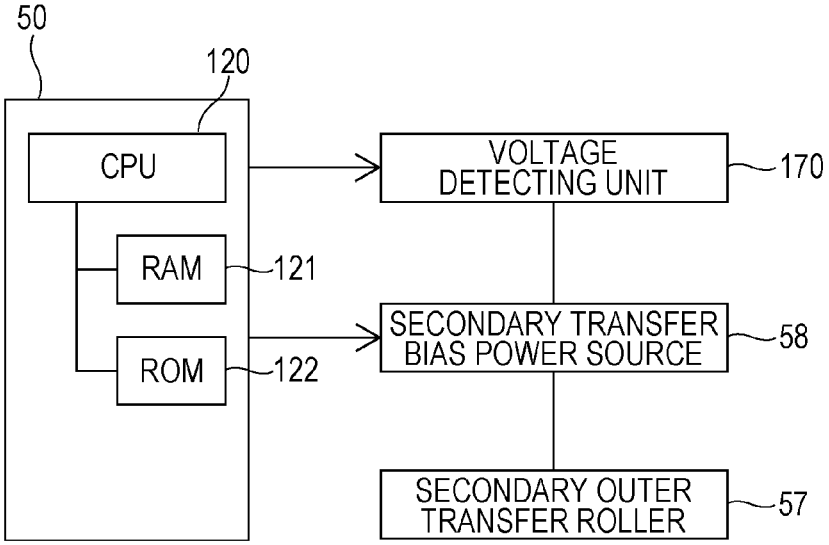
FIG. 69 is a diagram illustrating interposing and not interposing the interposing toner, according to a twenty-second embodiment.
FIG. 70 is a control block diagram of an image forming apparatus according to the twenty-second embodiment.
FIG. 71 is a diagram illustrating a secondary transfer current according to the twenty-second embodiment.

As the number of times of use of the intermediate transfer belt increases, migration of constituents of the intermediate transfer belt such as fluorine compounds and so forth to the photosensitive drum surface decreases. Accordingly, when the number of times of usage of the intermediate transfer belt is great, streaks due to migration of constituents of the intermediate transfer belt such as fluorine compounds and so forth do not occur even if the intermediate transfer belt and photosensitive drum are left in contact for a long period of time. This means that in a case where the usage history of the intermediate transfer belt has reached a certain level or longer, the interposing toner no longer has to be formed. Accordingly, no interposing toner is formed the present embodiment after a certain number of images has been formed. Accordingly, the amount of toner consumed can be suppressed. FIG. 69 illustrates the number of images formed and whether or not to interpose the interposing toner. In the present embodiment, the predetermined number is set to 10,000 sheets, without the interposing toner being formed up to 10,000 sheets, and no longer formed from 10,001 sheets on. Constant Current Secondary Transfer ATVC Now, in order to appropriately transfer a toner image onto the recording medium at the secondary transfer portion N2 (transfer portion) that is between the intermediate transfer belt 51 and the secondary outer transfer roller 57 (transfer member), it is desirable for the current value to be applied to the secondary transfer portion N2 (secondary transfer current value) to be an appropriate value. Using the secondary outer transfer roller 57 may cause the resistance value to change, and a desired current value may not be able to be obtained for the secondary transfer current value even though the same voltage is applied. Accordingly, what is known as secondary transfer Active Transfer Voltage Control (ATVC), where a test bias is applied to decide an appropriate transfer voltage before the recording medium reaches the secondary transfer portion N2 (correction mode), is performed so that image forming can be performed by an appropriate secondary transfer current value.

Specifically, the secondary transfer bias power source 58 serving as a bias applying unit applies multiple test biases, with different magnitudes from each other, to the secondary outer transfer roller 57, as illustrated in FIG. 70. At the time of starting image forming, constant voltage secondary transfer ATVC is performed in the present embodiment, where multiple current values (test biases) are applied with a constant current, which will be described later. Each voltage value here is detected by a voltage detecting unit 170, and the results of detection thereof are stored in a storage device, such as the RAM 121 of the control circuit 50. The CPU 120 decides the secondary transfer voltage to be applied to the secondary outer transfer roller 57 when forming the image, based on the voltage values detected.

The control for constant current secondary transfer ATVC (hereinafter, simply "ATVC") differs in the present embodiment depending on whether interposing toner has been formed or not. That is to say, a first stopping mode and a second stopping mode can be executed in the present embodiment. The first stopping mode is a mode where driving of the photosensitive drum 1*a* and intermediate transfer belt 51 is stopped in a state where interposing toner is formed between the photosensitive drum 1*a* and intermediate transfer belt 51, as described above. The second stopping mode a mode where driving of the photosensitive drum 1*a* and intermediate transfer belt 51 is stopped in a state where no interposing toner is formed between the photosensitive drum 1*a* and intermediate transfer belt 51. The test bias applied at the timing of the interposing toner reaching the secondary transfer portion N2 in a case where ATVC is to be executed after stopping in the first stopping mode, is set higher than the test bias in a case of executing ATVC after stopping in the second stopping mode.

ATVC in Case where No Interposing Toner is Formed

First, ATVC in a case where no interposing toner has been formed (ATVC after stopping in second stopping mode) will be described with reference to FIGS. 71 and 72. In the present embodiment, ATVC is performed where an appropriate secondary transfer current value (test bias) is applied from the secondary transfer bias power source 58 by constant current control, and the secondary transfer voltage for the image being formed is decided based on the applied voltage value at that time. This ATVC is performed during pre-rotation when starting the image forming job (the period between starting of the image forming job till the recording medium reaches the secondary transfer portion N2).

A secondary transfer current value 2TrI(1) appropriate for the first side of the recording medium in a case of performing both-sided printing, and a secondary transfer current value 2TrI(2) appropriate for the second side, are applied as test biases in the present embodiment. FIG. 71 shows the secondary transfer current values appropriate for each. The secondary transfer current value 2TrI(1) appropriate for the first side is 50 μA, and the secondary transfer current value 2TrI(2) appropriate for the second side is 40 μA. While forming the images, secondary transfer voltages Vtr1 and Vtr2 that cause the 2TrI(1) and 2TrI(2) to flow are applied from the secondary transfer bias power source 58 by constant voltage to the secondary outer transfer roller 57.

In the ATVC, the 2TrI(1) and 2TrI(2) are applied from the secondary transfer bias power source 58 by constant voltage to the secondary outer transfer roller 57, in order to decide (correct to) the secondary transfer voltages Vtr1 and Vtr2. The voltage values Vb1 and Vb2 of each at this time are detected. Divided voltages Vp1 and Vp2 of the recording medium to be used are added to the detected voltage values Vb1 and Vb2, thereby deciding the secondary transfer voltages Vtr1 (i.e., Vb1+Vp1) and Vtr2 (i.e., Vb2+Vp2).

Figure 72:
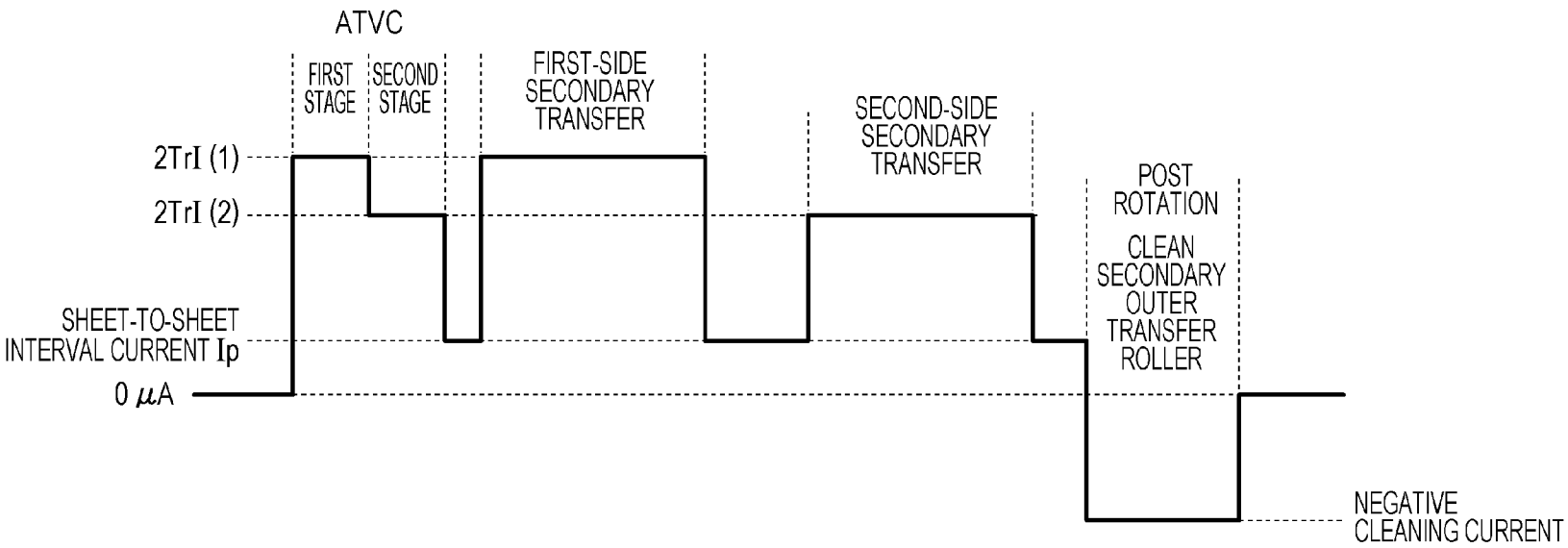
FIG. 72 is a timing chart illustrating the behavior of the secondary transfer current in a case where interposing toner is not interposed, according to the twenty-second embodiment.

FIG. 72 shows the way in which the secondary transfer voltage value changes from the start of the image forming job, including the ATVC performed during pre-rotation, in a case where no interposing toner is interposed. When a both-sided image forming job starts, for example, ATVC is performed first. In the ATVC, 2TrI(1) is applied at a constant current as a first stage, and then 2TrI(2) is applied at a constant current as a second stage. The voltage detecting unit 170 detects the voltage values Vb1 and Vb2 at each, and the detection results are stored in the RAM 121 of the control circuit 50. The CPU 120 then adds the divided voltages Vp1 and Vp2 to the detected voltage values Vb1 and Vb2, and decides the secondary transfer voltages Vtr1 and Vtr2. Note that the current value Ip shown in FIG. 72 is a current applied to the secondary transfer portion N2 between recording medium and recording medium (inter-sheet current).

After having decided the secondary transfer voltages Vtr1 and Vtr2, the decided secondary transfer voltage Vtr1 is applied as constant voltage to the first side of the recording medium entering the secondary transfer portion N2, thereby transferring the toner image from the intermediate transfer belt 51 onto the first side of the recording medium. Next, the decided secondary transfer voltage Vtr2 is applied to the second side of the recording medium, thereby transferring the toner image from the intermediate transfer belt 51 onto the second side of the recording medium. Thereafter, voltage of opposite polarity as to the toner is applied to the secondary outer transfer roller 57, thereby performing secondary transfer roller cleaning. Thus, negative cleaning current flows to the secondary transfer portion N2, and toner adhered to the secondary outer transfer roller 57 moves to the intermediate transfer belt 51. The toner that has moved to the intermediate transfer belt 51 is cleaned by the belt cleaner 60.

ATVC in Case where Interposing Toner is Formed

Next, ATVC in a case where interposing toner has been formed (ATVC after stopping in the first stopping mode) will be described. In a case of having formed interposing toner, performing electrostatic cleaning of the secondary outer transfer roller 57 at the time of starting image forming to clean the toner adhering to the secondary outer transfer roller 57 causes image output to be delayed accordingly, as described above. That is to say, performing both electrostatic cleaning and ATVC in a case of performing ATVC when starting image forming results in a longer time from the start of the image forming job to the first image output (pre-rotation time). On the other hand, if the toner is left adhered to the secondary outer transfer roller 57, the interposing toner will cause backside contamination of the recording medium.

On the other hand, it is conceivable to reduce the ATVC time and perform ATVC and cleaning of the secondary outer transfer roller 57, so that the pre-rotation time does not become lower. However, this may reduce the accuracy of ATVC. That is to say, there is a possibility that the secondary transfer current while forming the image may markedly deviate from 2TrI (1) and 2TrI(2).

Accordingly, in the present embodiment, a larger current value than the secondary transfer current value applied in the ATVC in FIG. 72 described above is applied in the ATVC when starting the next image forming after having formed the interposing toner. Thus, both prevention of backside contamination of the recording medium, and reduction in the pre-rotation when starting image forming (the time for starting the image forming job to output of the first image) are realized. This will be described in detail.

In a case of having formed interposing toner in the present embodiment, the current value applied in the first stage of the two stages of current values (test biases) applied in ATVC is set to 2TrI_D, which is larger than the test biases 2TrI(1) and 2TrI(2) in FIG. 72. 2TrI_D is 70 μA in the present embodiment.

Figure 73:
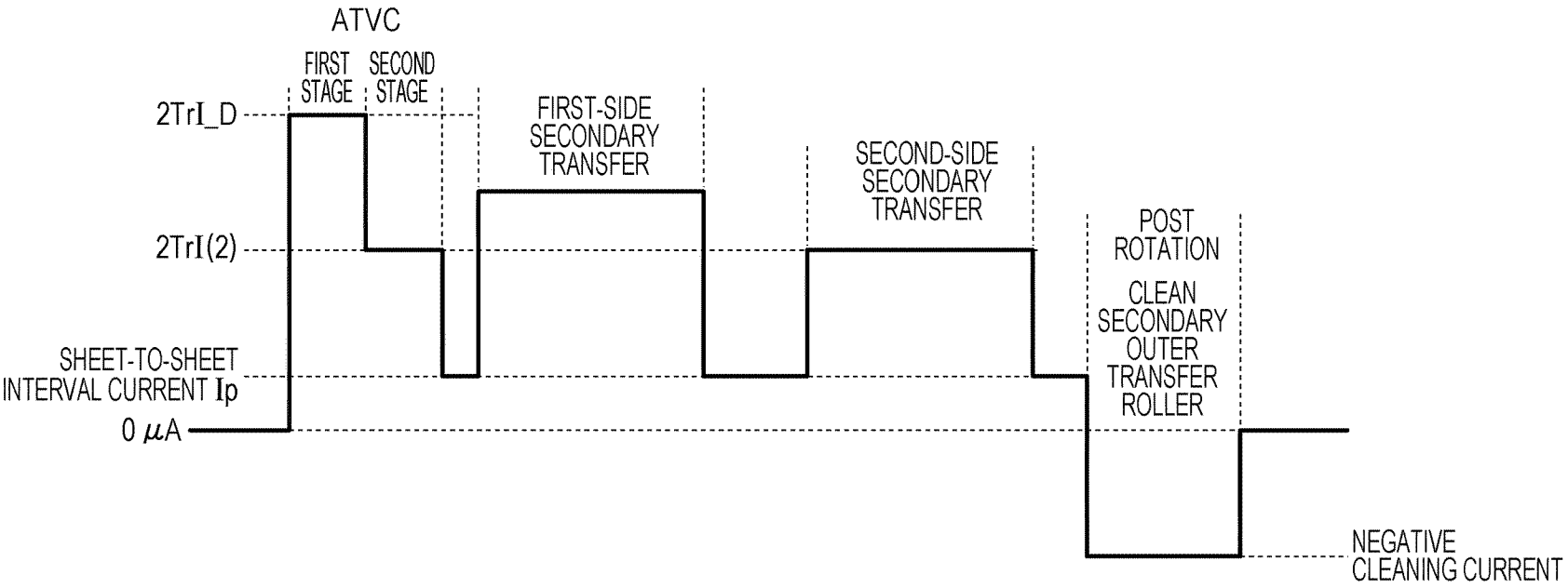
FIG. 73 is a timing chart illustrating the behavior of the secondary transfer current in a case where interposing toner is interposed, according to the twenty-second embodiment.

FIG. 73 shows the way in which the secondary transfer voltage value changes from the start of the image forming job, including the ATVC performed during pre-rotation, in a case where interposing toner has been formed. This is the same as that illustrated in FIG. 72, except that the value of the constant current applied in the first stage of ATVC is 2TrI_D.

Now, the reason why the first stage in the ATVC in a case where interposing toner has been formed is set to a large current value 2TrI_D that is 70 μA will be described. In a case where interposing toner is formed, the interposing toner will adhere to the secondary outer transfer roller 57 when forming the next image, as described above. At this time, the adhered toner can be powerfully held on the surface of the secondary outer transfer roller 57 by applying 2TrI_D of 70 μA, which is a large current value, as the test bias during the pre-rotation ATVC when starting image forming. That is to say, interposing toner is adhered to the secondary outer transfer roller 57 in the pre-rotation, and the toner is powerfully held at the secondary outer transfer roller 57 by the first-stage test bias in ATVC. Accordingly, even of the recording medium passes through the secondary transfer portion N2 thereafter, the toner adhered to the secondary outer transfer roller 57 can be suppressed from moving to the back side of the recording medium, and thus backside contamination of the recording medium can be suppressed.

FIG. 74 is a diagram illustrating backside contamination of the recording medium in a case where an image forming job is started from a stopped state in which interposing toner is present at the primary transfer portion N1*a*, and the current value at the first stage of ATVC is changed. Cases where backside contamination was conspicuous to the eye are indicated in FIG. 74 by "poor", cases where somewhat conspicuous but in a tolerable range by "fair", and cases where not conspicuous by "good". It can be seen from FIG. 74 that the larger the current value is, the more improvement there is with regard to backside contamination. It was found that backside contamination became tolerable when the current value was 60 μA or higher, and backside contamination became inconspicuous at 70 μA or higher. Accordingly, In a case where interposing toner has been formed, the 2TrI_D applied at the first stage in ATVC preferably is 60 μA or higher, and more preferably 70 μA or higher. Accordingly, 2TrI_D is set to 70 μA in the present embodiment.

Note that the toner powerfully held at the surface of the secondary outer transfer roller 57 in the ATVC is transferred to the intermediate transfer belt 51 by application of bias of opposite polarity to the toner being applied during the secondary outer transfer roller cleaning during post rotation after forming the image, as illustrated in FIG. 73. Thus, the surface of the secondary outer transfer roller 57 is cleaned.

Next, a method of calculating the transfer voltage Vtr1 for the first side and the transfer voltage Vtr2 for the second side, in a case of having applied the current value 2TrI_D, which is greater than the secondary transfer current value 2TrI(1) applied to the first side of the recording medium, in the first stage of ATVC, will be described with reference to FIG. 70.

The control circuit 50 inputs the 2TrI_D and 2TrI(2) into the secondary transfer bias power source 58, and the secondary transfer bias power source 58 applies the 2TrI_D and 2TrI_(2) as constant current to the secondary outer transfer roller 57. The voltage detecting unit 170 detects the respective voltage values Vb_D and Vb2 at this time, and inputs to the control circuit 50. The CPU 120 calculates Vb1 corresponding to the secondary transfer current value 2TrI(1) appropriate for the first side, from the results of linear interpolation of 2TrI_D and 2TrI(2), and Vb_D and Vb2. Thereafter, the divided voltages Vp1 and Vp2 of the recording medium stored in the ROM 122 beforehand are added, thereby deciding the secondary transfer voltages Vtr1 (i.e., Vb1+Vp1) and Vtr2 (i.e., Vb2+Vp2).

The control circuit 50 inputs the Vtr1 and Vtr2 decided in this way to the secondary transfer bias power source 58. The secondary transfer bias power source 58 applies the Vtr1 and Vtr2 to the secondary outer transfer roller 57 respectively for the first side and second side of the recording medium at constant voltage when forming images.

Now, the reason why the second stage of ATVC is set to the secondary transfer current 2TrI(2) that is appropriate for the second side of the recording medium, in a case of having formed interposing toner, will be described. 2TrI(2) is lower than 2TrI(1), so 2TrI(2) is farther away from 2TrI_D than 2TrI(1) is. Accordingly, using the secondary transfer current 2TrI(2) that is appropriate for the second side of the recording medium in the second stage of ATVC enables the Vtr2 to apply to the second side to be accurately obtained, and further, the accuracy of the calculation results regarding the above-described linear interpolation can be improved. That is to say, the accuracy of calculation of Vb1 and Vb2 described above can be improved.

The reason why ATVC is as shown in FIG. 72 when no interposing toner is formed is as follows. If there is no interposing toner, there is no concern of backside contamination of the recording medium after the image forming job has started, and so there is no need to apply the 2TrI_D that is a large current during pre-rotation, as described above. Not forming interposing toner means that the number of times of usage of the intermediate transfer belt 51 is great. Accordingly, the toner and intermediate transfer belt 51 have been used for a long time, and secondary transfer performance has deteriorated, as illustrated in FIG. 69, so the ATVC accuracy preferably is maximally raised.

Further, in a case where 2TrI_D, which is the large voltage value, is applied in the first stage of ATVC, there arises the need for calculation of linear interpolation for the transfer voltage Vtr1 regarding the first side of which the image is being formed. Accordingly, there is a possibility that the transfer current of the first side of which the image is being formed will shift toward 2TrI(1) as compared to the ATVC illustrated in FIG. 72. Accordingly, the ATVC illustrated in FIG. 72 is performed in cases where no interposing toner is formed and there is no concern of backside contamination of the recording medium.

Figure 75:
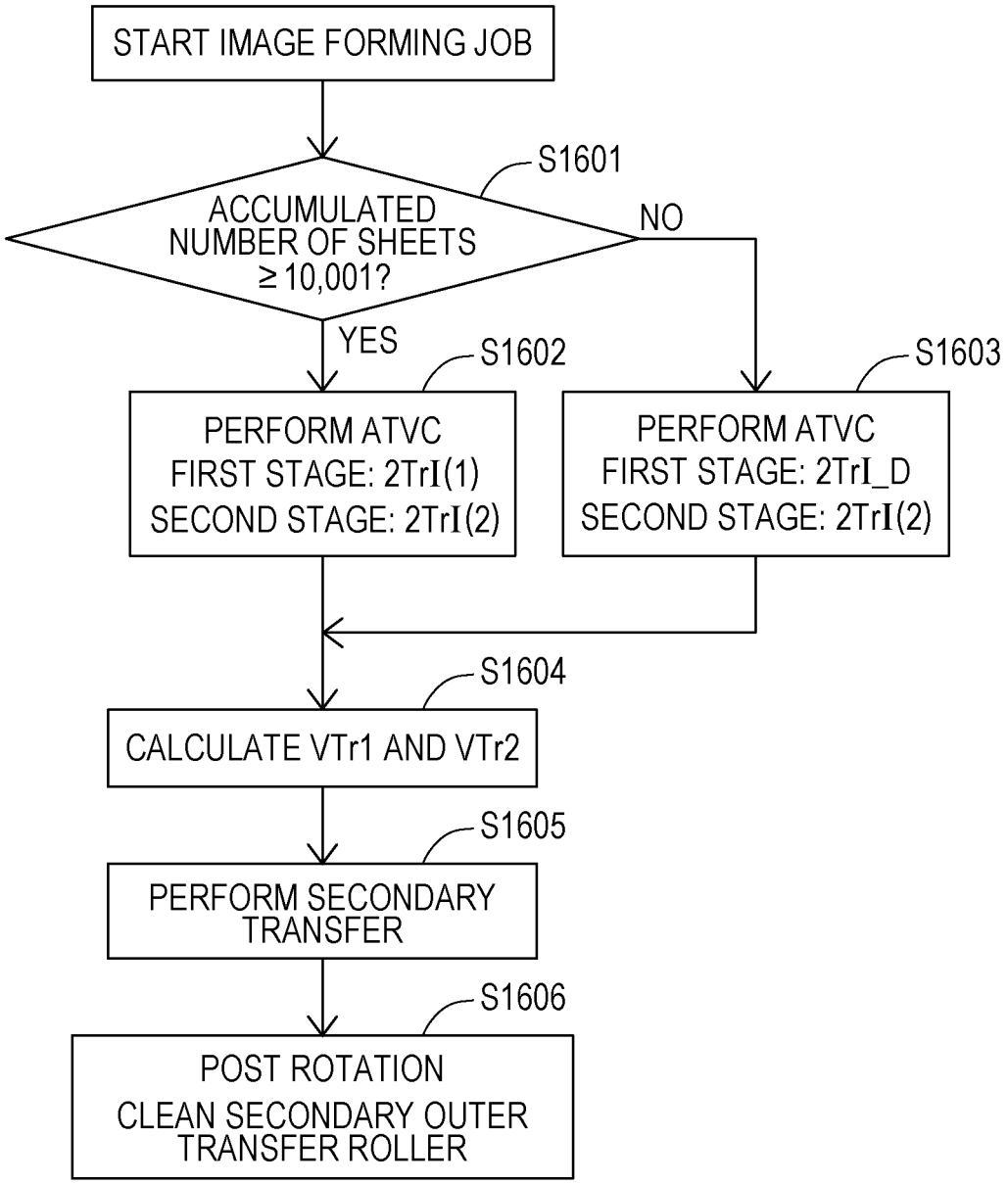
FIG. 75 is a flowchart of control relating to secondary transfer by the image forming apparatus according to the twenty-second embodiment.

FIG. 75 illustrates a flowchart relating to the secondary transfer according to the present embodiment. Upon an image forming job being started, judgment is made regarding whether or not interposing toner has been formed (S1601). In the present embodiment, the number of times that the intermediate transfer belt 51 has been used, i.e., the total number of images formed by performing image forming by the image forming apparatus (total number of pages). This total number of pages is accumulated by the CPU 120, and sorted in a storage device such as the RAM 121 or the like. The threshold value for judgment is 10,001, as described in FIG. 69. That is to say, no interposing toner is formed if the total number of pages is 10,001 or more, but is formed if any less.

In a case where interposing toner is not formed, the ATVC shown in FIG. 72 is performed during pre-rotation (S1602). On the other hand, in a case where interposing toner is formed, the ATVC shown in FIG. 73 is performed during pre-rotation (S1603). After either ATVC, the secondary transfer voltages Vtr1 and Vtr2 for the first side and second side when forming images are calculated from the results thereof (S1604). The secondary transfer is started (S1605), and thereafter, secondary outer transfer roller cleaning is executed in the post rotation (S1606).

As described above, in a case of starting an image forming job from a stopped state where interposing toner is present at the primary transfer portion N1, a current that powerfully attracts toner to the surface of the secondary outer transfer roller 57 is applied in the first stage of ATVC. Accordingly, backside contamination of the recording medium can be prevented without extending the pre-rotation time.

Although forming of the interposing toner in the present embodiment has been described as being performed by the developing bias AC alone, but this is not restrictive, as long as the desired amount of interposing toner is obtained. For example, developing bias DC may be applied that has a lower absolute value than normal image forming, as described in the second embodiment. Alternatively, interposing toner may be formed by forming a latent image on the photosensitive drum and developing it. Further, the content of any one of the first through thirteenth embodiments may be combined as appropriate with regard to formation of interposing toner. Also, interposing toner may be formed in a case where predetermined conditions are satisfied in the standby mode, as in the twentieth and twenty-first embodiments. Moreover, ATVC as a correction mode is not restricted to the above-described constant current for being carried out, and an arrangement may be made, for example, where multiple voltages are applied and the current values of each are detected, and the relationship between voltage and current is obtained.

Twenty-Third Embodiment

Figure 76:
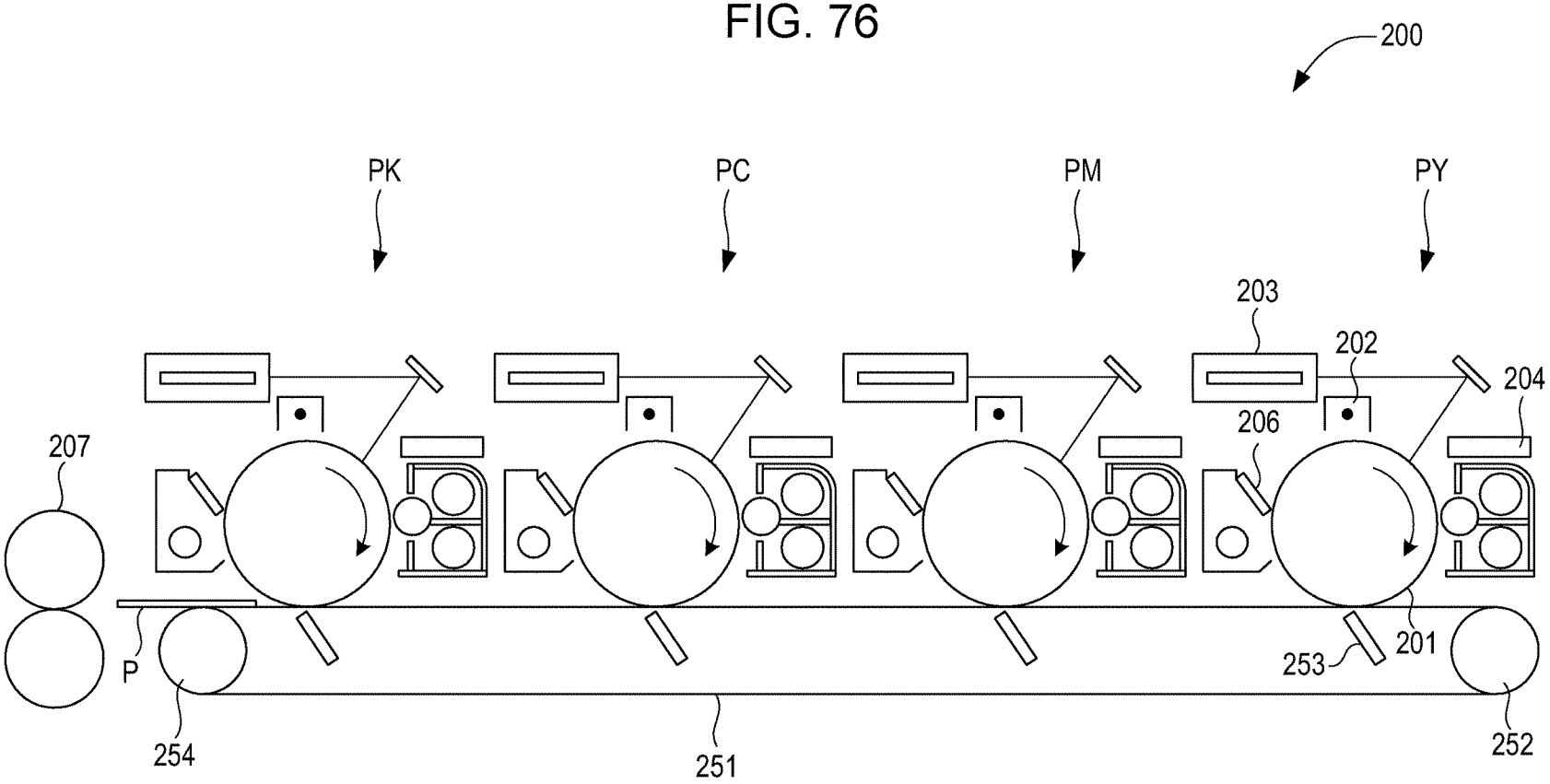
FIG. 76 is a schematic configuration diagram of an image forming apparatus according to a twenty-third embodiment.

A twenty-third embodiment will be described with reference to FIG. 76. An intermediate-transfer image forming apparatus using the intermediate transfer belt 51 has been described in the above embodiments. Conversely, the present embodiment is a direct-transfer image forming apparatus where a toner image is directly transferred from a photosensitive drum serving as an image bearing member onto a recording medium.

An image forming apparatus 200 is a full-color electrophotography image forming apparatus using a tandem direct transfer system, where multiple image forming stations PY, PM, PC, and PK, that each have different toner colors, are arrayed in the rotation direction of a recording medium conveying belt 251. The image forming stations PY, PM, PC, and PK form toner images of the colors yellow, magenta, cyan, and black, respectively. The configurations of the image forming stations are essentially the same, except that the color of the toner used is different. Accordingly, description will be made using the image forming station PY representatively, and reference symbols and description of the other image forming stations will be omitted.

The image forming station PY includes a primary charger 202, an exposing device 203, a developing device 204, a transfer charger 253, and a drum cleaning device 206, disposed around a photosensitive drum 201 serving as an image bearing member. The photosensitive drum 201 serving as an image bearing member has a photosensitive layer formed on the outer circumferential layer, and rotates in the direction of the arrow at a predetermined process speed.

The primary charger 202 serving as a charging unit irradiates the photosensitive drum 201 by charged particles from corona discharge, for example, to a uniform dark potential of negative polarity. The exposing device 203 serving as an exposing unit scans a laser beam, of which on/off has been modulated by scanning line image data where color separation images of each color have been rasterized, over a rotary mirror, so as to write an electrostatic latent image of the image on the surface of the charged photosensitive drum 201. The developing device 204 serving as a developing unit supplies toner to the photosensitive drum 201, and develops the electrostatic latent image into a toner image.

The transfer charger 253 has a transfer blade. This transfer blade is pressed against the recording medium conveying belt 251, so as to form a toner image transfer portion between the photosensitive drum 201 and the recording medium conveying belt 251. DC voltage of opposite polarity as to the charging polarity of the toner is applied to the transfer blade, so that the toner image borne on the photosensitive drum 201 is transferred to the recording medium P borne by the recording medium conveying belt 251. Residual toner remaining borne on the photosensitive drum 201 after transfer is removed by the drum cleaning device 206.

The recording medium conveying belt 251 serving as a recording medium conveying member is an endless belt having an outermost layer (the layer bearing the recording medium) that includes a coat layer and elastic layer, in the same way as the intermediate transfer belt described above. The recording medium conveying belt 251 is tensioned by a driving roller 252 and tension roller 254, and is rotationally driven by the driving roller 252. The recording medium conveying belt 251 is disposed so as to come into contact with the photosensitive drum 201, and conveys the recording medium P borne on its surface. The recording medium conveying belt 251 further conveys the recording medium downstream after transfer of the toner image has been performed form the photosensitive drum 201 at the above-described transfer portion. The recording medium P from which the toner image has been transferred is heated and pressured by a fixing unit 207, so that the toner image is fixed.

The image forming apparatus 200 according to the present embodiment as described above also forms a interposing toner image at a predetermined timing, as in the above-described first through thirteenth, twentieth, and twenty-first embodiments, so that the interposing toner is interposed between the photosensitive drum 201 and the recording medium conveying belt 251. Other configurations and operations thereof are the same as in the above-described first through thirteenth, twentieth, and twenty-first embodiments.

Other Embodiments

The above embodiments may be combined and carried out as suitable. For example, in a case of forming interposing toner, the interposing toner density may be adjusted by combining at least one of toner density information, environment information, process speed, and intermediate transfer belt or recording medium conveying belt usage history. In a case of performing electrostatic cleaning of the secondary outer transfer roller 57, at least one of toner density information, environment information, process speed, and information of the surface properties of the recording medium may be combined to change the cleaning conditions.

According to the present embodiment, the amount of toner interposed between the image bearing member and the rotating member can be prevented from being excessive.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2015-168420, filed Aug. 28, 2015, which is hereby incorporated by reference herein in its entirety.

What is claimed is:

1. An image forming apparatus comprising:

an image bearing member configured to bear an image thereon;

a charging device configured to charge a surface of the image bearing member;

an exposing device configured to expose the charged surface of the image bearing member and form an electrostatic latent image;

a developing device configured to develop the electrostatic latent image formed on the surface of the image bearing member by voltage being applied where AC voltage has been superimposed on DC voltage;

a rotating member, provided rotatably, and disposed in contact with the image bearing member; and a control unit configured to effect control to, corresponding to an end of an image forming job, stop application of the DC voltage by the charging device in a state where the image bearing member is driven, stop application of the DC voltage of the developing device after the surface of the image bearing member facing the charging device when the application of DC voltage by the charging device stops has passed the developing device, and stop driving of the image bearing member after application of DC voltage by the developing device has stopped, wherein the control unit is configured to execute a mode of controlling driving of the image bearing member, corresponding to an end of the image forming job, after stopping application of the DC voltage at the charging device and the developing device, the control unit drives the image bearing member in a state with AC voltage applied to the developing device so as to adhere toner to the image bearing member, and controls driving of the image bearing member so that the surface of the image bearing member, that has passed a position facing the developing device at a time of AC voltage being applied to the developing device, stops at a position in contact with the rotating member.

2. The image forming apparatus according to claim 1, wherein the control unit stops application of the AC voltage at the developing device after driving of the image bearing member and rotating member stops.

3. The image forming apparatus according to claim 1, wherein the control unit can drive the image bearing member and the rotating member at a first speed, and a second speed slower than the first speed, and when in the mode, effects control such that in a time from stopping the driving of the image bearing member and the rotating member until stopping applying AC voltage and the developing device, an amount of time of being driven at the second speed is shorter than an amount of time of being driven at the first speed.

4. The image forming apparatus according to claim 1, wherein an amount of toner adhering to the image bearing member at the time of applying AC voltage at the developing device when in the mode, is 0.001 to 0.03 $mg/cm^2$.

5. The image forming apparatus according to claim 1, wherein the rotating member is an intermediate transfer member that rotates while bearing a toner image transferred from the image bearing member.

6. The image forming apparatus according to claim 1, wherein the control unit changes at least one of duty ratio, amplitude, and frequency, of a waveform of AC voltage to be applied to the developing device when in the mode.

7. The image forming apparatus according to claim 1, further comprising:

a toner density information detecting unit configured to detect information relating to density of a toner image developed by the developing device, wherein the control unit changes at least one of duty ratio, amplitude, and frequency, of the waveform of AC voltage to be applied to the developing device when in the mode, in accordance with detection results from the toner density information detecting unit.

8. The image forming apparatus according to claim 1, further comprising:

an apparatus main unit in which the image bearing member, the charging device, the exposing device, the developing device, and the rotating member are accommodated; and an environment detecting unit configured to detect an environment within the apparatus main unit;

wherein the control unit changes at least one of duty ratio, amplitude, and frequency, of the waveform of AC voltage to be applied to the developing device when in the mode, in accordance with the detection results of the environment detecting unit.

9. The image forming apparatus according to claim 1, wherein the control unit can drive the image bearing member and the rotating member at a plurality of speeds, and changes at least one of duty ratio, amplitude, and frequency, of the waveform of AC voltage to be applied to the developing device when in the mode, in accordance with the speed.

10. The image forming apparatus according to claim 1, wherein the control unit adjusts the density of toner adhering to the image bearing member when in the mode, in accordance with a count of times of use of the rotating member.

11. The image forming apparatus according to claim 1, wherein the control unit does not execute the mode in a case where the count of times of use of the rotating member is a predetermined number of times or more.

12. An image forming apparatus comprising:

an image bearing member configured to bear an image thereon;

a charging device configured to charge a surface of the image bearing member;

an exposing device configured to expose the charged surface of the image bearing member and form an electrostatic latent image;

a developing device configured to develop the electrostatic latent image formed on the surface of the image bearing member by voltage being applied where AC voltage has been superimposed on DC voltage;

a rotating member, provided rotatably, and disposed in contact with the image bearing member; and a control unit configured to effect control to, corresponding to an end of an image forming job, stop application of the DC voltage by the charging device in a state where the image bearing member is driven, stop application of the DC voltage of the developing device after the surface of the image bearing member facing the charging device when the application of DC voltage by the charging device stops has passed the developing device, and stop driving of the image bearing member after application of DC voltage by the developing device has stopped, wherein the control unit can execute a standby mode where image forming operations standby in a case where no image forming job is being executed, and a sleep mode where consumption of electric power is less than in the standby mode, and is configured to, upon starting of the sleep mode, stop application of the DC voltage at the charging device and the developing device, and also drive the image bearing member in a state with AC voltage applied to the developing device so as to adhere toner to the image bearing member, and controls driving of the image bearing member so that the surface of the image bearing member, that has passed a position facing the developing device at a time of AC voltage being applied to the developing device, stops at a position in contact with the rotating member.

13. An image forming apparatus comprising:

an image bearing member configured to bear an image thereon;

a charging device configured to charge a surface of the image bearing member;

an exposing device configured to expose the charged surface of the image bearing member and form an electrostatic latent image;

a developing device configured to develop the electrostatic latent image formed on the surface of the image bearing member by voltage being applied where AC voltage has been superimposed on DC voltage;

an intermediate transfer member disposed in contact with the image bearing member, the intermediate transfer member provided rotatably and configured to bear a toner image transferred from the image bearing member;

a transfer member configured to transfer the toner image transferred onto the intermediate member onto a recording medium at a transfer portion;

a bias applying device configured to apply bias to the transfer member; and a control unit configured to, at a predetermined timing, execute a first stopping mode of forming interposing toner on a surface of the image bearing member and stopping driving of the image bearing member and the intermediate transfer member in a state where the interposing toner is interposed between the image bearing member and the intermediate transfer member, and a second stopping mode of stopping driving of the image bearing member and the intermediate transfer member in a state where no interposing toner is interposed between the image bearing member and the intermediate transfer member, and configured to execute a correction mode to correct bias applied to the transfer member at a time of image forming, by applying a test bias by the bias applying device before an image forming operation, and in a case of executing the correction mode after having stopped in the first stopping mode, sets the test bias applied during the interposing toner passing the transfer portion higher than the test bias applied in a case of executing the correction mode after having stopped in the second stopping mode.

14. The image forming apparatus according to claim 13, wherein the intermediate transfer member is an endless belt having a coat layer formed on a surface of an elastic layer, with the coat layer being an outermost layer.

15. The image forming apparatus according to claim 13, wherein fluorine or a fluorine compound is dispersed in the coat layer.

16. An image forming apparatus comprising:

an image bearing member configured to bear an image thereon;

a charging device configured to charge a surface of the image bearing member;

an exposing device configured to expose the charged surface of the image bearing member and form an electrostatic latent image;

a developing device configured to develop the electrostatic latent image formed on the surface of the image bearing member by voltage being applied where AC voltage has been superimposed on DC voltage;

a rotating member, provided rotatably, and disposed in contact with the image bearing member; and a control unit configured to effect control to, corresponding to an end of an image forming job, stop application of the DC voltage by the charging device in a state where the image bearing member is driven, stop application of the DC voltage of the developing device after the surface of the image bearing member facing the charging device when the application of DC voltage by the charging device stops has passed the developing device, and stop driving of the image bearing member after application of DC voltage by the developing device has stopped, wherein the control unit is configured to execute a mode of controlling driving of the image bearing member, corresponding to an end of the image forming job, after stopping application of the DC voltage at the developing device, the control unit drives the image bearing member in a state with AC voltage applied to the developing device so as to adhere toner to the image bearing member, and controls driving of the image bearing member so that the surface of the image bearing member, that has passed a position facing the developing device at a time of AC voltage being applied to the developing device, stops at a position in contact with the rotating member.

17. The image forming apparatus according to claim 16, wherein fog-removing contrast when in the mode is equal to or smaller than fog-removing contrast when forming an image.

* * * * *